US006901232B2

(12) United States Patent
Sakuma et al.

(10) Patent No.: US 6,901,232 B2
(45) Date of Patent: May 31, 2005

(54) DEVELOPING APPARATUS AND IMAGE FORMING APPARATUS USING PROGRESSIVE WAVE ELECTRIC FIELD TRANSPORT

(75) Inventors: Masamitsu Sakuma, Hirakata (JP); Katsumi Adachi, Nara (JP); Taisuke Kamimura, Nara (JP); Kiyoshi Toizumi, Nara (JP); Toshimitsu Gotoh, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/481,338

(22) PCT Filed: Jun. 21, 2002

(86) PCT No.: PCT/JP02/06234

§ 371 (c)(1),
(2), (4) Date: Jun. 14, 2004

(87) PCT Pub. No.: WO03/001303

PCT Pub. Date: Jan. 3, 2003

(65) Prior Publication Data

US 2004/0213608 A1 Oct. 28, 2004

(30) Foreign Application Priority Data

Jun. 22, 2001 (JP) ..... 2001-190065
Aug. 30, 2001 (JP) ..... 2001-261806

(51) Int. Cl.[7] ..... G03G 15/08
(52) U.S. Cl. ..... 399/266; 399/289; 399/291
(58) Field of Search ..... 399/281, 285, 399/289, 290, 291, 266, 265, 53, 55; 347/55

(56) References Cited

U.S. PATENT DOCUMENTS 4,962,723 A * 10/1990 Hotomi ..... 399/266
5,414,497 A 5/1995 Tsuchiya et al. ..... 399/272
6,652,938 B1 * 11/2003 Nishikawa et al. ..... 428/35.9
6,708,014 B2 * 3/2004 Miyaguchi et al. ..... 399/266
2002/0037182 A1 * 3/2002 Miyaguchi et al. ..... 399/252

FOREIGN PATENT DOCUMENTS

| | | | |
|---|---|---|---|
| EP | 0 762 231 A2 | | 3/1997 |
| JP | 63-13069 A | | 1/1988 |
| JP | 4-204570 A | | 7/1992 |
| JP | 5-31146/1993 B2 | | 5/1993 |
| JP | 5-31147/1993 B2 | | 5/1993 |
| JP | 07-064390 | * | 3/1995 |
| JP | 09-68864 A | | 3/1997 |
| JP | 2000-112239 A | | 4/2000 |
| JP | 2001-122436 | * | 5/2001 |
| JP | 2002-091160 | * | 3/2002 |
| JP | 2002-099142 | * | 4/2002 |
| JP | 2002-099143 | * | 4/2002 |
| JP | 2002-116620 | * | 4/2002 |
| WO | WO 99/01800 A1 | | 1/1999 |

* cited by examiner

*Primary Examiner*—Sophia S. Chen
(74) *Attorney, Agent, or Firm*—Birch, Stewart, Kolasch & Birch, LLP

(57) ABSTRACT

On surfaces of insulating layers 1*b* and 1*c* of a transportation member 1, a protective layer 1*d* having a volume resistivity of $10^{10}$ Ω·cm to $10^{17}$ Ω·cm is so laminated that a sum of thickness of the insulating layers 1*b* and 1*c* is less than intervals between adjacent ones of progressive wave generating electrodes 2. With this arrangement, it is ensured that a progressive wave electric field generated by the progressive wave generating electrodes 2 is exposed beyond a surface of the transportation member 1. Even if developer T and the transportation member 1 contact each other, a surface potential of the transportation member 1 is not changed. Moreover, firm adhering of the toner T to the surface of the transportation member 1 is prevented. It is therefore possible to certainly transport the developer T to a development position always stably.

12 Claims, 33 Drawing Sheets

FIG. 14

| FREQUENCY f (Hz) | PITCH λ (m) BETWEEN ELECTRODES | VALUE OF λ × f | EVALUATION | RELATIVE VALUE OF TRANSPORTATION AMOUNT | TRANSPORTATION STATE |
|---|---|---|---|---|---|
| 300 | 1.30E-04 | 0.04 | BAD | 20% | FIXATION AMOUNT LARGE, UNSTABLE |
| 900 | | 0.12 | GOOD | 70% | STABLE TRANSPORTATION |
| 1200 | | 0.16 | GOOD | 85% | STABLE TRANSPORTATION |
| 2500 | | 0.33 | GOOD | 100% | STABLE, PEAK OF TRANSPORTATION AMOUNT |
| 3500 | | 0.46 | GOOD | 75% | STABLE TRANSPORTATION |
| 4200 | | 0.55 | BAD | 10% | FIXATION AMOUNT LARGE, UNSTABLE |
| 300 | 1.70E-04 | 0.05 | BAD | 20% | FIXATION AMOUNT LARGE, UNSTABLE |
| 800 | | 0.14 | GOOD | 80% | STABLE TRANSPORTATION |
| 1200 | | 0.2 | GOOD | 90% | STABLE TRANSPORTATION |
| 1900 | | 0.32 | GOOD | 100% | STABLE, PEAK OF TRANSPORTATION AMOUNT |
| 2500 | | 0.43 | GOOD | 85% | STABLE TRANSPORTATION |
| 3100 | | 0.53 | BAD | 20% | FIXATION AMOUNT LARGE, UNSTABLE |
| 150 | 2.50E-04 | 0.04 | BAD | 20% | FIXATION AMOUNT LARGE, UNSTABLE |
| 600 | | 0.15 | GOOD | 80% | STABLE TRANSPORTATION |
| 1300 | | 0.33 | GOOD | 100% | STABLE, PEAK OF TRANSPORTATION AMOUNT |
| 1500 | | 0.38 | GOOD | 95% | STABLE TRANSPORTATION |
| 1800 | | 0.45 | GOOD | 85% | STABLE TRANSPORTATION |
| 2300 | | 0.58 | BAD | 15% | FIXATION AMOUNT LARGE, UNSTABLE |
| 100 | 3.80E-04 | 0.04 | BAD | 25% | FIXATION AMOUNT LARGE, UNSTABLE |
| 450 | | 0.17 | GOOD | 80% | STABLE TRANSPORTATION |
| 900 | | 0.34 | GOOD | 100% | STABLE, PEAK OF TRANSPORTATION AMOUNT |
| 1100 | | 0.42 | GOOD | 90% | STABLE TRANSPORTATION |
| 1300 | | 0.49 | GOOD | 80% | STABLE TRANSPORTATION |
| 1500 | | 0.57 | BAD | 30% | FIXATION AMOUNT LARGE, UNSTABLE |
| 100 | 5.10E-04 | 0.05 | BAD | 30% | FIXATION AMOUNT LARGE, UNSTABLE |
| 250 | | 0.13 | GOOD | 70% | STABLE TRANSPORTATION |
| 600 | | 0.31 | GOOD | 100% | STABLE, PEAK OF TRANSPORTATION AMOUNT |
| 900 | | 0.46 | GOOD | 85% | STABLE TRANSPORTATION |
| 1100 | | 0.56 | BAD | 50% | FIXATION AMOUNT LARGE, UNSTABLE |

FIG. 16

| FREQUENCY f (Hz) | PITCH λ (m) BETWEEN ELECTRODES | VALUE OF λ × f | ABSOLUTE VALUE \|q/m\| OF SPECIFIC CHARGE OF TONER | | | | | | | | | |
|---|---|---|---|---|---|---|---|---|---|---|---|---|
| | | | 2 μ C/g | | 5~10 μ C/g | | 20~50 μ C/g | | 65~75 μ C/g | | OVER 100 μ C/g | |
| | | | TRANSPORTATION STATE AND RELATIVE VALUE OF TRANSPORTATION AMOUNT | | TRANSPORTATION STATE AND RELATIVE VALUE OF TRANSPORTATION AMOUNT | | TRANSPORTATION STATE AND RELATIVE VALUE OF TRANSPORTATION AMOUNT | | TRANSPORTATION STATE AND RELATIVE VALUE OF TRANSPORTATION AMOUNT | | TRANSPORTATION STATE AND RELATIVE VALUE OF TRANSPORTATION AMOUNT | |
| 150 | 2.50E-04 | 0.04 | AMOUNT OF FIXATION AND SCATTERING LARGE | 15% | AMOUNT OF FIXATION AND SCATTERING LARGE | 15% | FIXATION AMOUNT LARGE, UNSTABLE | 20% | FIXATION AMOUNT LARGE | 15% | FIXATION AMOUNT LARGE | 0% |
| 450 | | 0.11 | LARGE DECREASE OF TRANSPORTATION AMOUNT | 40% | LARGE DECREASE OF TRANSPORTATION AMOUNT | 50% | STABLE TRANSPORTATION | 85% | FIXATION OCCURS | 40% | FIXATION AMOUNT LARGE | 10% |
| 600 | | 0.15 | DECREASE OF TRANSPORTATION AMOUNT | 55% | STABLE TRANSPORTATION | 70% | STABLE TRANSPORTATION | 90% | FIXATION OCCURS | 55% | FIXATION AMOUNT LARGE | 25% |
| 1000 | | 0.25 | PEAK OF TRANSPORTATION AMOUNT | 70% | STABLE, PEAK OF TRANSPORTATION AMOUNT | 90% | STABLE TRANSPORTATION | 95% | STABLE TRANSPORTATION | 80% | FIXATION OCCURS | 60% |
| 1300 | | 0.33 | SMALL DECREASE OF TRANSPORTATION AMOUNT | 60% | STABLE TRANSPORTATION | 85% | STABLE, PEAK OF TRANSPORTATION AMOUNT | 100% | STABLE TRANSPORTATION | 100% | FIXATION OCCURS | 80% |
| 1400 | | 0.35 | LARGE DECREASE OF TRANSPORTATION AMOUNT | 50% | STABLE TRANSPORTATION | 80% | STABLE TRANSPORTATION | 100% | STABLE TRANSPORTATION | 105% | FIXATION OCCURS | 95% |
| 1500 | | 0.38 | LARGE DECREASE OF TRANSPORTATION AMOUNT | 40% | STABLE TRANSPORTATION | 70% | STABLE TRANSPORTATION | 95% | STABLE, PEAK OF TRANSPORTATION AMOUNT | 110% | FIXATION AMOUNT SMALL | 110% |
| 1600 | | 0.4 | LARGE DECREASE OF TRANSPORTATION AMOUNT | 30% | SMALL DECREASE OF TRANSPORTATION AMOUNT | 60% | STABLE TRANSPORTATION | 90% | STABLE TRANSPORTATION | 95% | PEAK OF TRANSPORTATION AMOUNT | 125% |
| 1800 | | 0.45 | LARGE DECREASE OF TRANSPORTATION AMOUNT | 20% | DECREASE OF TRANSPORTATION AMOUNT | 45% | STABLE TRANSPORTATION | 85% | STABLE TRANSPORTATION | 80% | FIXATION AMOUNT SMALL | 90% |
| 2000 | | 0.5 | AMOUNT OF FIXATION AND SCATTERING LARGE | 15% | AMOUNT OF FIXATION AND SCATTERING LARGE | 30% | STABLE TRANSPORTATION | 70% | FIXATION OCCURS | 65% | FIXATION OCCURS | 60% |
| 2300 | | 0.58 | AMOUNT OF FIXATION AND SCATTERING LARGE | 5% | AMOUNT OF FIXATION AND SCATTERING LARGE | 10% | FIXATION AMOUNT LARGE, UNSTABLE | 15% | FIXATION AMOUNT LARGE | 15% | FIXATION AMOUNT LARGE | 5% |

FIG. 17

| FREQUENCY f (Hz) | PITCH λ (m) BETWEEN ELECTRODES | VALUE OF λ × f | VOLUME RESISTIVITY ρ (Ω·m) | VALUE OF ρ × f | f × ρ > 10 | ρ > 10 | TONER TRANSPORTATION STATE |
|---|---|---|---|---|---|---|---|
| 500 | 2.50E-04 | 0.13 | 5.00E+06 | 2.50E+09 | | | D |
| 700 | | 0.18 | | 3.50E+09 | | | D |
| 1000 | | 0.25 | | 5.00E+09 | | | D |
| 1500 | | 0.38 | | 7.50E+09 | | | C~D |
| 2000 | | 0.5 | | 1.00E+10 | * | | C |
| 500 | 2.50E-04 | 0.13 | 1.10E+07 | 5.50E+09 | | ** | C |
| 700 | | 0.18 | | 7.70E+09 | | ** | C |
| 1000 | | 0.25 | | 1.10E+10 | * | ** | B |
| 1500 | | 0.38 | | 1.70E+10 | * | ** | B |
| 2000 | | 0.5 | | 2.20E+10 | * | ** | B |
| 500 | 2.50E-04 | 0.13 | 1.50E+08 | 7.50E+10 | * | ** | B |
| 700 | | 0.18 | | 1.10E+11 | * | ** | A |
| 1000 | | 0.25 | | 1.50E+11 | * | ** | A |
| 1500 | | 0.38 | | 2.30E+11 | * | ** | A |
| 2000 | | 0.5 | | 3.00E+11 | * | ** | B |
| 500 | 2.50E-04 | 0.13 | 9.00E+09 | 4.50E+12 | * | ** | B |
| 700 | | 0.18 | | 6.30E+12 | * | ** | A |
| 1000 | | 0.25 | | 9.00E+12 | * | ** | A |
| 1500 | | 0.38 | | 1.40E+13 | * | ** | A |
| 2000 | | 0.5 | | 1.80E+13 | * | ** | B |
| 500 | 2.50E-04 | 0.13 | 1.30E+12 | 6.50E+14 | * | ** | B |
| 700 | | 0.18 | | 9.10E+14 | * | ** | A |
| 1000 | | 0.25 | | 1.30E+15 | * | ** | A |
| 1500 | | 0.38 | | 2.00E+15 | * | ** | A |
| 2000 | | 0.5 | | 2.60E+15 | * | ** | B |
| 300 | 5.10E-04 | 0.15 | 5.00E+06 | 1.50E+09 | | | D |
| 500 | | 0.26 | | 2.50E+09 | | | D |
| 700 | | 0.35 | | 3.50E+09 | | | D |
| 900 | | 0.45 | | 4.50E+09 | | | D |
| 300 | 5.10E-04 | 0.15 | 1.10E+07 | 3.30E+09 | | ** | C~D |
| 500 | | 0.26 | | 5.50E+09 | | ** | C |
| 700 | | 0.35 | | 7.70E+09 | | ** | C |
| 900 | | 0.45 | | 9.90E+09 | * | ** | C~B |
| 300 | 5.10E-04 | 0.15 | 1.50E+08 | 4.50E+10 | * | ** | B |
| 500 | | 0.26 | | 7.50E+10 | * | ** | B |
| 700 | | 0.35 | | 1.10E+11 | * | ** | A |
| 900 | | 0.45 | | 1.40E+11 | * | ** | B |
| 300 | 5.10E-04 | 0.15 | 9.00E+09 | 2.70E+12 | * | ** | B |
| 500 | | 0.26 | | 4.50E+12 | * | ** | A |
| 700 | | 0.35 | | 6.30E+12 | * | ** | A |
| 900 | | 0.45 | | 8.10E+12 | * | ** | B |
| 300 | 5.10E-04 | 0.15 | 1.30E+12 | 3.90E+14 | * | ** | B |
| 500 | | 0.26 | | 6.50E+14 | * | ** | A |
| 700 | | 0.35 | | 9.10E+14 | * | ** | A |
| 900 | | 0.45 | | 1.20E+15 | * | ** | B |

FIG. 22

| PITCH λ (μm) BETWEEN ELECTRODES | INTERVAL d (μm) | PERIODICAL DENSITY UNEVENNESS | BLOTCHING | TOTAL EVALUATION | RELATIONSHIP BETWEEN d AND λ |
|---|---|---|---|---|---|
| 120 | 50 | D | D | D | d< λ |
| | 100 | C | D | C~D | d< λ |
| | 150 | B | B | B | d> λ |
| | 500 | A | B | B~A | d> λ |
| 250 | 100 | D | D | D | d< λ |
| | 150 | C | D | C~D | d< λ |
| | 200 | C | C | C | d< λ |
| | 300 | B | B | B | d> λ |
| | 1000 | A | A | A | d> λ |
| 250 | 200 | D | D | D | d< λ |
| | 300 | D | D | D | d< λ |
| | 400 | C | C | C | d< λ |
| | 600 | B | B | B | d> λ |
| | 1000 | A | B | A~B | d> λ |
| | 2000 | A | A | A | d> λ |

A:VERY GOOD,B:GOOD,C:SLIGHTLY PROBLEMATIC,D:BAD

FIG. 23

| CONDITIONS FOR FORMATION OF ELECTROSTATIC LATENT IMAGE BY PHOTOSENSITIVE DRUM | | | | | PITCH λ (m) BETWEEN ELECTRODES | 250 | | | 500 | | |
|---|---|---|---|---|---|---|---|---|---|---|---|
| | | | | | INTERVAL d(μm) | 100 | 300 | 1000 | 300 | 600 | 2000 |
| | | | | | RELATIONSHIP BETWEEN d AND λ | d<λ | d>λ | d>λ | d<λ | d>λ | d>λ |
| PERIPHERAL VELOCITY vp (mm/sec) OF PHOTOSENSITIVE DRUM | RESOLUTION (dpi) | RESOLUTION R(dot/mm) | SPATIAL FREQUENCY vp·R(dot/sec) | RELATIONSHIP BETWEEN vp·R AND f | FREQUENCY f (Hz) OF VOLTAGES APPLIED | STATE OF PERIODICAL DENSITY UNEVENNESS A:VERY GOOD,B:GOOD, C:SLIGHTLY PROBLEMATIC,D:BAD | | | | | |
| 50 | 300 | 11.81 | 591 | vp·R>f | 300 | D | B | B | D | B | B |
| | | | | vp·R>f | 500 | D | B | A | D | B | A |
| | | | | vp·R<f | 1000 | B | B | A | B | B | A |
| | | | | vp·R<f | 1500 | B | A | A | B | A | A |
| 50 | 600 | 23.62 | 1181 | vp·R>f | 500 | D | B | B | D | B | B |
| | | | | vp·R>f | 1000 | C | B | A | C | B | A |
| | | | | vp·R<f | 1500 | B | B | A | B | B | A |
| | | | | vp·R<f | 2000 | B | A | A | B | A | A |
| 50 | 1200 | 47.24 | 2362 | vp·R>f | 500 | D | B | B | D | B | B |
| | | | | vp·R>f | 1000 | D | B | A | D | B | A |
| | | | | vp·R>f | 2000 | C | B | A | C | B | A |
| | | | | vp·R<f | 3000 | B | A | A | TONER NOT ADEQUATELY TRANSPORTED | | |
| 200 | 300 | 11.81 | 2362 | vp·R>f | 500 | D | B | B | D | B | B |
| | | | | vp·R>f | 1000 | D | B | A | D | B | A |
| | | | | vp·R>f | 2000 | C | B | A | C | B | A |
| | | | | vp·R<f | 3000 | B | A | A | TONER NOT ADEQUATELY TRANSPORTED | | |
| 200 | 600 | 23.62 | 4724 | vp·R>f | 500 | D | B | B | D | B | B |
| | | | | vp·R>f | 1000 | D | B | A | D | B | A |
| | | | | vp·R>f | 2000 | D | B | A | D | B | A |
| | | | | vp·R<f | 5000 | TONER NOT ADEQUATELY TRANSPORTED | | | TONER NOT ADEQUATELY TRANSPORTED | | |
| 200 | 1200 | 47.24 | 9449 | vp·R>f | 500 | D | B | B | D | B | B |
| | | | | vp·R>f | 1000 | D | B | A | D | B | A |
| | | | | vp·R>f | 2000 | D | B | A | D | B | A |
| | | | | vp·R>f | 5000 | TONER NOT ADEQUATELY TRANSPORTED | | | TONER NOT ADEQUATELY TRANSPORTED | | |

FIG. 25

| ANALYZED DATA | CHARGE POTENTIAL V0(V) IN NON-IMAGE AREA OF PHOTOSENSITIVE DRUM | AVERAGE VALUE V1(V) OF VOLTAGES APPLIED | INTERVAL d (μm) | ELECTRIC FIELD \|V0-V1\|/d (V/m) WITH WHICH TONER IS RETURNED | BLOTCHING |
|---|---|---|---|---|---|
| ① | -400 | 0 | 10000 | 4.00E+04 | A |
| ② | -400 | -200 | 10000 | 2.00E+04 | B |
| ③ | -400 | -300 | 10000 | 1.00E+04 | B |
| ④ | -400 | -350 | 10000 | 5.00E+03 | D |
| ⑤ | -400 | -350 | 7000 | 7.14E+03 | D |
| ⑥ | -400 | -350 | 5000 | 1.00E+04 | B |
| ⑦ | -400 | -350 | 3000 | 1.67E+04 | B |
| ⑧ | -500 | -350 | 10000 | 1.50E+04 | B |

A:VERY GOOD,B:GOOD,C:SLIGHTLY PROBLEMATIC,D:BAD

FIG. 31 (a) DOT REPRODUCTION EVALUATION

| λ ×f | TONER TRANSPORTATION PROPERTY | DENSITY UNEVENNESS | | TOTAL EVALUATION | | |
|---|---|---|---|---|---|---|
| | | ROTATION IN THE SAME DIRECTION | ROTATION IN THE OPPOSITE DIRECTION | ROTATION IN THE SAME DIRECTION | ROTATION IN THE OPPOSITE DIRECTION | |
| 5 | C | D | B | D | C～B | |
| 10 | B | D | B | D | B | CLAIMED ROTATION IN THE OPPOSITE DIRECTION 10≦λ ×f≦800 |
| 25 | B | D | B | D | B | |
| 70 | B | D | B | D | B | |
| 125 | A | D | A | D | A | |
| 250 | A | D | A | D | A | |
| 500 | A | C | A | C | A | |
| 800 | A | C | A | B | A | |
| 1000 | C | C | A | C～B | C～B | |
| 1250 | D | B | A | D | C | |

A:VERY GOOD,B:GOOD,C:NOT GOOD,D:VERY BAD

FIG. 31 (b) EXPERIMENTAL CONDITION

| | |
|---|---|
| CONDITIONS FOR TONER TRANSPORTATION | PITCH BETWEEN ELECTRODES;254 μm |
| | WIDTH OF ELECTRODES;127 μm |
| | VOLTAGES APPLIED;900V |
| | FREQUENCY;1kHz |

| | |
|---|---|
| CONDITIONS FOR DEVELOPMENT | ROTATION SPEED OF PHOTOSENSITIVE BODY;100mm/s |
| | DEVELOPMENT GAP;3mm |
| | DOT;600dpi |

DENSITY UNEVENNESS ; A

DENSITY UNEVENNESS ; B

DENSITY UNEVENNESS ; D

DEVELOPING APPARATUS AND IMAGE FORMING APPARATUS USING PROGRESSIVE WAVE ELECTRIC FIELD TRANSPORT

TECHNICAL FIELD

The present invention relates to a developing apparatus used in an electrophotographic image forming apparatus, and relates to the image forming apparatus. The developing apparatus is so arranged that an electrostatic latent image formed on an image supporting body is visualized by using developer. The present invention especially relates to a developing apparatus so arranged that developer is transported to a development position on an image supporting body by using a progressive wave electric field, and relates to an image forming apparatus using the developing apparatus.

BACKGROUND ART

The present invention relates to a developing apparatus used in an electrophotographic image forming apparatus. The developing apparatus is so arranged that an electrostatic latent image formed on an image supporting body is visualized by using developer. The present invention especially relates to a developing apparatus so arranged that developer is transported to a development position on an image supporting body by using a progressive wave electric field.

Among developing apparatuses used in image forming apparatuses, such as copying apparatuses and printers, that perform electrophotographic image forming, some developing apparatuses are so arranged that a developer supporting body, which supplies developer to an image supporting body, is positioned so as not to contact a surface of the image supporting body. Well-known methods employed in such developing apparatuses are a powder cloud method, a jumping method, and an electric field curtain (progressive wave electric field) method. The electric field curtain method is employed in a developing apparatus disclosed in Japanese Publication for Unexamined Patent Application, Tokukaihei No. 9-68864 (Publication Date: Mar. 11, 1997) (U.S. Pat. No. 2,836,537), for example. In the developing apparatus, an insulating layer is laminated on a substrate made of metal or resin. In the insulating layer, plural sets of electrodes are disposed in series. Each set includes three electrodes. The electrodes generate an electric field curtain effect by using a progressive wave electric field. The electrodes function as transportation means. The transportation means constitutes a transportation path. Via the transportation path, developer is transported from a developing tank to a development position in proximity with an image supporting body, and transported back to the developing tank.

However, with the conventional progressive wave electric field method, the developing apparatus has the following problems. When electrically charged developer is transported to the transportation path, which is provided with the transportation means including the substrate and the insulating layer, secondary electric charge occurs between the developer and the insulating layer of the substrate. This changes a surface potential of the insulating layer. As a result, transportation of the developer is destabilized, for example, because the developer firmly adheres onto a surface of the transportation means. Moreover, when the surface potential of the insulating layer is changed, there is also a change in a developing potential, which is a potential difference between the image supporting body and the transportation means in a developing step. As a result, a stable state of development cannot be maintained.

The present invention also relates to a developing apparatus that develops, by using developer and the like, an electrostatic latent image formed on a latent image supporting body (image supporting body), and relates to an image forming apparatus including the developing apparatus. The present invention especially relates to a developing apparatus and an image forming apparatus that use a mechanism (electric field curtain) with which the developer is transported by using a progressive wave electric field.

The electrostatic latent image is not limited to an electrostatic latent image formed by writing optical information onto an image supporting body electrically charged with a predetermined charge. The electrostatic latent image may be formed, by a method such as an ion flow method, directly on a dielectric material. Alternatively, the electrostatic latent image may be directly formed by a method such as a toner jet method, in which (i) an arbitrary voltage is applied to an electrode having a plurality of openings, so as to form a latent image in the air, and (ii) the developer is sprayed on a recording medium.

Among developing apparatuses used in image forming apparatuses, such as copying apparatuses, printers, and facsimiles, in which photoelectric image forming is performed, attention is currently paid to such developing apparatuses that use a non-contact method. In the non-contact method, development is performed in such a manner that the developer supporting body contacts the image supporting body. Examples of the non-contact method are the powder cloud method, the jumping method, and the electric field curtain (progressive wave electric field) method.

As described in, for example, Japanese Publication for Unexamined Patent Application, Tokukaihei No. 9-68864, means for generating an electric field curtain includes (i) a supporting substrate made of metal or resin, and (ii) an insulating layer laminated on the supporting substrate. In the insulating layer, plural sets of electrodes are disposed in series. The electrodes generate an electric field curtain effect. Each set of the electrodes includes three electrodes. When multiphase voltages are applied to the electrodes, a progressive wave electric field is formed. By using the progressive wave electric field, developer is transported on a surface of developer transportation member.

Incidentally, for developing apparatuses using a progressive wave electric field, it is necessary to appropriately select (i) a pitch between adjacent ones of the electrodes of a developer transportation member and (ii) a driving frequency of the progressive wave electric field, so as to transport the developer efficiently and stably.

Specifically, if the pitch between adjacent ones of the electrodes is wide, a long time (transport time) is required for the developer to move between adjacent ones of the electrodes, although field intensity is high. It is therefore necessary to apply low-frequency voltages to the electrodes, so that an amount of the developer transported per unit time is maximized at a low frequency. On the other hand, if the pitch between adjacent ones of the electrodes is narrow, only a short time is required for the developer to move between adjacent ones of the electrodes, although the field intensity is low. It is therefore necessary to apply high-frequency voltages to the electrodes, so that the amount of the developer transported per unit time is maximized at a high frequency.

Thus, depending on whether the pitch between adjacent ones of the electrodes is wide or narrow, the amount of the developer transported per unit time significantly varies in a frequency band of the voltages applied to the electrodes. Therefore, unless an appropriate developer transportation condition is selected, it is impossible to transport the developer efficiently on the developer transportation means by using the progressive wave electric field.

Moreover, under the following conditions, developing apparatuses using a progressive wave electric field is susceptible to spatial and temporal distribution of a potential generated by the voltages applied to the electrodes: (i) a progressive wave electric field is generated on the surface (developer transportation surface) of the developer transportation member, that is, different voltages are applied to the electrodes, and (ii) a supporting surface (front surface) of the image supporting body, such as a photosensitive body, is right above or in close proximity with the surface of the developer transportation member after the image supporting body has moved in a perimeter direction. Therefore, when the supporting surface of the image supporting body is in close proximity with the surface of the developer transportation member, there is a possibility that periodical change in density is caused because of (i) the frequency of the voltages applied to the electrodes, (ii) the pitch between adjacent ones of the electrodes, and (3) a peripheral velocity of the image supporting body, as shown in FIGS. 26(*a*) and 26(*b*), when the electrostatic latent image on the supporting surface of the image supporting body is developed.

In order to transport the developer on the surface of the developer transportation member, the progressive wave electric field needs to have certain intensity. The field intensity is influenced by the pitch between adjacent ones of the electrodes, and by a potential difference between adjacent ones of the electrodes. This is because, in order to attain progressive wave electric field intensity necessary for transporting the developer, the potential difference between adjacent ones of the electrodes needs to be larger as the pitch between adjacent ones of the electrodes becomes wider. Here, a state of the developer transported by the progressive wave electric field is as follows. The developer is in a cloud-like state while being transported by the progressive wave electric field. When the developer is in the cloud-like state, a height of the developer from the surface of the developer transportation member becomes higher if the pitch between adjacent ones of the electrodes becomes wider. If the pitch between adjacent ones of the electrodes is wide, the potential difference between adjacent ones of the electrodes needs to be large, so as to attain a desired progressive wave electric field. Therefore, energy of movement (energy of movement qV where q is charge of the developer, and V is the potential difference) given to the developer becomes large. This causes collisions of the developer with the developer itself, and increases a transportation speed of the developer. In this way, the developer in the cloud-like state is laminated on the surface of the developer transportation member due to, for example, deflection of a spraying path caused by an influence of air resistance. As a result, the height of the developer tends to become higher. Therefore, if the supporting surface of the image supporting body is completely soaked into the developer that is in the cloud-like state, so-called blotching is caused. Blotching is a phenomenon in which the developer adheres to a non-developing area of the supporting surface. The non-developing area is an area to which adhesion of the developer is not intended.

As described above, in image forming apparatuses such as copying apparatuses and printers employing an electrophotographic method, developing apparatuses employing a non-contact method are often used. In the non-contact method, the developer is transported to a vicinity of the image supporting body, and the developer is sprayed on an electrostatic latent image on the image supporting body, so that the electrostatic latent image is developed. Examples of the non-contact method are the powder cloud method, the jumping method, and the electric field curtain (progressive wave electric field) method.

A method using a progressive wave electric field is described in Tokukaihei 9-68864, for example. In this method, there are provided (i) a transportation path through which developer is transported from a developer containing section to an image supporting body, (ii) a collecting path through which unnecessary developer that did not adhere to the image supporting body is collected, and (iii) a developing electrode, which is directed downward and which is provided in proximity with one end of the transportation path so as to face the image supporting body.

The transportation path has a large number of electrodes embedded therein. To the electrodes, multiphase alternating voltages are applied, so as to generate a progressive wave electric field. By using the progressive wave electric field, the developer on the transportation path is transported to the image supporting body. When the developer is transported to the vicinity of the image supporting body, the developer is sprayed on the image supporting body due to charge of the electrostatic latent image of the image supporting body and due to the field generated by the developing electrode. Then, the developer adheres to the electrostatic latent image. In this way, the electrostatic latent image on the image supporting body is developed. The developer that did not adhere to the electrostatic latent image falls into the collecting path, and is collected through the collecting path into the developer containing section.

In such a developing apparatus, no mechanical power is used for transporting the developer. Instead, only the multiphase alternating voltages are applied to the electrodes of the transportation path. Therefore, it is possible to simplify an arrangement of the apparatus, and to miniaturize the apparatus.

Incidentally, in a method using a progressive wave electric field, distribution of toner in the transportation path is uneven in a traveling direction. Therefore, periodical density unevenness of the toner is caused. This is due to a frequency of the multiphase alternating current applied to the electrodes of the transportation path. If a toner image is formed by adhering the toner to the electrostatic latent image on the image supporting body while the uneven density of the toner on the transportation path moves in parallel with the electrostatic latent image in such a manner as to face the electrostatic latent image, the uneven density of the toner is directly reflected in the toner image.

However, in the foregoing conventional developing apparatus, despite the fact that (i) a traveling direction of the developer is a rotation movement direction of the image supporting body, and (ii) the toner having the uneven density on the transportation path faces the electrostatic latent image on the image supporting body and moves in parallel with the electrostatic latent image, no measure has been taken to suppress an influence of the density unevenness of the toner.

DISCLOSURE OF INVENTION

The present invention was made to solve the problems above. An object of the present invention is to provide a developing apparatus capable of (i) suppressing a variation of a surface potential of an insulating layer of transportation means at a time of transportation of developer, so as to prevent firm adhering of the developer to a surface of the transportation means, thereby transporting the developer to a development position always stably, and (ii) suppressing a variation of a developing potential between an image supporting body and the transportation means in a developing step, so as to attain an always stable state of development.

Another object of the present invention is to provide a developing apparatus in which (i) a pitch between adjacent ones of electrodes and (ii) a frequency of voltages applied are regulated, so that developer is transported efficiently on the developer transportation means by using progressive wave electric field, and to provide an image forming apparatus including the developing apparatus.

Yet another object of the present invention is to provide a developing apparatus capable of (i) developing an image of uniform density on an image supporting body, and (ii) performing excellent image forming with little blotching, and to provide an image forming apparatus including the developing apparatus.

A further object of the present invention is to provide a developing apparatus in which an electrostatic latent image can be developed evenly because density unevenness of toner does not have much influence on the electrostatic latent image although toner is transported by using a progressive wave electric field, and to provide an image forming apparatus including the developing apparatus.

To attain the objects above, the developing apparatus of the present invention has the following arrangements:

(1) In a developing apparatus in which an electrostatic latent image on a surface of an image supporting body is visualized by transporting developer to a development position by using a progressive wave electric field generated at transportation means, the transportation means includes: an insulating layer that covers a circumferential surface of progressive wave generating electrodes provided on a surface of a substrate; and a protective layer that protects a contact surface that contacts the developer, the insulating layer and the protective layer being laminated in this order; and a volume resistivity of the protective layer is lower than a volume resistivity of the insulating layer.

According to this arrangement, the protective layer is provided on a front surface of the insulating layer that covers the circumferential surface of the progressive wave generating electrodes on the substrate of the transportation means. The developer transported by the transportation means contacts the protective layer whose volume resistivity is lower than the volume resistivity of the insulating layer. Therefore, when the developer electrically charged in advance is transported by the transportation means, the surface potential of the transportation means is not varied significantly, even if secondary electric charge occurs between the developer and the transportation means.

(2) The volume resistivity of the protective layer is $10^{10}$ Ω·cm to $10^{17}$ Ω·cm. It is more preferable that the volume resistivity is $10^{10}$ Ω·cm to $10^{14}$ Ω·cm.

According to this arrangement, the volume resistivity of the protective layer, which contacts the developer on the transportation member, is $10^{10}$ Ω·cm to $\mathbf{10}^{17}$ Ω·cm. That is, the volume resistivity of the protective layer is set to such a value that, unlike a value that is (i) lower than approximately $10^{18}$ Ω·cm, which is necessary for the insulating layer so as to maintain insulation among the electrodes, and that is (ii) $\mathbf{10}^{9}$ Ω·cm or lower, a transportation property and developing efficiency are not deteriorated by firm adhering, to the surface, of the developer melted by heat generated by the contact between the protective layer and the developer. Moreover, unlike cases in which the volume resistivity is lower, the transportation property is not deteriorated by an insufficient exposure, in which the electric field generated by the progressive wave generating electrodes is not sufficiently exposed beyond the protective layer.

(3) The protective layer is grounded.

According to this arrangement, the protective layer, which contacts the developer on the transportation means, is grounded. Therefore, even if secondary electric charge occurs between the protective layer and the developer, the surface potential of the protective layer is kept constant. This ensures that the developer does not firmly adhere onto the surface of the protective layer, and a development voltage between the image supporting body and the protective layer is not varied. As a result, the transportation property and the state of development are kept constant.

(4) In the transportation means, $$a\mathbf{1}+a\mathbf{2}<b$$

where a1 is thickness of the protective layer, a2 is thickness of the insulating layer, and b is a distance between adjacent ones of the progressive wave generating electrodes.

According to this arrangement, the distance between adjacent ones of the progressive wave generating electrodes is longer than a sum of the thickness of the protective layer and the thickness of the insulating layer. Therefore, it is ensured that a part of the electric field generated by the progressive wave generating electrodes is exposed beyond the protective layer. As a result, the transportation property does not deteriorate.

According to the present invention, the following effects can be attained.

(1) When the developer electrically charged in advance is transported by the transportation means, the surface potential of the transportation means is not varied significantly even if secondary electric charge occurs between the protective layer and the developer. This makes it possible to certainly transport the developer on the surface of the transportation means, and to attain an always stable state of development. This effect is brought about by providing the protective layer on the front surface of the insulating layer that covers the circumferential surface of the progressive wave generating electrodes on the surface of the substrate of the transportation means, and by causing the developer, which is transported by the transportation means, to contact the protective layer whose volume resistivity is lower than the volume resistivity of the insulating layer.

(2) The transportation property is not deteriorated by an insufficient exposure, in which the electric field generated by the progressive wave generating electrodes is not sufficiently exposed beyond the protective layer. This makes it possible to certainly transport the developer on the surface of the transportation means, and to attain an always stable state of development. This effect is brought about by setting the volume resistivity of the protective layer, which contacts the developer on the transportation means, to $10^{10}$ Ω·cm to $10^{17}$ Ω·cm. In this way, the volume resistivity of the protective layer is set to such a value that, unlike a value that is (i) lower than required for the insulating layer so as to maintain insulation among the electrodes, and that is (ii) $10^{9}$ Ω·cm or lower, the transportation property and the developing efficiency are not deteriorated by firm adhering, to the surface, of the developer melted by heat generated by the contact between the protective layer and the developer.

(3) The surface potential of the protective layer can be kept constant more certainly, even if secondary electric charge occurs between the protective layer and the developer. This makes it possible to prevent (i) firm adhering of the developer onto the surface of the protective layer, and (ii) a variation of the development voltage between the protective layer and the image supporting body. As a result, it is possible to transport the developer in a more stable state on the surface of the transportation means. This effect is brought about by grounding the protective layer, which contacts the developer on the transportation means.

(4) It is ensured that a part of the electric field generated by the progressive wave generating electrodes is exposed beyond the protective layer. This makes it possible to more certainly prevent deterioration of the transportation property of the developer, so that the developer can be transported in a more stable state. This effect is brought about by setting the distance between adjacent ones of the progressive wave generation electrodes to be longer than the sum of the thickness of the protective layer and the thickness of the insulating layer.

Moreover, to attain the object above, a developing apparatus of the present invention is based on a premise that the developing apparatus includes developer transportation means provided at a development area that faces an image supporting body that supports on a surface thereof an electrostatic latent image, the developer transportation means transporting developer by using a progressive wave electric field generated by applying multiphase voltages to a plurality of electrodes so provided in a substrate that there are predetermined intervals between adjacent ones of the electrodes. It is so arranged that a pitch λ (m) between adjacent ones of the electrodes, and a frequency f (Hz) of the voltages applied to the electrodes satisfy $$0.1<\lambda\times f<0.5.$$

With this arrangement, transportation of the developer does not fail to catch up with a switching cycle of the voltages applied, and an amount of the developer transported does not decrease because the number of transportation of the developer per unit time does not decrease. Moreover, the developer does not firmly adhere onto the developer transportation means. Therefore, it is possible to stably transport a large amount of the developer per unit time in a stable region in which a change in the frequency of the line voltage and the variation of the pitch between adjacent ones of the electrodes do not have much influence, that is, to transport the developer efficiently by using the progressive wave electric field on the developer transportation means.

Here, if an absolute value of a specific charge q/m, which is a charge amount of the developer, is within a range of $$5\ \mu C/g \text{ to } 100\ \mu C/g,$$

the charge amount of the developer does not become excessively small. This makes it possible to move the developer smoothly between adjacent ones of the electrodes, thereby increasing the amount of the developer transported. Moreover, even if the developer scatters in a region in which the progressive wave electric field is weak on the developer transportation means, it is possible to control scattering of the developer by using a force of the electric field, because the charge amount of the developer is not excessively small.

Moreover, the charge amount of the developer is not excessively large. Therefore, the developer is transported even at a relatively high frequency. Here, once the developer adheres to the surface of the developer transportation means for some reason, mirror-image-induced firm adhering of the developer is likely to occur on its low-frequency side, and on its high-frequency side beyond a peak. However, because a variation, with respect to values of (λ×f), of the amount of the developer transported does not have a salient peak, mirror-image-induced firm adhering of the developer is prevented, so that the developer is transported stably.

Moreover, if (i) the transportation means includes a high-resistance layer provided in a range from a surface of each electrode to the surface on which the developer is transported, and (ii) the frequency f (Hz) of the voltages applied to the electrodes, and a volume resistivity ρ (Ω×m) of the high-resistance layer satisfy $$f\times\rho>10^{10},$$

charge of the developer caused by the contact between the developer and the developer transportation means is suppressed when the developer is transported on the developer transportation means. With this arrangement, the amount of the developer transported is not decreased by decrease, especially at a low frequency, of field intensity of the progressive wave electric field. Therefore, it is possible to transport the developer efficiently on the developer transportation means.

In particular, if the volume resistivity ρ (Ω×m) of the high-resistance layer satisfies $$\rho>10^{7},$$

the progressive wave electric field is sufficiently generated on the developer transportation means. As a result, it is possible to transport the developer more efficiently.

Furthermore, if the developing apparatus is used in an image forming apparatus, it is possible to provide an image forming apparatus that can transport the developer efficiently by using a progressive wave electric field in a stable region in which (i) the change in the frequency caused by the line voltage, and (ii) the variation of the pitch between adjacent ones of the electrodes do not have much influence.

As described above, by setting the pitch λ (m) between adjacent ones of the electrodes, and the frequency f (Hz) of the voltages applied to the electrodes to satisfy $$0.1<\lambda\times f<0.5,$$

it is possible to transport the developer efficiently on the developer transportation means by using the progressive wave electric field, without causing firm adhering of a large amount of the developer per unit time.

Here, by setting the absolute value of the specific charge q/m, which is the charge amount of the developer, within the range of $$5\ \mu C/g \text{ to } 100\ \mu C/g,$$

it is possible to move the developer smoothly between adjacent ones of the electrodes, thereby increasing the amount of the developer transported. Moreover, it is possible to control the scattering of the developer. Furthermore, the variation of the amount of the developer transported, with respect to values of (λ×f), does not have a salient peak. Therefore, mirror-image induced firm adhering of the developer is prevented, so that the developer is transported stably.

By setting the volume resistivity ρ (Ω×m) of the high-resistance layer and the frequency f (Hz) of the voltages applied as to satisfy $$f\times\rho>10^{10},$$

the amount of the developer transported is not decreased by decrease, especially at a low frequency, of the electric field intensity of the progressive wave electric field. Therefore, it is possible to transport the developer efficiently on the developer transportation means.

In particular, by setting the volume resistivity ρ (Ω×m) of the high-resistance layer to satisfy $$\rho > 10^7,$$

the progressive wave electric field is sufficiently generated on the developer transportation means. As a result, it is possible to transport the developer more efficiently.

Furthermore, by using the developing apparatus in an image forming apparatus, it is possible to provide an image forming apparatus that can transport the developer efficiently by using the progressive wave electric field in the stable region in which (i) the change in the frequency caused by the line voltage, and (ii) the variation of the pitch between adjacent ones of the electrodes do not have much influence.

To attain the foregoing object, a developing apparatus of the present invention includes developer transportation member, which is (i) provided at a development area that faces an image supporting body that supports, on a surface thereof, an electrostatic latent image, and (ii) made by coating, with a surface protective layer, a plurality of electrodes so provided in a substrate that there are predetermined intervals between adjacent ones of the electrodes, the developing apparatus transporting, on the developer transportation member, developer by using a progressive wave electric field generated by applying multiphase voltages to the plurality of electrodes, a gap d, in meter, between the developer transportation member and the image supporting body and a pitch λ, in meter, between adjacent ones of the electrodes satisfy $$d > \lambda.$$

In this arrangement, the gap d between the developer transportation member and the image supporting body is wider than the pitch λ between adjacent ones of the progressive wave generating electrodes. Under such a condition, a supporting surface of the image supporting body is hardly influenced, at a position right above or in close proximity with the surface of the developer transportation member, by spatial and temporal distribution of the potential, even while the progressive wave electric field is generated on the surface of the developer transportation member, that is, while different voltages are respectively applied to the progressive wave generating electrodes. Therefore, the potential distribution between adjacent ones of the progressive wave generating electrodes is hardly reflected at the supporting surface of the image supporting member that is in close proximity with the surface of the developer transportation member. As a result, temporal and spatial uniformity is maintained. This makes it possible to reduce, in performing developing, an influence of unevenness in the potential distribution between adjacent ones of the electrodes, so as to develop an image having a uniform density on the surface of the image supporting body. Moreover, it is possible to perform excellent image forming because problems such as blotching, in which the developer adheres to a non-developing area on the supporting surface, can be prevented.

Here, if a peripheral velocity vp (mm/sec) of the image supporting body, a latent image writing resolution R (dot/mm) in a perimeter direction of the image supporting body, and the frequency f (Hz) of the voltages applied to the electrodes, are set to satisfy $$vp \times R > f,$$

the voltages applied to the progressive wave generating electrodes have such a frequency that is lower than a spatial frequency vp×R (dot/sec) of the electrostatic latent image on the supporting surface of the image supporting body.

This setting is made in light of the following problems. If the spatial frequency of the electrostatic latent image on the supporting surface of the image supporting body is higher than the frequency of the progressive wave electric field, states of development are different per plural pixels on the supporting surface of the image supporting body, between a case in which the voltages applied to the progressive wave generating electrodes are maximum, and a case in which the voltages applied to the progressive wave generating electrodes are minimum. As a result, unevenness in development density is caused. On the other hand, if the frequency of the voltages applied to the electrodes is higher than the spatial frequency, each pixel on the supporting surface is developed by experiencing the voltage of a maximum value and the voltage of a minimum value. Although this eliminates the unevenness in development density among the pixels, the costs for the power source are increased.

In this respect, if (i) the gap d between the developer transportation member and the image supporting body and (ii) the pitch λ between adjacent ones of the electrodes, are set to satisfy $$d > \lambda,$$

the supporting surface of the image supporting body that is in close proximity with the surface of the developer transportation member. Therefore, by applying, to the electrodes, the voltages having the frequency f lower than the spatial frequency vp×R of the electrostatic latent image on the supporting surface of the image supporting body, it is possible to perform excellent image forming with no unevenness in development density. Moreover, it is possible to reduce the costs for the power source, thereby attaining a reasonable price.

In order to prevent unnecessary developer from adhering to a non-image area (non electrostatic latent image part) and from scattering in the apparatus, it is necessary to return the unnecessary developer onto the developer transportation member. Here, the unnecessary developer is the developer that did not contribute to development of the electrostatic latent image on the supporting surface when the developer in a cloud-like state was transported by the progressive wave electric field and reached a vicinity of the image supporting member. If an average value V1 (V) of the voltages applied to the electrodes, a charge potential V0 (V) of a non-image area of the image supporting body, and the gap d (m) between the developer transportation member and the image supporting body, are set to satisfy $$|V0 - V1|/d > 10^4,$$

strength of an effect of returning the unnecessary developer is decided. In other words, decided is strength of an effect by which the unnecessary developer is returned to the toner transportation member by a force applied in a direction in which the developer is returned to the developer transportation member, the force being given by the electric field between the non-image area of the image supporting body and the developer transportation member. Here, an important factor (the strength of the effect by which the unnecessary developer is returned to the developer transportation member) is a quotient of (i) an absolute value of a difference between the charge potential V0 in the non-image area of the image supporting body and the average value V1 of the voltages applied to the electrodes, by (ii) the gap d between the developer transportation member and the image supporting body. By setting the quotient to be larger than $10^4$, it is possible to perform excellent image forming with no blotching.

If the interval λ between adjacent ones of the electrodes is set to

100 μm to 1000 μm, the interval λ is optimized, without becoming excessively narrow or excessively wide.

If the pitch λ between adjacent ones of the electrodes is narrower than 100 μm, there is a possibility that the electrodes are not formed properly when the developer transportation member is manufactured, thereby resulting in leakage between adjacent ones of the electrodes. On the other hand, if the pitch λ between adjacent ones of the electrodes is wider than 1000 μm, it is necessary to apply high voltages so that the progressive wave electric field becomes strong enough to transport the developer. As a result, there is a possibility that costs for the power source are increased, and unnecessary noise is caused by vibration of the developer transportation member. However, by setting the pitch λ between adjacent ones of the electrodes to 100 μm to 1000 μm, it is possible (i) to prevent the leakage between adjacent ones of the electrodes, (ii) to reduce the costs for the power source, and (iii) to reduce the noise caused by the vibration of the developer transportation member.

If the gap d between the developer transportation member and the image supporting body is set to 0.1 mm to 10 mm, the gap d is optimized, without becoming excessively narrow or excessively wide.

If the gap between the developer transportation member and the image supporting body is narrower than 0.1 mm, blotching, that is, adhesion of the developer to the non-developing area, is likely to occur, and the image forming becomes unstable because the strength of the developing electric field is significantly changed even by a slight inaccuracy of the gap. On the other hand, if the gap between the developer transportation member and the image supporting body is wider than 10 mm, the charge potential needs to be high, so as to attain the field intensity necessary to return the unnecessary developer to the developer transportation member. This increases a load applied to the image supporting body, thereby causing deterioration of the image supporting body. However, by setting the gap d between the developer transportation member and the image supporting body to 0.1 mm to 10 mm, it is possible to perform the image forming smoothly, because blotching of the image supporting body can be prevented, and because the developing field intensity is stabilized. Moreover, it is possible to lower the charge potential of the image supporting body, so that the load applied to the image supporting body is decreased. As a result, deterioration of the image supporting body is prevented.

Furthermore, by using the developing apparatus in an image forming apparatus, it is possible to provide an image forming apparatus that can develop, on the image supporting surface of the image supporting body, an image having uniform density, and that can perform excellent image forming with little blotching.

As described above, by setting the gap d between the developer transportation member and the image supporting body to be wider than the pitch λ between adjacent ones of the electrodes, the influence of unevenness in the potential distribution between adjacent ones of the electrodes is reduced in performing developing. Therefore, it is possible to develop an image having uniform density on the image supporting body, and to prevent blotching of the image supporting body. As a result, it is possible to perform excellent image forming.

Here, by applying, to the electrodes, voltages of such a frequency that is lower than a product of (i) the peripheral velocity vp of the image supporting body and (ii) the latent image writing resolution R of the image supporting body, it is possible to eliminate the influence of the potential distribution between adjacent ones of the electrodes, under the condition in which the gap d between the developer transportation member and the image supporting body is wider than the pitch λ between adjacent ones of the electrodes. This makes it possible to perform excellent image forming with no unevenness in development density, and to reduce the costs for the power source, thereby attaining a lower price.

Moreover, by setting, to be larger than $10^4$, the quotient of (i) the absolute value of the difference between the average value V1 of the voltages applied to the electrodes and a charge potential V0 (V) in the non-image area of the image supporting body, by (ii) the gap d between the developer transportation member and the image supporting body, it is possible to decide the strength of the effect by which the unnecessary toner, which did not contribute to developing the electrostatic latent image on the supporting surface, is returned to the developer transportation member. Therefore, it is possible to perform excellent image forming with no blotching.

Moreover, by setting the pitch λ between adjacent ones of the electrodes to 100 μm to 1000 μm, it is possible (i) to prevent the leakage between adjacent ones of the electrodes, (ii) to reduce the cost for the power source, and (iii) to reduce the noise caused by the vibration of the developer transportation member.

By setting the gap d between the developer transportation member and the image supporting body to 0.1 mm to 10 mm, it is possible to prevent blotching of the image supporting body and to stabilize the developing electric field intensity, so that the image forming can be performed smoothly. Moreover, it is possible to lower the charge potential of the image supporting body, so that the load applied to the image supporting body is decreased. As a result, it is possible to prevent deterioration of the image supporting body.

Furthermore, by using the developing apparatus in an image forming apparatus, it is possible to provide an image forming apparatus that can develop, on the image supporting surface of the image supporting body, an image having uniform density, and that can perform excellent image forming with little blotching.

To attain the object above, in a developing apparatus, in which (i) a plurality of electrodes are provided in a row on a transportation path for developer, so that there are predetermined intervals between adjacent ones of the electrodes, (ii) a progressive wave electric field is generated by applying multiphase voltages to the electrodes, and (iii) the developer is supplied to the image supporting body by transporting, by using the progressive wave electric field, the developer on the transportation path to the image supporting body, so that an electrostatic latent image on the image supporting body, which is rotating, is developed, a traveling direction of the developer is opposite to a rotative direction of the image supporting body.

According to the present invention having this arrangement, the developer is transported via the transportation path by using the progressive wave electric field. Therefore, distribution of the toner in the transportation path is uneven in a traveling direction, in accordance with the frequency of the multiphase voltages applied to the electrodes of the transportation path. This causes periodical density unevenness of the toner. However, by setting the traveling direction of the developer to be opposite to the rotative direction of the image supporting body as in the present invention, the developer on the transportation path and the electrostatic latent image on the image supporting body pass each other, so that the toner can be supplied to any part of the electrostatic latent image from a broad range in the transportation path. Because of this, the density unevenness of the toner disappears in a process of supplying the toner from the transportation path to the image supporting body. Therefore, the density unevenness of the toner does not appear on the image supporting body. In contrast, if the traveling direction of the developer is the same as the rotative direction of the image supporting body as in the conventional apparatuses, the toner that is on the transportation path and that has uneven density faces the electrostatic latent image on the image supporting body, and moves in parallel with the electrostatic latent image. As a result, the uneven density of the toner is directly reflected in the toner image on the image supporting body.

Moreover, in the present invention, it is so arranged that $10 \leqq \lambda \times f \leqq 800$, where $\lambda$, in micrometer, is an interval between adjacent ones of the electrodes provided in a row; and f, in kirohertz, is a frequency.

By thus setting the interval $\lambda$ and the frequency f, it is possible to suppress the density unevenness of the toner, and to transport the toner stably via the transportation path. As a result, quality of the toner image obtained by developing the electrostatic latent image is stabilized. If the interval $\lambda$ and the frequency f are set to satisfy $\lambda \times f > 800$, the frequency is so high as compared with the interval $\lambda$ that the progressive wave electric field is switched before the toner is transported over the electrodes. Therefore, much of the toner moves in an opposite direction, without following the progressive wave electric field. As a result, the density unevenness of the toner becomes significant, thereby increasing the density unevenness of the toner image. Moreover, if the interval $\lambda$ and the frequency f are set to satisfy $\lambda \times f < 10$, the amount of the toner transported is drastically decreased.

Furthermore, an image forming apparatus of the present invention includes the developing apparatus.

In such an image forming apparatus, if the traveling direction of the developer is set to be opposite to the rotative direction of the image supporting body, the density unevenness of the toner disappears in the process of supplying the toner from the transportation path to the image supporting body. As a result, the density unevenness of the toner does not appear on the image supporting body.

As described above, according to the present invention, the traveling direction of the developer is opposite to the rotative direction of the image supporting body. Therefore, the developer on the transportation path and the electrostatic latent image on the image supporting body pass each other, so that the toner can be supplied to any part of the electrostatic latent image from a broad range in the transportation path. Because of this, the density unevenness of the toner disappears in a process of supplying the toner from the transportation path to the image supporting body. As a result, the density unevenness of the toner does not appear on the image supporting body.

Moreover, according to the present invention, it is so arranged that $10 \leqq \lambda \times f \leqq 800$, where $\lambda$, in micrometer, is an interval between adjacent ones of the electrodes provided in a row; and f, in kirohertz, is a frequency. With this arrangement, it is possible to suppress the density unevenness of the toner, and to transport the toner stably via the transportation path. As a result, quality of the toner image obtained by developing the electrostatic latent image is stabilized.

For a fuller understanding of the nature and advantages of the invention, reference should be made to the ensuring detailed description taken in conjunction with the accompanying drawings.

BRIEF DESCRIPTION OF DRAWINGS

FIG. 14 shows evaluation results on which a range of $\lambda \times f$, which is the product of the pitch between adjacent ones of the electrodes by the frequency, is decided.

FIG. 16 shows evaluation results on which a range of the relative value of the specific charge of the toner is decided.

FIG. 17 shows evaluation results on which a value of f×ρ and a condition for a volume resistivity of a high-resistance layer are regulated, where f×ρ is a product of the frequency of the applied voltage by the volume resistivity.

FIG. 22 shows evaluation results on which a relationship between (i) a gap between a developer transportation member and an image supporting body and (ii) the pitch between adjacent ones of the electrodes is regulated.

FIG. 23 shows evaluation results on which a relationship between (i) a product of a peripheral velocity of the image supporting body by a latent image writing resolution of the image supporting body and (ii) the frequency of the voltages applied to the progressive wave generating voltages is to be regulated.

FIG. 24(*b*) is an enlarged view of a part of FIG. 24(*a*).

FIG. 25 shows evaluation results on which field intensity for returning the toner is to be regulated.

FIG. 26(*b*) is an enlarged view of a part of FIG. 26(*a*).

FIG. 31(*a*) is a view illustrating a transportation property, density unevenness, and total evaluation levels of values of λ×f. FIG. 31(*b*) is a view illustrating an experimental condition.

BEST MODE FOR CARRYING OUT THE INVENTION

Figure 1:
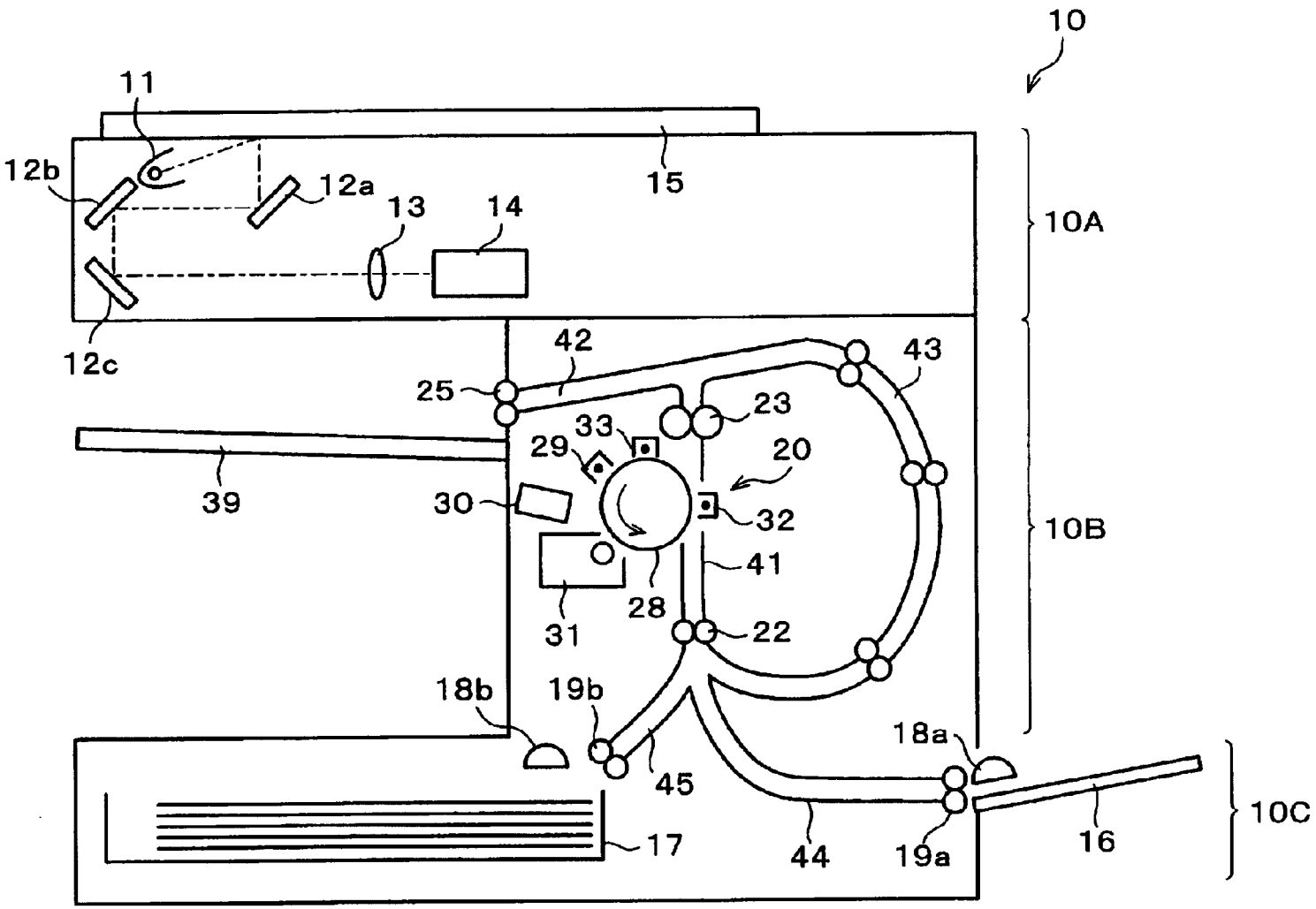
FIG. 1 is a cross-sectional view illustrating an arrangement of a digital copying apparatus, which is an example of an image forming apparatus in which a developing apparatus of an embodiment of the present invention is used.

FIG. 1 is a cross-sectional view illustrating an arrangement of a digital copying apparatus, which is an example of an image forming apparatus in which a developing apparatus of an embodiment of the present invention is used. A digital copying apparatus 10 includes a scanner section 10A in an upper part thereof, a printer section 10B in a middle part thereof, and a feeding section 10C in a lower part thereof. The digital copying apparatus 10 is substantially horseshoe-shaped. The scanner section 10A has a document table 15 made of transparent hard glass. The document table 15 is exposed on an upper surface of the digital copying apparatus 10. Below the document table 15, a light source lamp 11, mirrors 12*a* to 12*c*, a lens 13, and a photoelectric conversion element (hereinafter "CCD") 14 are provided.

The exposure lamp 11, which, together with and the mirror 12*a*, moves back and forth in parallel with a lower surface of the document table 15, so as to emit light onto an image surface of a document placed on an upper surface of the document table 15. The mirrors 12*b* and 12*c* move back and forth in parallel with the lower surface of the document table 15, at a half speed of a speed of the light source lamp 11 and the mirror 12*a*, so as to supply light to the lens 13 with a constant light length, the light being radiated from the light source lamp 11 and reflected by the image surface of the document. The lens 13 focuses, on a light receiving surface of the CCD 14, the light reflected by the image surface of the document. The CCD 14 supplies a light receipt signal that is in accordance with an amount of light received by the light receiving surface. The light receipt signal supplied from the CCD 14 is converted into digital data by an image processing section, which is described later. Then, the light receipt signal is processed by predetermined image processing, and supplied as image data to the printer section 10B.

In this example, the scanner section employs a fixed-document method, in which images of the document fixed to the document table is read by using a scanner optical system that moves in parallel with the document table. However, the scanner section may employ a moving-document method alone, or may employ both the fixed-document method and the moving-document method.

The printer section 10B includes an image forming section 20, which performs image forming by the electrophotographic method. The image forming section 20 includes a charger 29, a laser scan unit (hereinafter "LSU") 30, a developing apparatus 31, a transferrer 32, and a charge remover 33, which are so provided as to surround a photosensitive drum 28 in this order along a rotative direction of the photosensitive drum 28. The image forming section 20 further includes a fixing apparatus 23. In a main transportation path 41, the fixing apparatus 23 is located in a downstream of a gap between the photosensitive drum 28 and the transferrer 32.

In performing image forming by the image forming section 20, the charger 29 evenly applies predetermined charge to a surface of the photosensitive drum 28 rotating in an arrow direction at a predetermined processing speed. Then, the LSU 30 radiates a laser beam modulated in accordance with the image data. This forms an electrostatic latent image on the surface of the photosensitive drum 28. The developing apparatus 31 supplies developer to the surface of the photosensitive drum 28 on which the electrostatic latent image has been formed, so as to visualize, as a developer image, the electrostatic latent image. The transferrer 32 transfers the developer image supported on the surface of the photosensitive drum 28 onto a surface of a recording sheet P.

After the transferring step, remaining toner and residual charge are removed from the surface of the photosensitive drum 28 by a cleaner (not shown) and the charge remover 33, so that the photosensitive drum 28 can be used repeatedly for image formation processing. The fixing apparatus 23 causes, by applying a predetermined pressure, a heating roller and a pressure roller to contact each other, so as to heat and pressurize the recording sheet P passing through a gap between the heating roller and the pressure roller. In this way, a toner image transferred on the recording sheet P is crushed at a high temperature and under a high pressure. As a result, the toner image is thermally compressed on the recording sheet P.

Inside the printer section 10B, there is a sub-transportation path, in addition to the main transportation path 41 and an ejection transportation path 42. Between the main transportation path 41 and the ejection transportation path 42, a flapper that opens and closes the sub-transportation path is so provided as to flap freely.

The feeding section 10C includes a feeding tray 16, a feeding cassette 17, pickup rollers 18*a* and 18*b*, and feeding rollers 19*a* and 19*b*. The feeding tray 16 is attached to one side of a main body. The feeding cassette 17 contains a plurality of sheets, and is detachably provided to the main body. The pickup rollers 18*a* and 18*b* send, a sheet at a time, recording sheets P placed on the feeding tray 16 and the recording sheets contained in the feeding cassette 17. The feeding rollers 19*a* and 19*b* feed, to the printer section 10B, the recording sheets P sent by the pickup roller 18*b*. The feeding section 10C includes feeding transportation paths 44 and 45, which respectively connect the feeding tray 16 and the feeding cassette 17 with an upstream part of the main transportation path 41.

In the printer section 10B, the main transportation path 41 includes registration rollers 22, in addition to the heating roller and the pressure roller that constitute the fixing apparatus 23. The registration rollers 22 temporarily stop, before the photosensitive drum 28 rotates, the recording sheet P fed by the feeding section 10C. Then, in synchronization with rotation of the photosensitive drum 28, the registration rollers 22 lead the recording sheet P to the gap between the photosensitive drum 28 and the transferrer 32. In other words, the registration rollers 22 are not rotating when the recording sheet P is fed by the feeding section 10C; the registration rollers 22 start rotating at a timing when, at a position where the photosensitive drum 28 and the transferrer 32 face each other, a front end of the recording sheet P matches a front end of the toner image supported by the photosensitive drum 28.

The digital copying apparatus 10 has, in a space between the scanner section 10A and the feeding section 10C, an ejection tray 39 attached to one side of the printer section 10B. The ejection transportation path 42 in the printer section 10B links a downstream end of the main transportation path 41 to the ejection tray 39. Ejection rollers 25 are provided at an end of the ejection transportation path 42, the end being nearer to the ejection tray 39. The ejection rollers 25 are capable of rotating in both forward and backward directions. The ejection rollers 25 are used for realizing a both-side image forming function of the image forming section 20.

When the image forming section 20 is in a one-side image forming mode, in which images are formed on one side of the recording sheet P, the flapper is so positioned as to connect the main transportation path 41 and the ejection transportation path 42. The recording sheet P that has passed through the fixing apparatus 23 is sent to the ejection transportation path 42 by forward rotation of the ejection rollers 25, and is ejected to the ejection tray 39. On the other hand, in forming a first-side image in a both-side image forming mode, in which images are formed on both sides of the recording sheet P, the flapper flaps so as to connect the ejection transportation path 42 and the sub-transportation path 43 when a back end of the recording sheet P passes over a transportation roller (not shown) in the feeding transportation path 42. Then, the recording sheet P is led into the sub-transportation path 43 by backward rotation of the ejection rollers 25. When the recording sheet P has completely moved into the sub-transportation path 43, the flapper flaps so as to connect the main transportation path 41 and the ejection transportation path 42. The recording sheet P that has passed through the sub-transportation path 43 is led to the image forming section 20 via an upstream part of the main transportation path 41. At this time, the recording sheet P is in a reversed state. After images are formed on a second side, the recording sheet P is ejected to the ejection tray 39 by the ejection rollers 25 rotating forwardly.

Figure 2:
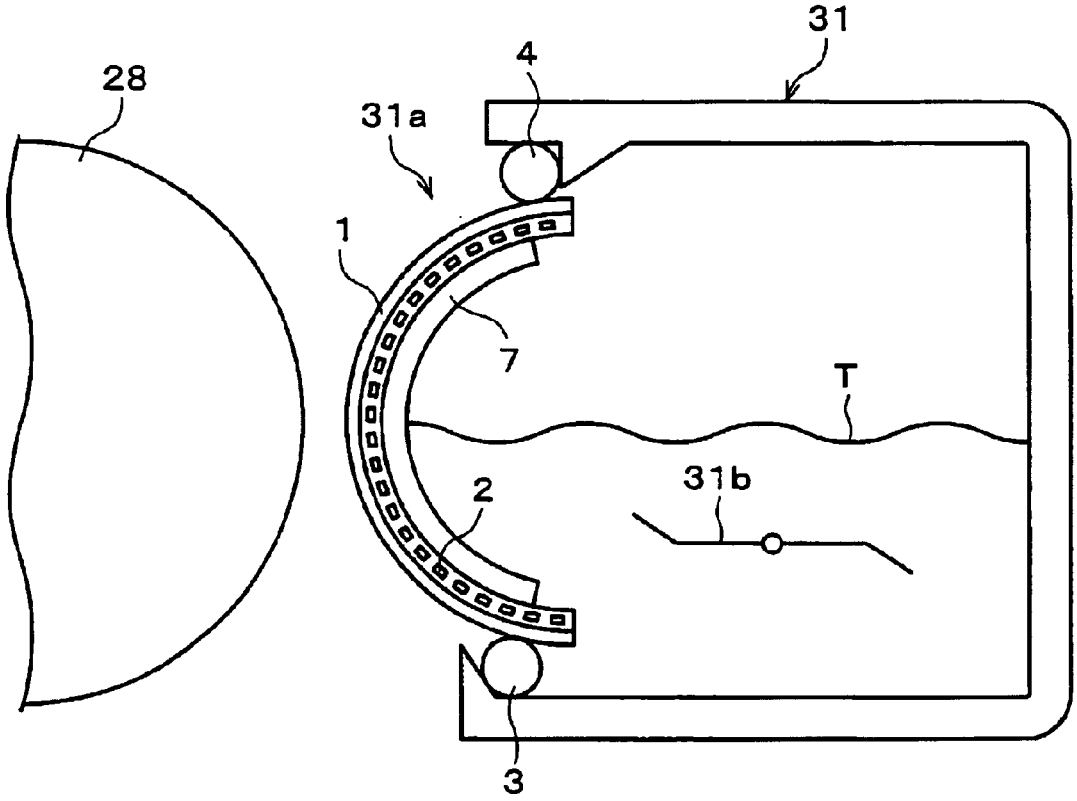
FIG. 2 illustrates an arrangement of the developing apparatus in the digital copying apparatus.

FIG. 2 illustrates an arrangement of the developing device of the digital copying apparatus. The developing apparatus 31 includes a transportation member 1 at an opening 31*a*. The transportation member 1 is transportation means of the present invention. The opening 31*a* is so provided as to face the photosensitive drum 28. The photosensitive drum 28 is an image supporting body of the present invention. The developing apparatus 31 contains the developer. Inside the developing apparatus 31, a stirring paddle 31*b* supported by a shaft is provided. The transportation member 1 faces a circumferential surface of the photosensitive drum 28 over a substantially entire area in an axis direction. The transportation member 1 is arc-shaped, and convex toward the photosensitive drum 28. Inside the transportation member 1, there are a plurality of progressive wave generating electrodes 2. The transportation member 1 is supported by a supporting member 7, which has an arc shape concentric to the transportation member 1. Note that the shape of the transportation member 1 is not limited to the arc shape. The transportation member 1 may have a flat-plate shape, for example.

At such a position of the opening 31*a* of the developing apparatus 31 as to face a vicinity of a lower end of the transportation member 1, there is provided a supplying member 3 for supplying, to a surface of the transportation member 1, developer T contained in the developing apparatus 31. At such a position of the opening 31*a* of the developing apparatus 31 as to face a vicinity of an upper end of the transportation member 1, there is provided a collecting member 4 for collecting, into the developing apparatus 31, the developer T remaining on the surface of the transportation member 1. The supplying member 3 and the collecting member 4 are roller-shaped, for example, and are rotatably supported in such a manner that circumferential surfaces thereof are partially in contact with the surface of the transportation member 1.

The supplying member 3 is made of such a material as solid rubber or rubber foam of such as silicone, urethane, or EPDM (ethylene-propylene-diene-methylene copolymer). The supplying member 3 may be so arranged that the supplying member 3 has conductivity by containing carbon black or ionic conductive material, and that a predetermined voltage is applied to the supplying member 3. A function of charging the developer T may be given to the supplying member 3 by setting, to predetermined values, (i) a contact pressure between the supplying member 3 and the surface of the transportation member 1 and (ii) voltages applied to the supplying member 3. Moreover, at such a portion of the supplying member 3 that faces an interior portion of the developing apparatus 31, there may be provided a thin-plate-shaped blade made of the same material as that constituting the supplying member 3, so that the developer T is electrically charged by the blade. The collecting member 4 may also be made of the same material as that constituting the supplying member 3. The supporting member 7 may be so formed as to fit the shape of the transportation member 1. For example, the supporting member 7 may be made of such a material as ABS (acrylonitrile-butadiene-styrene), and the like.

In the developing apparatus 31 having this arrangement, the developer T contained therein is stirred by rotation of the stirring paddle 31*b*, so that the developer T is transported to a vicinity of the supplying member 3. In the developing apparatus 31, the developer T in the vicinity of the supplying body 3 is electrically charged by the supplying member 3, and supplied to the surface of the transportation member 1. The developer T supplied to the lower end of the surface of the transportation member 1 is transported on the surface of the transportation member 1 toward the upper end, by progressive waves generated by the progressive wave generating electrodes 2, which are in the transportation member 1. Then, at a development position closest to the circumferential surface of the photosensitive drum 28, the developer T is electrostatically adsorbed into an electrostatic latent image formed on the circumferential surface of the photosensitive drum 28. A part of the developer, the part having not been absorbed into the electrostatic latent image, and therefore having not contributed to the developing step, is collected into the developing apparatus 31 by the collecting member 4 at the upper end of the transportation member 1.

Figure 3:
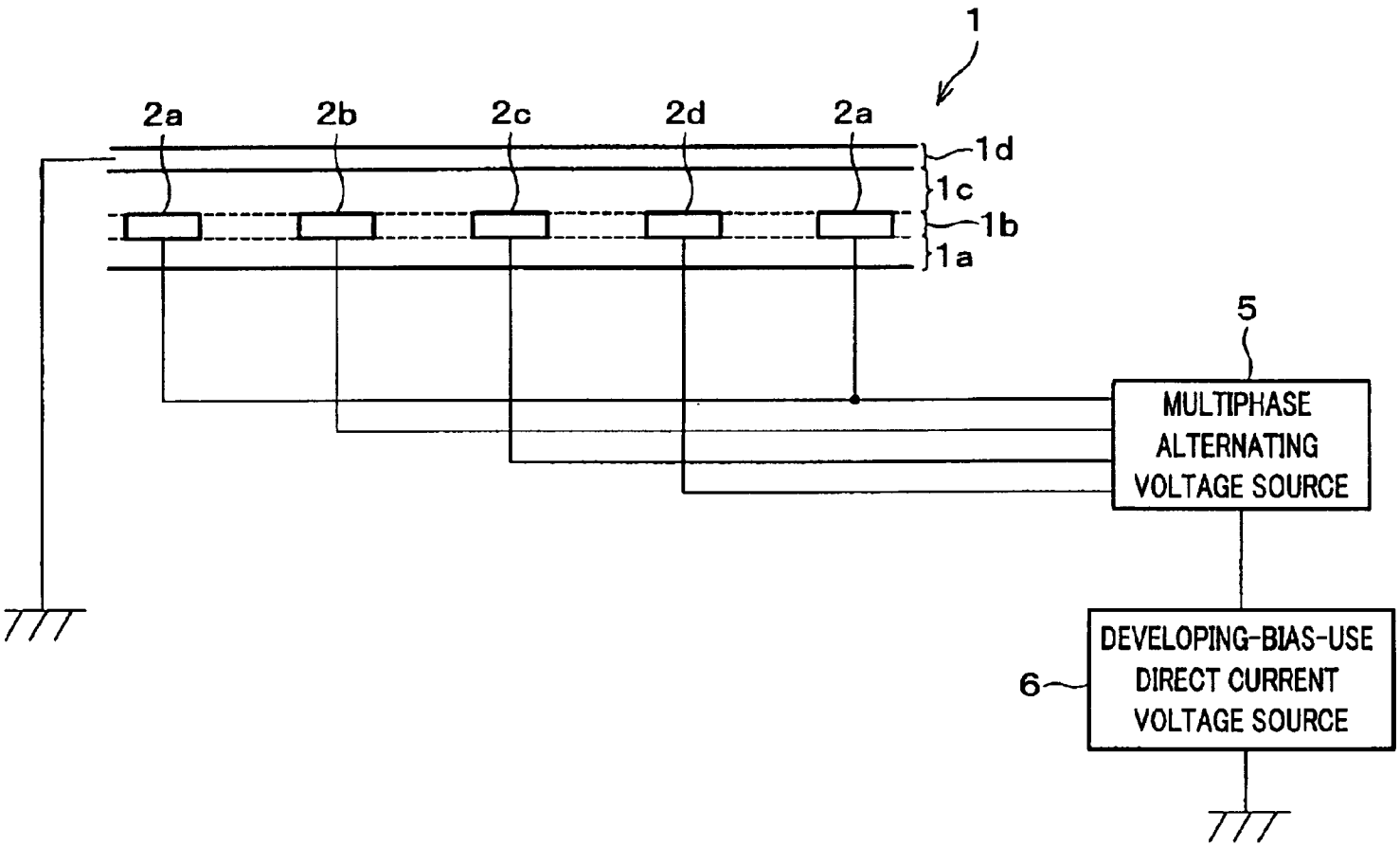
FIG. 3 illustrates an arrangement of a transportation member provided to the developing apparatus.

FIG. 3 illustrates an arrangement of the transportation member provided to the developing apparatus. On the transportation member 1, insulating layers 1*b*, 1*c*, and a protective layer 1*d* are laminated in this order on a surface of a substrate 1*a* in which a large number of progressive wave generating electrodes 2 are provided. The progressive wave generating electrodes 2 are covered with the insulating layers 1*b* and 1*c*. For example, the substrate 1*a* is 25 μm in thickness and made of polyimide; the progressive wave generating electrodes 2 are respectively 18 μm in thickness, and made of copper; the insulating layers 1*b* and 1*c* are respectively 25 μm in thickness and made of polyimide; and the protective layer 1*d* is 25 μm in thickness and made of carbon-containing polyimide. The progressive wave generating electrodes 2 are very small electrodes, each of which has a length that is substantially equivalent to a total width of the photosensitive drum 28 in the axis direction, and a width of 40 μm to 130 μm. The progressive wave generating electrodes 2 are disposed in parallel with each other, at a density of 50 dpi to 300 dpi (approximately 500 μm to 85 μm in pitch).

In this example, plural sets of progressive wave generating electrodes 2 are disposed in series in a traveling direction of the developer. Each set includes four electrodes. Four alternating voltages having different phases are respectively applied to the progressive wave generating electrodes 2 of each set. It is preferable that a developing bias voltage is applied to the progressive wave generating electrodes 2, so that a predetermined developing electric field is generated between the photosensitive drum 28 and the transportation member 1. Therefore, the developing apparatus 31 includes a multiphase alternating voltage source 5, and a developing bias direct current voltage source 6. The four alternating voltages supplied from the multiphase alternating voltage power source 5 are supplied to the progressive wave generating electrodes 2 of each set in such a manner that the four alternating voltages are superimposed on a direct current voltage supplied from the developing bias direct current voltage source 6. Note that the number of the progressive wave generating electrodes 2 in each set and the number of the alternating voltages are not limited to four. For example, three alternating voltages may be respectively applied to the three progressive wave generating electrodes 2 of each set.

Waveforms of the voltages supplied from the multiphase alternating voltage power source 5 may be rectangular, sinusoidal, or trapezoidal. It is preferable that values of the voltages supplied from the multiphase alternating voltage power source 5 fall within a range of, for example, 10V to 2 kV, so as not to cause dielectric breakdown between adjacent ones of the progressive wave generating electrodes 2. Moreover, it is preferable that a frequency of the voltages supplied from the multiphase alternating voltage power source 5 is approximately 100 Hz to 10 kHz, so as not to cause dielectric breakdown between adjacent ones of the progressive wave generating electrodes 2. These values may be set appropriately in accordance with a shape of the progressive wave generating electrodes 2, a transportation speed of the developer, a material of the developer, and the like.

Figure 4:
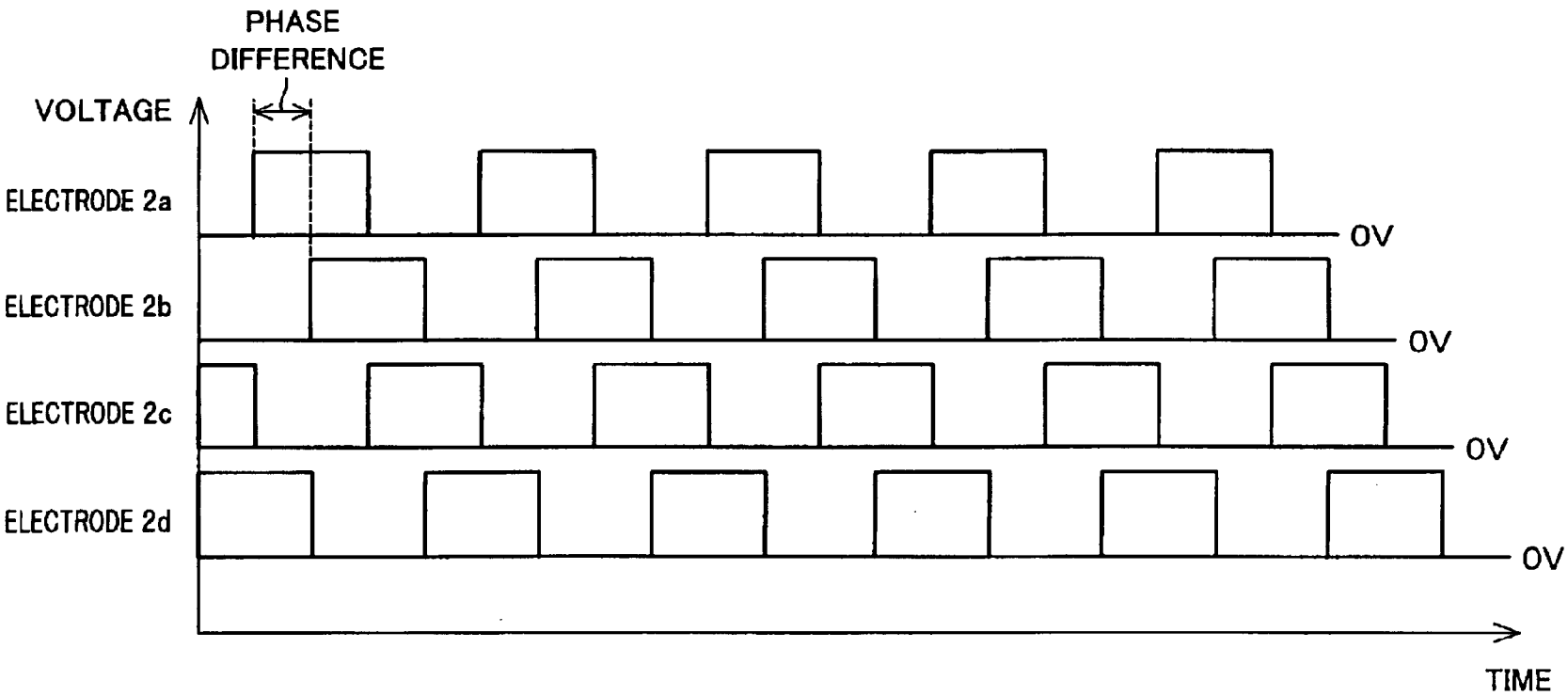
FIG. 4 is a timing chart illustrating how voltages are applied to progressive wave generating electrodes of the transportation member.
Figure 5:
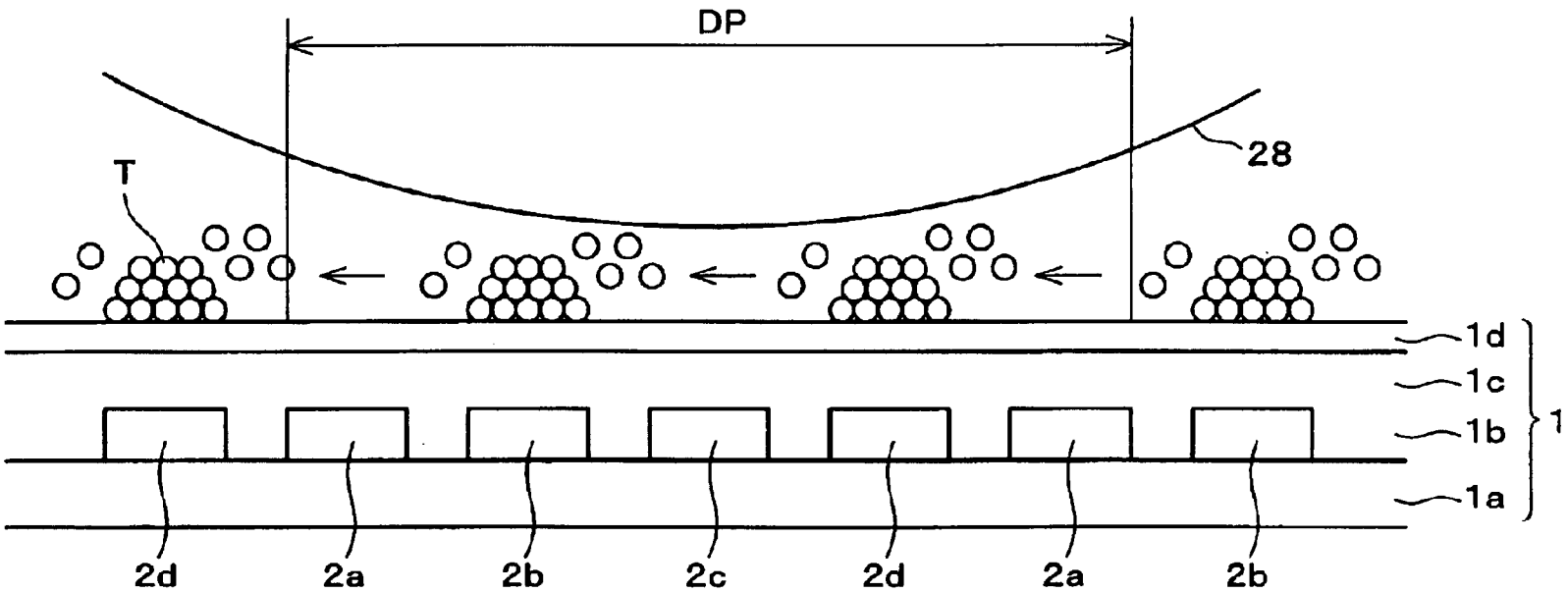
FIG. 5 illustrates how developer is transported by the transportation member.

FIG. 4 is a timing chart illustrating how the voltages are applied to the progressive wave generating electrodes of the transportation member. FIG. 5 illustrates how the developer is transported by the transportation member. Progressive wave generating electrodes 2*a* to 2*d* are disposed with predetermined intervals from each other, and disposed on the substrate 1*a* of the transportation member 1 from an upstream side to a downstream side in the traveling direction of the developer T. The alternating voltages are respectively applied, as shown in FIG. 4, to the four progressive wave generating electrodes 2*a* to 2*d*, which constitute a set. With this arrangement, as shown in FIG. 5, the developer T is sequentially transported on the surface of the transportation member 1 in an arrow direction. Then, at a development position DP, where the circumferential surface of the photosensitive drum 28 and the surface of the transportation member 1 are close to each other, the developer is electrostatically adsorbed into the electrostatic latent image formed on the surface of the photosensitive drum 28.

Note that the voltages may be applied to the progressive wave generating electrodes 2 in other ways, provided that the developer T can be transported in one direction on the surface of the transportation member 1.

Figure 6:
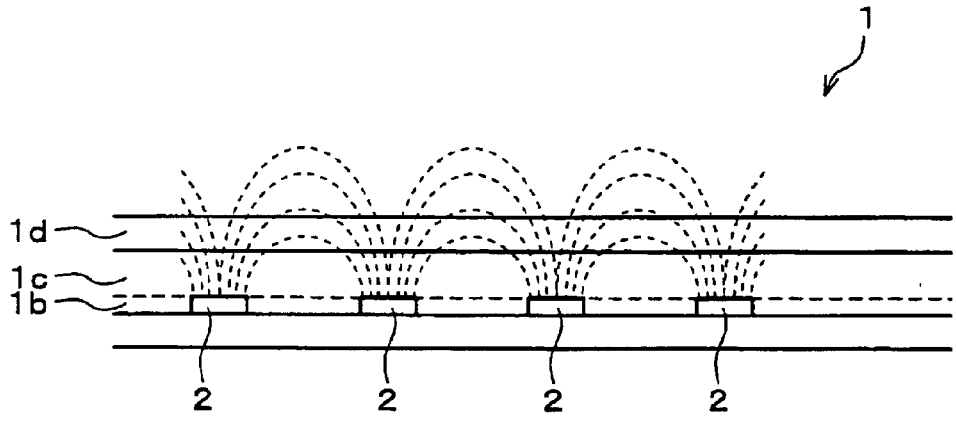
FIGS. 6(*a*) and 6(*b*) illustrate how a progressive wave electric field is generated by the progressive wave generating electrodes under different volume resistance values of a protective layer of the transportation member.
Figure 6:
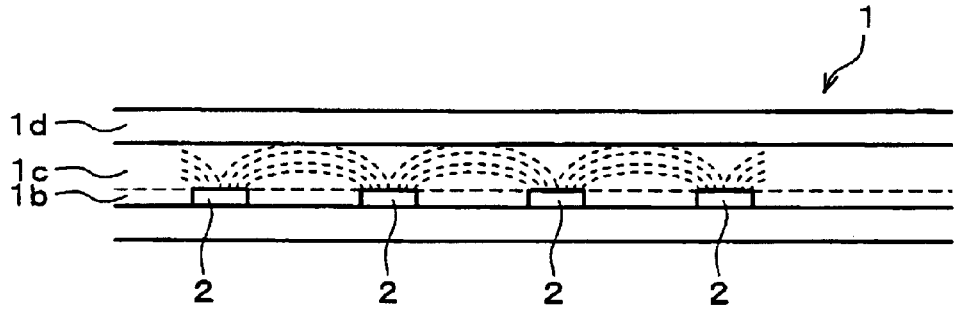

FIG. 6 illustrates how the progressive wave electric field is generated by the progressive wave generating electrodes under different volume resistance values of a protective layer of the transportation member. If a volume resistivity of the protective layer 1*d* is $10^9$ Ω·cm or lower, the developer cannot be transported on the surface of the transportation member 1, because the progressive wave electric field generated by the progressive wave generating electrodes 2 is not exposed beyond the surface of the transportation member 1, as shown in FIG. 6(*b*). If the volume resistivity of the protective layer 1*d* is $10^{18}$ Ω·cm or higher, which is equivalent to volume resistivities required for the insulating layers 1*b* and 1*c*, a surface potential of the transportation member 1 is changed by an influence of a charge potential of the developer T. Here again, the developer cannot be transported certainly on the surface of the transportation member 1. Moreover, a proper state of development cannot be kept, because the bias voltage between the surface of the transportation member 1 and the circumferential surface of the photosensitive drum 28 is changed.

In contrast, if the volume resistivity of the protective layer 1*d* is $10^{10}$ Ω·cm to $10^{17}$ Ω·cm, the progressive wave electric field generated by the progressive wave generating electrodes 2 is sufficiently exposed beyond the surface of the transportation member 1, as shown in FIG. 6(*a*). Moreover, if the volume resistivity of the protective layer 1*d* is $10^{10}$ Ω·cm to $10^{17}$ Ω·cm, the surface potential does not change significantly, even if the surface of the transportation member 1 and the developer T contact each other. As a result, the developer T can be transported certainly on the surface of the transportation member 1. Note that the volume resistivity of the protective layer 1*d* is preferably $10^{10}$ Ω·cm to $10^{14}$ Ω·cm. With this setting, it is possible to further reduce the change of the surface potential caused by the contact between the surface of the transportation member 1 and the developer T. Moreover, because the change of the surface potential of the transportation member 1 is reduced, a change of a value of the developing bias voltage between the surface of the transportation member 1 and the photosensitive drum is also reduced. As a result, it is possible to keep an always proper state of development of the electrostatic latent image formed on the circumferential surface of the photosensitive drum 28, thereby preventing deterioration of an image forming state.

For the foregoing reasons, the volume resistivity of the protective layer 1*d* should be $10^{10}$ Ω·cm to $10^{17}$ Ω·cm, which is lower than the volume resistivities of the insulating layers 1*b* and 1*c* and higher than $10^{9}$ Ω·cm. Note that, by grounding the protective layer 1*d* as shown in FIG. 3, it is possible to further reduce the change of the surface potential caused by the contact between the surface of the transportation member 1 and the developer T that has been electrically charged. This makes it possible to transport the developer T more certainly, and to prevent the change of the developing bias voltage between the surface of the transportation member 1 and the circumferential surface of the photosensitive drum 28 so as to keep the proper state of development. In this case, the protective layer 1*d* may be grounded by using a frame of the digital copying apparatus 10, or the like. The foregoing volume resistivities are values measured when 100V voltages are applied by using HIRESTA MCP-HT260, a product of MITUBISHI PETROCHEMICAL.

Figure 7:
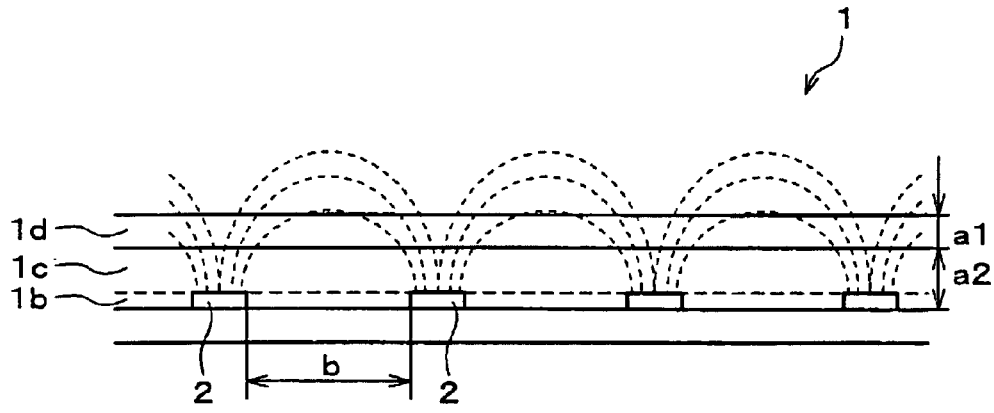
FIGS. 7(*a*) and 7(*b*) illustrate how the progressive wave electric field is generated by the progressive wave generating electrodes under different relationships between (i) thickness of insulating layers and the protective layer of the transportation member and (ii) a distance between adjacent ones of the progressive wave generating electrodes.
Figure 7:
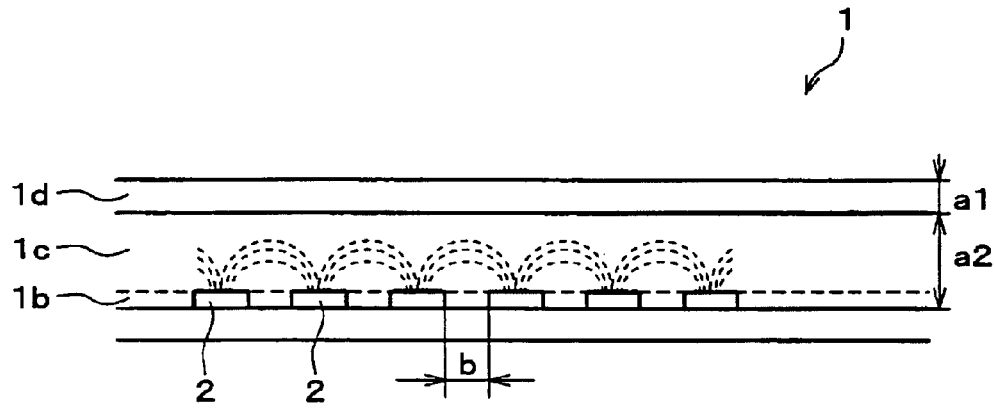

FIG. 7 illustrate how the progressive wave electric field is generated by the progressive wave generating electrodes under different relationships between (i) thickness of insulating layers and the protective layer of the transportation member and (ii) a distance between adjacent ones of the progressive wave generating electrodes. If a1+a2≧b, where a1 is thickness of the protective layer 1*d*, a2 is thickness of the insulating layers 1*b* and 1*c*, and b is a distance between adjacent ones of the progressive wave generating electrodes 2, the developer T cannot be transported on the surface of the transportation member 1, because the progressive wave electric field generated by the progressive wave generating electrodes 2 is not exposed beyond the surface of the transportation member 1, as shown in FIG. 7(*b*).

In contrast, if a1+a2<b, the developer can be certainly transported on the surface of the transportation member 1, because the progressive wave electric field generated by the progressive wave generating electrodes 2 is sufficiently exposed beyond the surface of the transportation member 1, as shown in FIG. 7(A).

For these reasons, the thickness of the protective layer 1*d* should be such that a sum of the thickness of the protective layer 1*d* and the thickness of the insulating layers 1*b* and 1*c* is less than the distance between adjacent ones of the progressive wave generating electrodes 2.

With reference to the drawings, the following describes another embodiment of the present invention.

Figure 8:
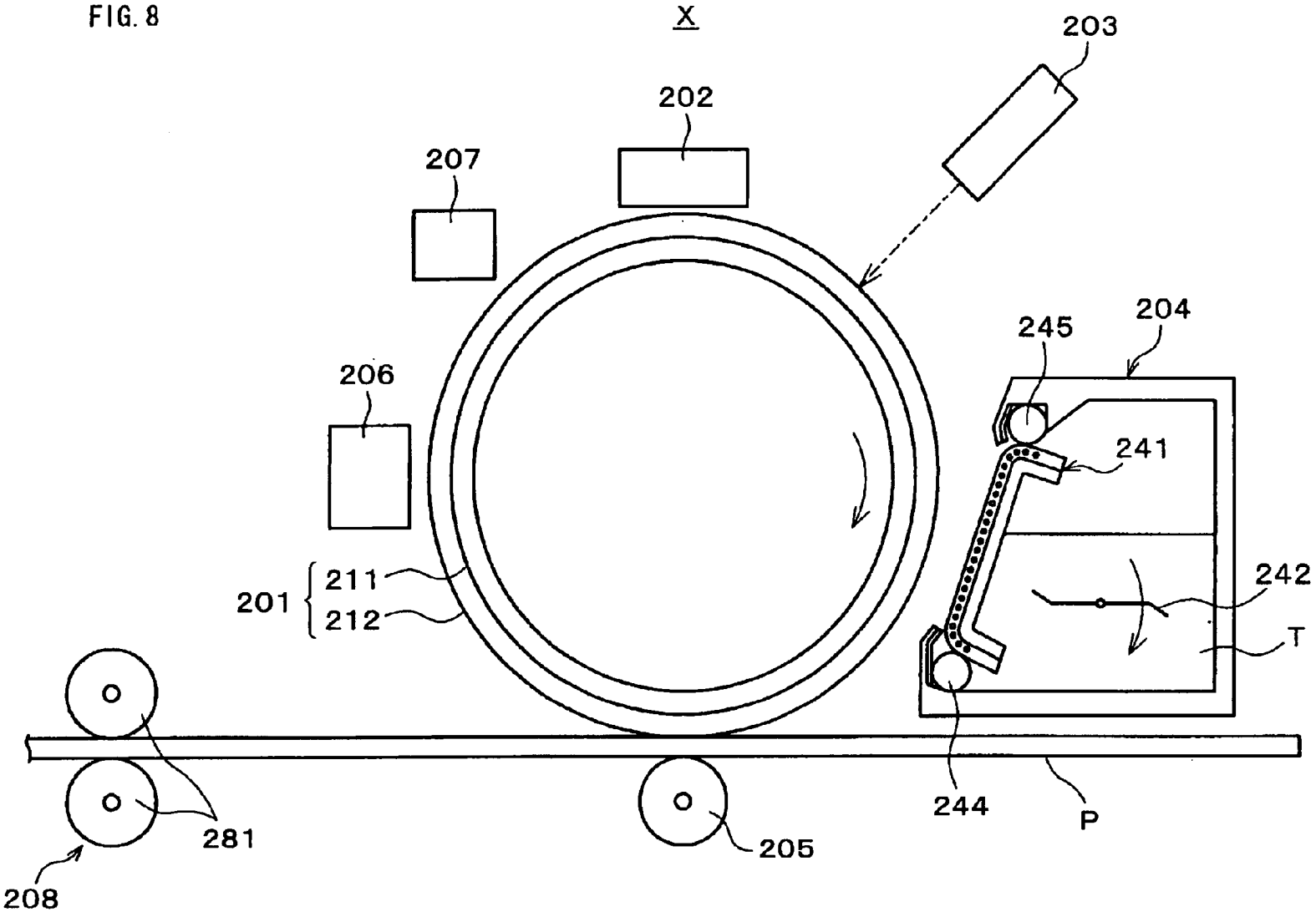
FIG. 8 is a schematic diagram illustrating a schematic arrangement of an image forming apparatus that employs an electrophotographic method, and uses a developing apparatus of an embodiment of the present invention.

FIG. 8 illustrates an image forming apparatus including a developing apparatus of the present invention. Inside the image forming apparatus X, there is provided a photosensitive drum 201 having a cylindrical shape. The photosensitive drum 201 is an image supporting body. There are a charging member 202, an exposing member 203, a developing apparatus 204, a transferring member 205, a cleaning member 206, and a potential removing member 207, which are provided in this order so as to surround the photosensitive drum 201. Between the photosensitive drum 201 and the transferring member 205, there is provided a sheet transportation path through which a sheet P is conveyed. With respect to a transportation direction of the sheet transportation path, provided in a downstream of the photosensitive drum 201 is a fixing apparatus 208 having fixing rollers 281. The fixing rollers 281 are an upper roller and a lower roller, which constitute a pair.

In an electrophotographic process, image forming is carried out as follows: (i) a document image or an electrostatic latent image corresponding to data from a host computer (not shown) is formed on the photosensitive drum 201; (ii) The electrostatic latent image is visualized by the developing apparatus; and (iii) The electrostatic latent image is transferred on the sheet P.

The photosensitive drum 201 includes a photoconductive layer 212 on a substrate 211. The photosensitive drum 201 can rotate from the charging member 202 to the members 203 to 207, according to an order in which the charging member 202 and the members 203 to 207 are disposed. First, a surface (photoconductive layer 212) of the photosensitive drum 201 is electrically charged by the charging member 202 until a predetermined potential is attained. The surface of the photosensitive drum 201, the surface having the predetermined potential, reaches a position of the exposing member 203 by rotation of the photosensitive drum 201. The exposing member 203 is writing means. By using light such as a laser, the exposing member 203 writes images on the electrically charged surface of the photosensitive drum 201, in accordance with image information. In this way, the electrostatic latent image is formed on the surface of the photosensitive drum 201. After the electrostatic latent image is formed, the surface of the photosensitive drum 201 reaches a position of the developing apparatus 204 by the rotation of the photosensitive drum 201.

The developing apparatus 204 develops the electrostatic latent image as a toner image on the photosensitive drum 201, by using toner T transported on a toner transportation member 241 (developer transportation means). The surface of the photosensitive drum 201, the surface supporting the toner image, reaches a position of the transferring member 205 by the rotation of the photosensitive drum 201.

The transferring member 205 transfers, onto the sheet P, the toner image formed on the surface of the photosensitive drum 201. The toner image transferred from the photosensitive drum 201 onto the sheet P is fixed on the sheet P by the fixing apparatus 208.

After the toner image is transferred, the surface of the photosensitive drum 201 reaches a position of the cleaning member 206 by the rotation of the photosensitive drum 201. The cleaning member 206 removes the toner T and paper powders remaining on the surface of the photosensitive drum 201. After cleaned by the cleaning member, the surface of the photosensitive drum 201 reaches a position of the potential removing member 207. The potential removing member 207 removes the potential remaining on the surface of the photosensitive drum 201. By the foregoing series of operation, one cycle of image forming is completed.

For example, the photosensitive drum 201 is so arranged that the substrate 211 is a metal drum made of aluminum or the like, and the photoconductive layer 212 having a thin-film shape is provided on a circumferential surface of the substrate 211, the photoconductive layer 212 being made of amorphous silicon (a-Si), selen (Se), organic photo conductor (OPC), and the like. However, the photosensitive drum 201 is not particularly limited.

Examples of the charging member 202 are (i) a corona charger made of such as (a) a charge wire such as a tungsten wire, (b) a shielding plate made of metal, or (c) a grid plate, (ii) a charging roller, and (iii) a charging brush. However, the charging member 202 is not particularly limited.

Examples of the exposing member 203 are a semiconductor laser and a light-emitting diode. However, the exposing apparatus is not particularly limited.

Examples of the transferring member 205 are a corona transferrer, a transferring roller, and a transferring brush. However, the transferring member 205 is not particularly limited.

An example of the cleaning member 206 is a cleaning blade. However, the cleaning member 206 is not limited.

An example of the potential removing member 207 is a potential removing lamp. However, the potential removing member 207 is not limited to this example.

In the present embodiment, there is a certain gap between the toner transportation member 241 and the photosensitive drum 201, so that the electrostatic latent image on the photosensitive drum 201 is developed in a non-contact manner. However, the present invention is not limited to this arrangement. It may be so arranged that contact development is performed by causing the toner transportation member and the surface of the photosensitive drum to contact each other.

Figure 9:
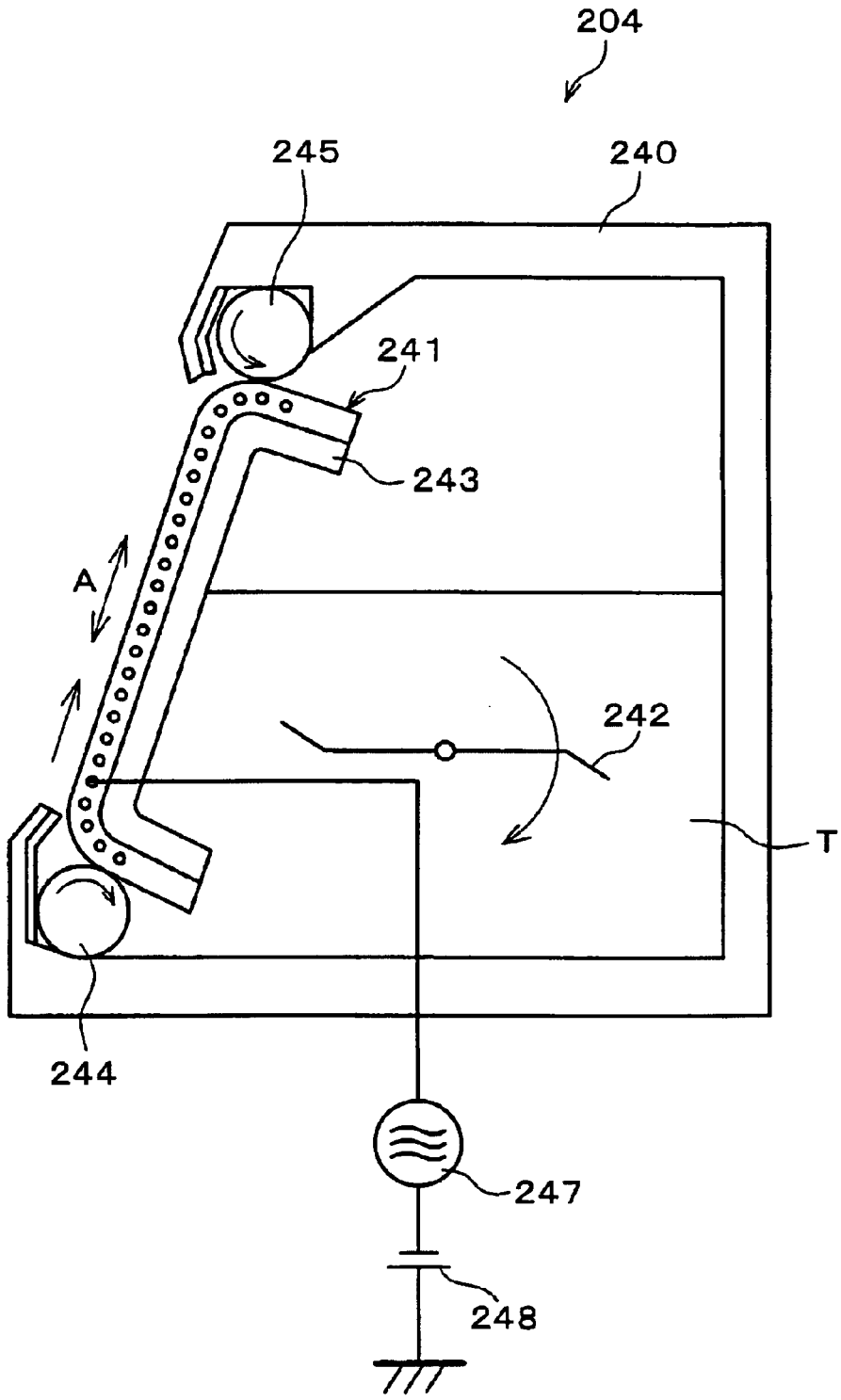
FIG. 9 is a schematic diagram illustrating an arrangement of the developing apparatus.

As shown in FIG. 9, the developing apparatus 204 includes a casing 240, a toner transportation member 241, and a mixing puddle 242. The casing 240 contains toner T. The mixing puddle 242 mixes the toner T contained in the casing 240.

The toner transportation member 241 has a belt-like shape and forms a substantially flat surface that faces a development area A of the photosensitive drum 201. Note that, although the toner transportation member 241 has the belt-like shape in the present embodiment, the toner transportation member 241 may have other shapes. For example, the toner transportation member 241 may have a semicircular shape.

The toner transportation member 241 is slightly sloped with respect to a vertical direction of the developing apparatus 204, so as to be substantially parallel to a tangent line of the development area A on the surface of the photosensitive drum 201. In order that the toner transportation member 241 having the belt-like shape can keep the posture above, provided on a reverse surface of the surface on which the toner T is transported is a supporting member 243 that supports the toner transportation member 241.

At a lower end of the toner transportation member 241, there is provided a supplying member 244 that supplies the toner T that is to be transported on the surface of the toner transportation member 241. On the other hand, at an upper end of the toner transportation member, there is provided a collecting member 245 that collects the toner T on the toner transportation member 241.

To the toner transportation member 241, a multiphase alternating voltage source 247 and a developing bias voltage source 248 are connected serially. The supplying member 244 and the connecting member 245 respectively have cylindrical shapes, and are rotatably in contact with the surface of the toner transportation member 241 having the belt-like shape.

The supplying member 244 supplies, to the toner transportation member 241, the toner T contained in the casing 240. Although a material of the supplying member 244 is not particularly limited, examples of the material are solid rubber and rubber foam of such as silicone, urethane, EPDM (ethylene-propylene-diene-methylene copolymer), and the like. To the material, carbon black or ionic conductive material may be added, so that the supplying member 244 becomes conductive (then, a voltage may be applied to the supplying member 244). It may be so arranged that the supplying member 244 has a function of charging the toner T, by setting, to predetermined values, (i) a contact pressure between the supplying member 244 and the surface of the toner transportation member 241 and (ii) voltages applied to the supplying member 244. Alternatively, it may be so arranged that the toner is electrically charged by, for example, a thin-plate-shaped blade provided in front of the supplying member 244. The same material as that constituting the supplying member 244 may be used as a material for the thin-plate-shaped blade.

The collecting member 245 is provided for collecting, and returning into the developing apparatus 204, the toner T that did not contribute to development of the electrostatic latent image on the photosensitive drum 201. Although a material of the collecting member 245 is not particularly limited, the same material as that constituting the supplying member 244 may be used, for example.

The supporting member 243 is provided for supporting the toner transportation member 241 having the belt-like shape, so that the toner transportation member 241 keeps facing the photosensitive drum 201. An arrangement of the supporting member 243 is not particularly limited. The supporting member 243 is made of ABS (acrylonitrile-butadiene-styrene) resin, for example.

Figure 10:
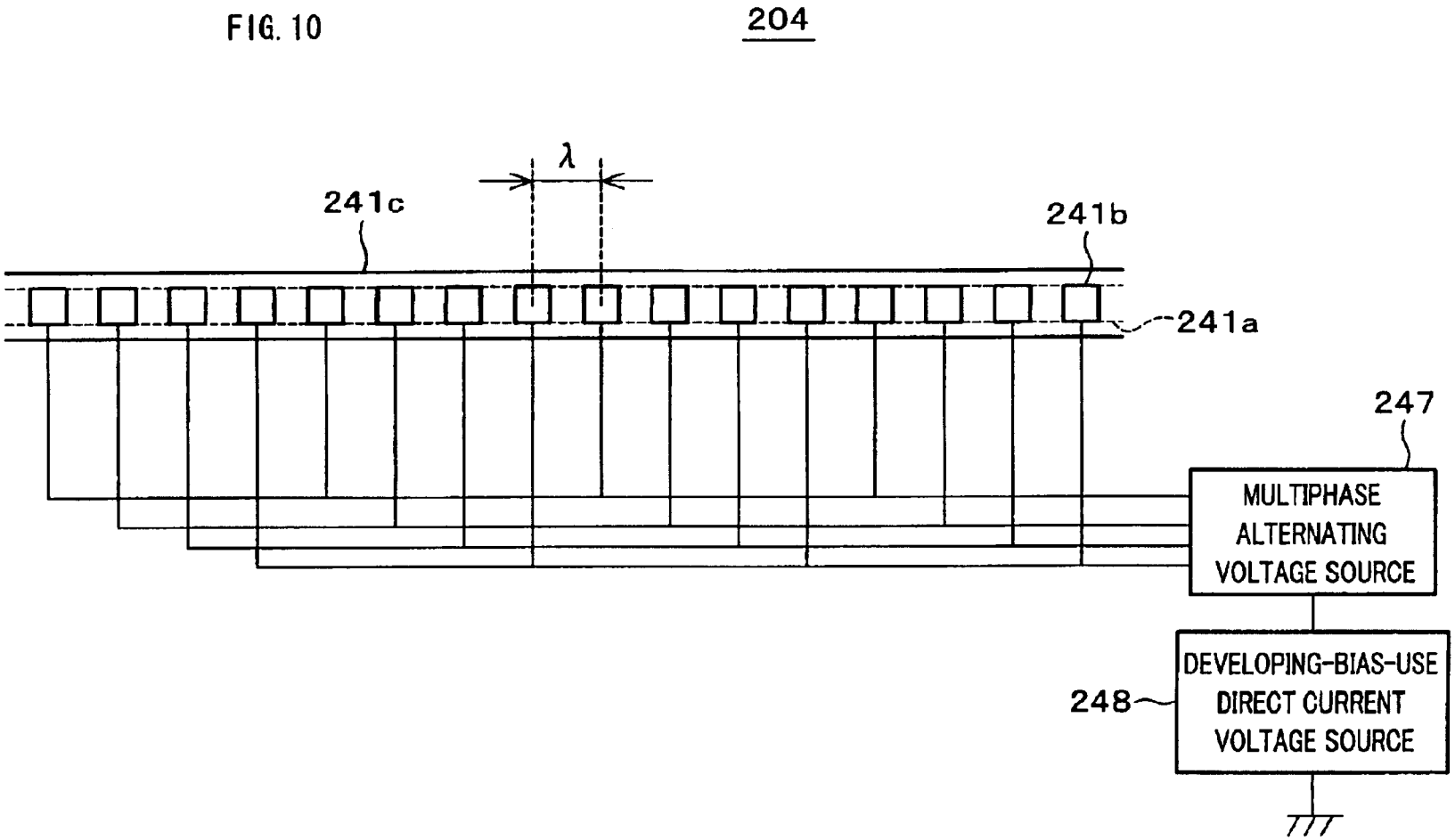
FIG. 10 is a schematic diagram illustrating an arrangement of a toner transportation member.

The toner transportation member 241 is provided for transporting the toner T by using an electric field curtain effect. As shown in FIG. 10, the toner transportation member 241 has, on a substrate 241*a* including insulating layers, plural sets of progressive wave generating electrodes 241*b* provided in series. The progressive wave generating electrodes 241*b* generate the electric field curtain effect. Each set includes four progressive wave generating electrodes 241*b*. A front surface of the toner transportation member 241 is covered with a front surface protective layer 241*c*. When multiphase alternating voltages are applied to the electrodes 241*b* by a multiphase alternating voltage source 247, an electric field curtain is generated on the front surface of the toner transportation member 241, in a direction parallel to the front surface of the toner transportation member 241. In this way, the toner T is transported to the development area A by the electric field curtain effect.

Figure 11:
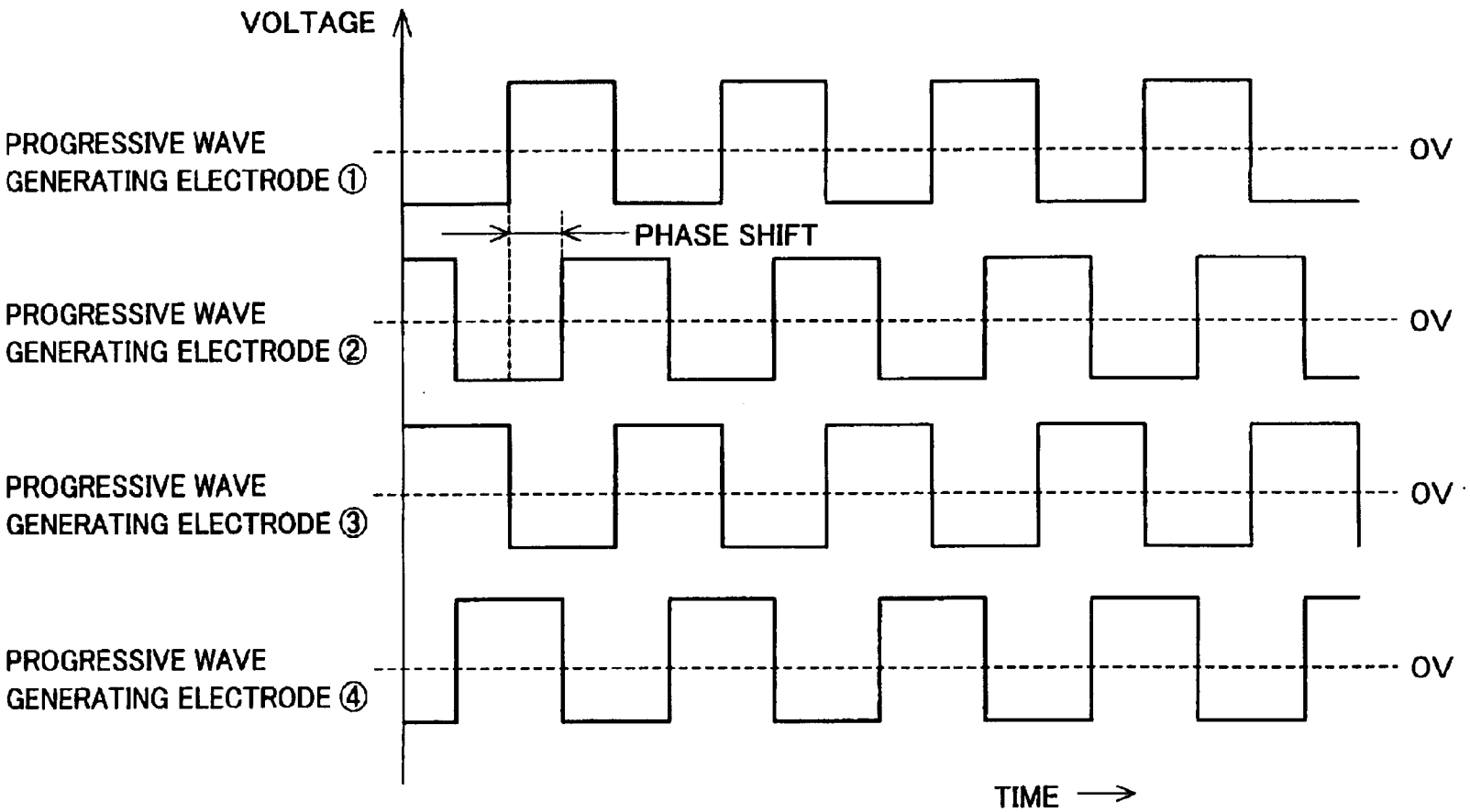
FIG. 11 is a waveform chart illustrating waveforms of voltages applied to the toner transportation member.

A specific arrangement example for the toner transportation member 241 is as follows: the substrate 241*a* is 25 $\mu$m in thickness and made of polyimide; the progressive wave generating electrodes 241*b* are respectively 18 $\mu$m in thickness, and made of copper; and the front surface protective layer 241*c* is 25 $\mu$m in thickness and made of polyimide. In the present embodiment, four progressive wave generating electrodes 241*b* constitute a set, and four alternating voltages having such waveforms as shown in FIG. 11 are respectively applied to the four progressive wave generating electrodes 241*b* of each set. In this way, the progressive wave electric field is generated on the progressive wave generating electrodes 241*b*. However, the toner transportation member 241 is not limited to this arrangement. For example, it may be so arranged that three progressive wave generating electrodes are used as a set, and three alternating voltages are respectively applied to the three progressive wave generating electrodes of each set. Moreover, it is preferable that a bias voltage (developing bias) is applied, so that a developing field is generated between the photosensitive drum 201 and the toner transportation member 241.

Waveforms of the voltages may be sinusoidal or trapezoidal. It is preferable that values of the voltages fall within a range of, for example, 100V to 3 kV, so as not to cause dielectric breakdown between adjacent ones of the progressive wave generating electrodes 241*b*. Moreover, a preferable range of the frequency is approximately 100 Hz to 5 kHz, so as not to cause dielectric breakdown between adjacent ones of the progressive wave generating electrodes 241*b*. However, these values of the voltages and frequency are not particularly limited, but may be set appropriately in accordance with a shape of progressive wave generating electrode elements, a transportation speed of the toner, a material of the toner, and the like.

As a feature of the present invention, the progressive wave generating electrodes 241*b* are very small electrodes having a width of 40 μm to 250 μm, and are disposed in parallel with each other. A pitch λ (μm) between adjacent ones of the electrodes is 50 dpi dot per inch) to 300 dpi, that is, approximately 508 μm to 85 μm. The pitch λ (μm) between adjacent ones of the electrodes and a frequency f (Hz) of the alternating current applied to the progressive wave generating electrodes 241*b* are so set as to satisfy $$0.1<\lambda\times f<0.5.$$

Figure 12:
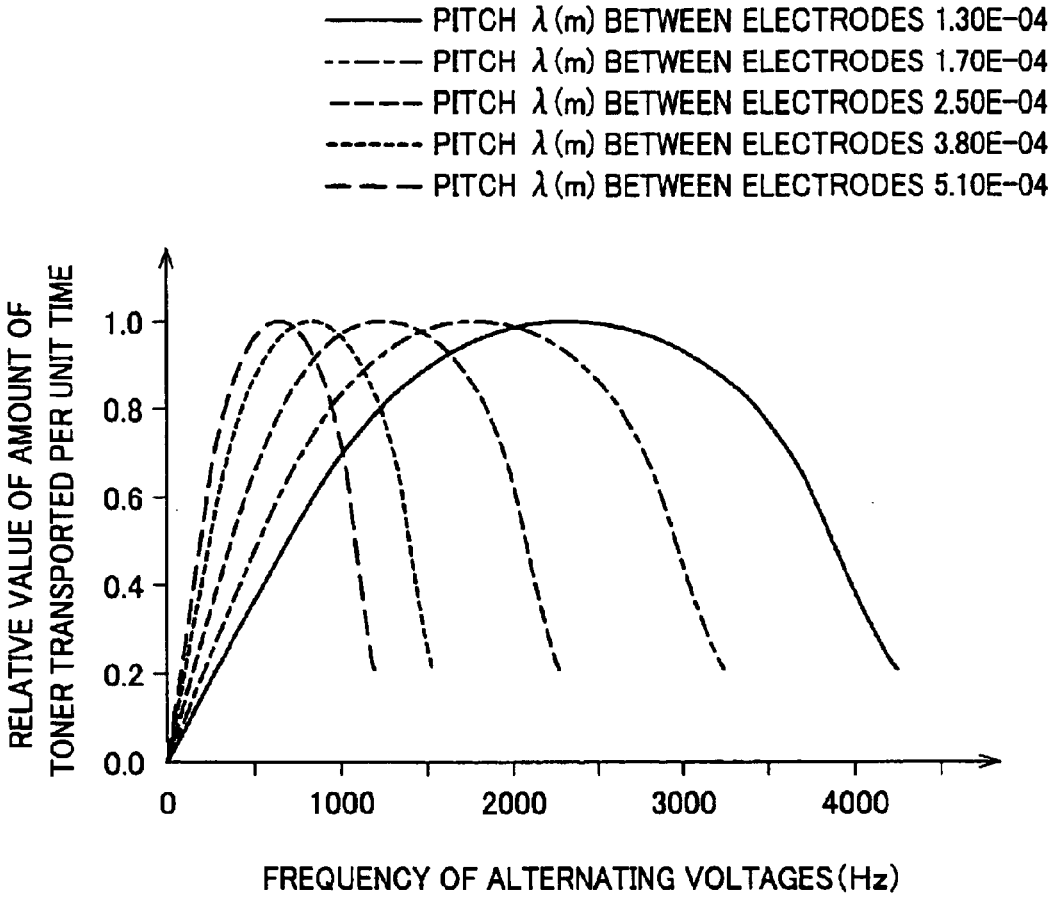
FIG. 12 is a characteristic graph illustrating characteristics of (a) relative values of an amount of the toner transported per unit time, with respect to (b) a frequency of the alternating voltages.
Figure 13:
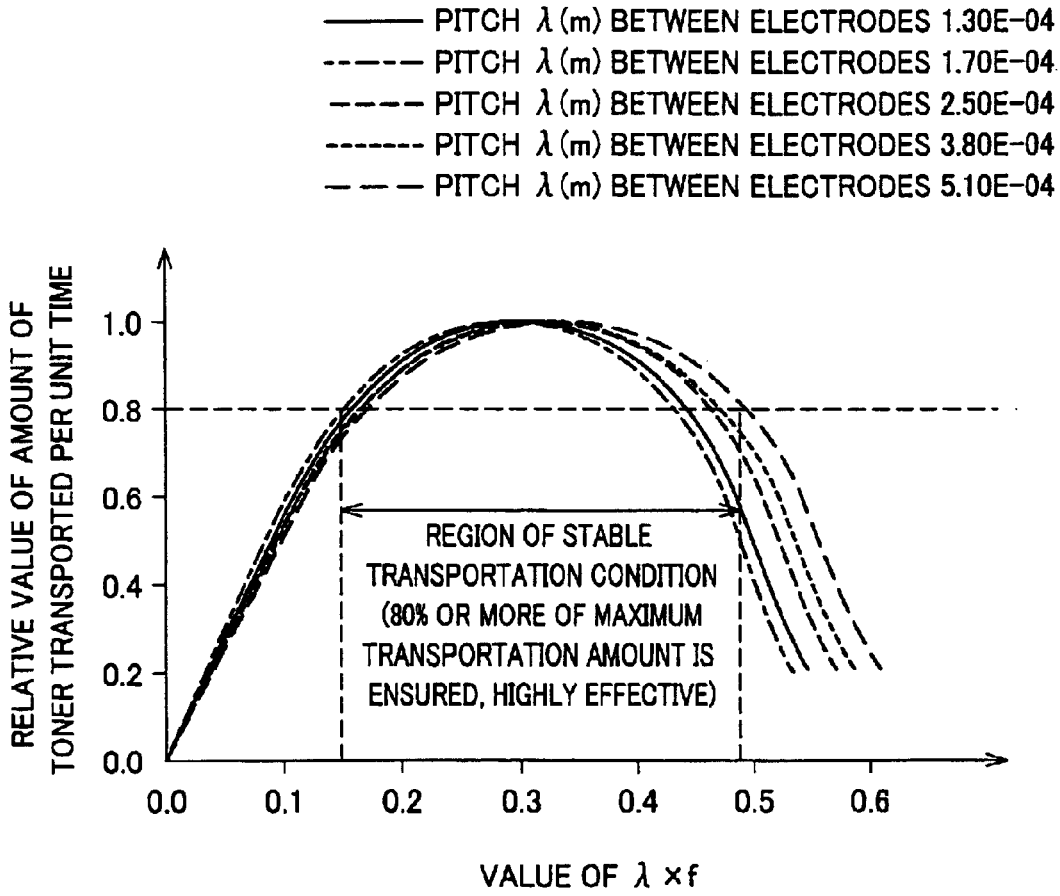
FIG. 13 is a characteristic graph illustrating characteristics of (a) the relative values of the amount of the toner transported per unit time, with respect to (b) a product of a pitch between adjacent ones of the electrodes by the frequency, under a condition in which the pitch between adjacent ones of the electrodes is varied.

FIG. 12 illustrates relative values (relative values where a maximum value under each condition is 1) of an amount of the toner T transported per unit time, with respect to the frequency f (Hz) of the alternating voltages applied to the progressive wave generating electrodes 241*b*. In FIG. 12, the pitch λ (μm) between adjacent ones of the progressive wave generating electrodes 241*b* is varied stepwise from 130 μm, 170 μm, 250 μm, 380 μm, to 510 μm. As shown in FIG. 12, if the pitch between adjacent ones of the electrodes is wide, the amount of the toner T transported per unit time becomes maximum at a low frequency. If the pitch between adjacent ones of the electrodes is narrow, the amount of the toner T transported per unit time becomes maximum on a high frequency. The foregoing setting is adopted because illustration of this relationship by using the frequency f of the alternating voltage and the amount of the toner T transported looks as shown in FIG. 13.

Specifically, regardless of the pitch λ between adjacent ones of the electrodes, the relationship between the frequency f of the alternating voltages and the amount of the toner T transported is shown as almost equivalent curves. Here, in such regions where slopes of the curves are relatively slight, that is, where a change in the frequency of a line voltage and a variation of the pitch between adjacent ones of the electrodes do not have much influence, the toner can be transported stably. Moreover, because the amount of the toner T transported is equal to or more than 80%, approximately, of the maximum amount of the toner T transported, this region is also excellent in terms of toner transportation efficiency. Therefore, as shown in FIG. 14, a stable region of the values of (λ×f) is set to a range of 0.1 to 0.5, within which the amount of the toner T transported does not change significantly, even if values of (λ×f) change. Note that FIG. 14 is based on results of an experiment conducted under the following conditions:

TABLE 1

| CONDITION OF EXPERIMENT | PITCH λ (μm) BETWEEN ELECTRODES | | | | |
|---|---|---|---|---|---|
| | 130 | 170 | 250 | 380 | 510 |
| WIDTH (μm) OF ELECTRODES | 60 | 85 | 120 | 170 | 250 |
| APPLIED VOLTAGE | ±250 V | ±300 V | ±470 V | ±750 V | ±950 V |
| FREQUENCY | VARIABLE | | | | |
| WAVEFORM | RECTANGULAR WAVE | | | | |
| NUMBER OF PHASES AND AMOUNT OF PHASE LAG | FOUR, 90° | | | | |
| SPECIFIC CHARGE (μC/g) OF TONER | −20 μC/g to −50 μC/g | | | | |

With the setting above, the transportation of the toner T does not fail to catch up with a switching cycle of the alternating voltages. Moreover, the amount of the toner T transported does not decrease because the number of transportation of the toner T per unit time does not decrease. Furthermore, it is possible to prevent firm adhering of the toner T onto the toner transportation member 241. Therefore, it is possible to transport a large amount of the toner T per unit time in the stable region in which the change in the frequency of the line voltage and the variation of the pitch between adjacent ones of the electrodes do not have much influence, that is, it is possible to transport the toner T efficiently by using the electric field curtain on the toner transportation member 241. In this case, by setting the values of (λ×f) within a range of 0.15 to 0.45, it is possible to transport the toner T very efficiently by using the electric field curtain on the toner transportation member 241, without changing the amount of the toner T transported, even if the values of (λ×f) change.

Moreover, an absolute value of a specific charge q/m, which is a charge amount given to the toner T, is set to a range of:

$$5\ \mu C/g \text{ to } 100\ \mu C/g.$$

Here, the specific charge is a physical quantity defined by q/m, where q is a charge amount of electrically charged particles absorbed, and m is a weight of the charge amount of the electrically charged particles absorbed, q and m being measured (absorption method) by a Faraday cup or the like.

Figure 15:
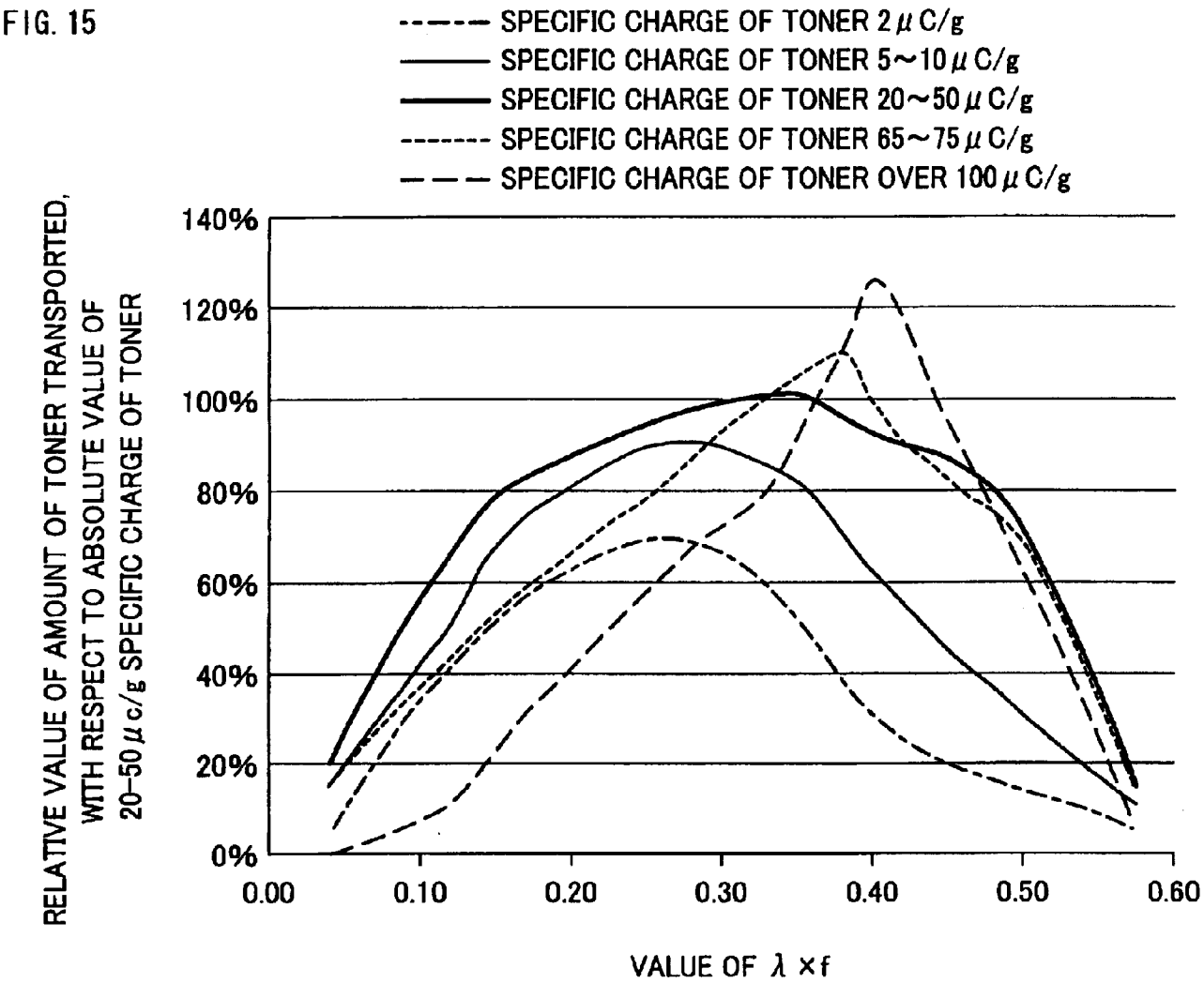
FIG. 15 is a characteristic graph illustrating characteristics of (a) the relative values of the amount of the toner transported per unit time, with respect to (b) the product of the pitch between adjacent ones of the electrodes by the frequency, under a condition in which an absolute value of specific charge of the toner is varied.

FIG. 15 illustrates characteristics of relative values of the amount of the toner T transported per unit time under the following condition of the specific charge q/m of the toner T: 2 μC/g, 5 μC/g to 10 μC/g, 20 μC/g to 50 μC/g, 65 μC/g to 75 μC/g, and 100 μC/g or more. Let us discuss the relative values of the amount of the toner T transported per unit time for the absolute values of 20 μC/g to 100 μC/g specific charge of the toner under these conditions. The amount of the toner T transported per unit time is shown with respect to the values of (λ×f), that is, a product of the pitch λ between adjacent ones of the progressive wave generating electrodes 241*b* by the frequency f (Hz) of the alternating voltages. As is obvious from FIG. 16, when the absolute value of the specific charge q/m of the toner T is set to a range of 5 μC/g to 100 μC/g, setting of an excessively small amount of charge of the toner T (a condition in which the absolute value of the specific charge q/m of the toner T is 2 μC/g) is excluded, and an excessively large amount of charge of the toner T (a condition in which the absolute value of the specific charge q/m of the toner T is 100 μC/g or more) is also excluded, thereby attaining a good transportation state under a condition in which the value of (λ×f) is 0.1 to 0.5, especially 0.15 to 0.45. Note that FIG. 16 is based on results of an experiment conducted under the following conditions shown on Table 2:

TABLE 2

| CONDITION OF EXPERIMENT | PITCH λ (μm) BETWEEN ELECTRODES 250 |
|---|---|
| WIDTH (μm) OF ELECTRODES | 120 |
| APPLIED VOLTAGE | ±470 V |
| FREQUENCY | VARIABLE |
| WAVEFORM | RECTANGULAR WAVE |
| NUMBER OF PHASES AND AMOUNT OF PHASE LAG | FOUR, 90° |
| SPECIFIC CHARGE (μC/g) OF TONER | VARIABLE |

By thus setting, to 5 μC/g or more, the absolute value of the specific charge q/m of the toner T, the charge amount of the toner T does not become excessively small. Therefore, it is possible to move the toner T smoothly between adjacent ones of the progressive wave generating electrodes 241*b*, so as to increase the amount of the toner T transported. Moreover, even if the toner T scatters in a region in which the progressive wave electric field is weak on the surface of the toner transportation member 241, it is possible to control scattering of the toner T by using a force of the progressive wave electric field, because the charge amount of the toner T is not excessively small.

On the other hand, by setting the absolute value of the specific charge q/m of the toner T to 100 μC/g or less, it is possible to prevent the charge amount of the toner T from becoming excessively large. Therefore, the toner T is transported even at a relatively high frequency. Here, once the toner T adheres to the surface of the toner transportation member 241 for some reason, mirror-image-induced firm adhering of the toner T is likely to occur on its low-frequency side, and on its high-frequency side beyond a peak. However, because a change, with respect to values of (λ×f), of the amount of the toner T transported does not have a salient peak, mirror-image-induced firm adhering of the toner T is prevented, so that the toner T is transported stably and smoothly.

In a region from (1) the surface protective layer 241*c* (surface of the progressive wave generating section 241*b*) provided to the surface of the toner transportation member 241 to (ii) a toner transportation surface, that is, on the surface protective layer 241*c*, there is provided a high-resistance layer (not shown) having a volume resistivity ρ of $10^7$ (Ω×m) or more. Note that the volume resistivity is measured by using Hiresta IP MCP-HT260 (product of Mitsubishi Petrochemical Co., Ltd.). After a 100V voltage is applied, values of ten seconds to one minute later are measured.

The volume resistivity ρ (Ω×m) of the high-resistance layer 241*d*, and the frequency f (Hz) of the voltages applied to the progressive wave generating electrodes 241*b* satisfy $$f\times\rho>10^{10}.$$

This is because, as shown in FIG. 17, good transportation states are attained under conditions in which a value of (f×ρ), that is, a product of the volume resistivity ρ (Ω×m) of the high-resistance layer 241*d* by the frequency f (Hz) of the voltages applied, is $10^{10}$ or more, and the volume resistivity ρ (Ω×m) is $10^7$ or more. In FIG. 17, those sections in which the value of (f×ρ) is $10^{10}$ or more are indicated by *, and those sections in which the volume resistivity ρ (Ω×m) is $10^7$ or more are indicated by . Note that FIG. 17** is based on results of an experiment conducted under the following conditions:

TABLE 3

| CONDITION OF EXPERIMENT | PITCH λ (μm) BETWEEN ELECTRODES 250 | 510 |
|---|---|---|
| WIDTH (μm) OF ELECTRODES | 120 | 250 |
| APPLIED VOLTAGE | ±470 V | ±950 V |
| FREQUENCY | VARIABLE | |
| WAVEFORM | RECTANGULAR WAVE | |
| NUMBER OF PHASES AND AMOUNT OF PHASE LAG | FOUR, 90° | |
| SPECIFIC CHARGE (μC/g) OF TONER | −20 μC/g to −50 μC/g | |

Thus, when the toner T is transported on the toner transportation member 241, the high-resistivity layer 241*d* ensures that the toner T is not electrically charged by contacting the toner transportation member 241. This prevents decrease of the amount of the toner T transported on the toner transportation member 241, because the field intensity of the progressive wave electric field is not decreased, especially at a low frequency. Therefore, it is possible to transport the toner T efficiently.

Moreover, by setting the volume resistivity ρ (Ω×m) of the high-resistance layer 241*d* to satisfy $\rho>10^7$, the progressive wave electric field is sufficiently generated on the toner transportation member 241. Therefore, it is possible to transport the toner T efficiently.

By using the developing apparatus 204 in an image forming apparatus X, it is possible to provide an image forming apparatus X that can transport the toner T efficiently by using a progressive wave electric field that is in a stable region in which (i) the change in the frequency f caused by the line voltage and (ii) the variation of the pitch λ between adjacent ones of the electrodes do not have much influence.

Note that the foregoing embodiment is not limited to an electrostatic latent image formed by writing optical information onto a photosensitive drum electrically charged with a predetermined charge. The foregoing embodiment may be applied to a method such as an ion flow method, in which an electrostatic latent image is formed directly on a dielectric material. Alternatively, the foregoing embodiment may be applied to a method such as a toner jet method, in which image forming is carried out directly by (i) applying an arbitrary voltage to an electrode having a plurality of openings, so that a latent image is formed in the air, and (ii) spraying developer on the recording medium.

With reference to the drawings, the following described yet another embodiment of the present invention.

Figure 18:
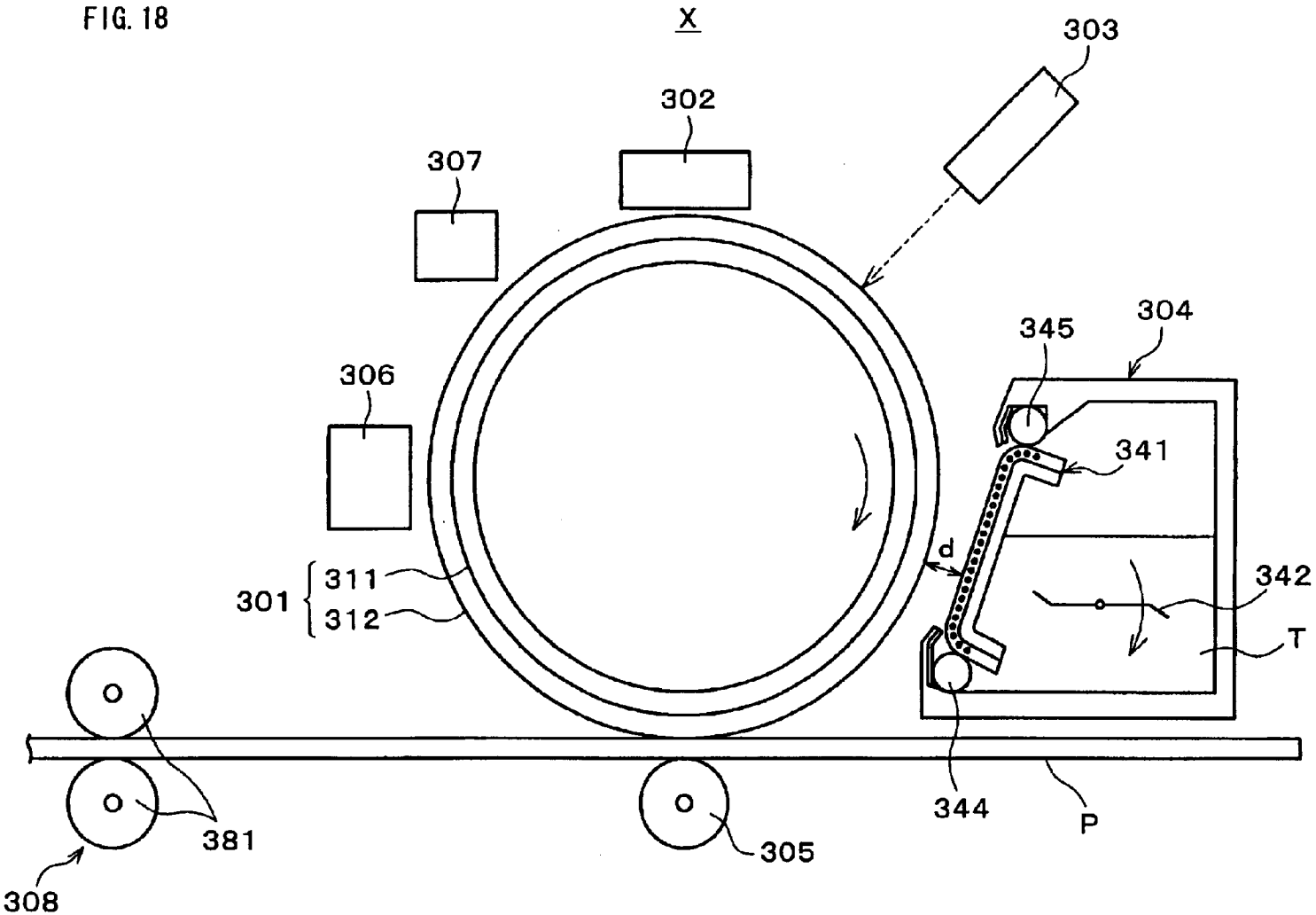
FIG. 18 is a schematic diagram illustrating a schematic arrangement of the image forming apparatus that employs an electrophotographic method, and uses the developing apparatus of the embodiment of the present invention.

FIG. 18 illustrates an image forming apparatus including a developing apparatus of the present embodiment. Inside the image forming apparatus X, there is provided a photosensitive drum 301 having a cylindrical shape. The photosensitive drum 301 is an image supporting body. There are a charging member 302, an exposing member 303, a developing apparatus 304, a transferring member 305, a cleaning member 306, and a potential removing member 307, which are provided in this order so as to surround the photosensitive drum 301. Between the photosensitive drum 301 and the transferring member 305, there is provided a sheet transportation path through which a sheet P is conveyed. With respect to a transportation direction of the sheet transportation path, provided at a downstream of the photosensitive drum 301 is a fixing apparatus 308 having fixing rollers 381. The fixing rollers 381 are an upper roller and a lower roller, which constitute a pair.

In an electrophotographic process, a document image or an electrostatic latent image corresponding to data from a host computer (not shown) is formed on the photosensitive drum 301. The electrostatic latent image is visualized by the developing apparatus, and image forming is performed by transferring the electrostatic latent image on the sheet P.

The photosensitive drum 301 includes a photoconductive layer 312 on a substrate 311. The photosensitive drum 301 can rotate from the charging member 302 to the members 303 to 307, according to an order in which the charging member 302 and the members 303 to 307 are disposed. First, a surface (photoconductive layer 312) of the photosensitive drum 301 is electrically charged by the charging member 302 until a predetermined potential is attained. The surface of the photosensitive drum 301, the surface having the predetermined potential, reaches a position of the exposing member 303 by rotation of the photosensitive drum 301. The exposing member 303 is writing means. The exposing member writes an image on the electrically charged surface of the photosensitive drum 301, in accordance with image information by using such light as a laser. In this way, the electrostatic latent image is formed on the surface of the photosensitive drum 301. After the electrostatic latent image is formed, the surface of the photosensitive drum 301 reaches a position of the developing apparatus 304 by the rotation of the photosensitive drum 301.

The developing apparatus 304 develops the electrostatic latent image as a toner image on the photosensitive drum 301, by using toner T (developer) transported on a toner transportation member 341. The surface of the photosensitive drum 301, the surface supporting the toner image, reaches a position of the transferring member 305 by rotation of the photosensitive drum 301.

The transferring member 305 transfers, onto the sheet P, the toner image formed on the surface of the photosensitive drum 301. The toner image transferred from the photosensitive drum 301 onto the sheet P is fixed on the sheet P by the fixing apparatus 308.

After the toner image is transferred, the surface of the photosensitive drum 301 reaches a position of the cleaning member 306 by rotation of the photosensitive drum 301. The cleaning member 306 removes the toner T and paper powders remaining on the surface of the photosensitive drum 301. After cleaned by the cleaning member 306, the surface of the photosensitive drum 301 reaches a position of the potential removing member 307. The potential removing member 307 removes the potential remaining on the surface of the photosensitive drum 301. By the foregoing series of operation, one cycle of image forming is completed.

For example, the photosensitive drum 301 has such an arrangement where the substrate 311 is a metal drum made of aluminum or the like, and the photoconductive layer 312 having a thin-film shape is provided on a circumferential surface of the photosensitive drum 301, the photoconductive layer 312 being made of amorphous silicon (a-Si), selen (Se), or organic photoconductor (OPC). However, the photosensitive drum 301 is not particularly limited to this arrangement.

Examples of the charging member 302 are (i) a corona charger made of such as (a) a charge wire such as a tungsten wire, (b) a shielding plate made of metal, or (c) a grid plate, (ii) a charging roller, and (iii) a charging brush. However, the charging member 302 is not particularly limited.

Examples of the exposing member 303 are a semiconductor laser and a light-emitting diode. However, the exposing member 303 is not particularly limited.

Examples of the transferring member 305 are a corona transferrer, a transferring roller, and a transferring brush. However, the transferring member 305 is not particularly limited.

An example of the cleaning member 306 is a cleaning blade. However, the cleaning member 306 is not limited.

An example of the potential removing member 307 is a potential removing lamp. However, the potential removing member 307 is not limited.

In the present embodiment, there is a certain gap between the toner transportation member 341 and the photosensitive drum 301, so that the electrostatic latent image on the photosensitive drum 301 is developed in a non-contact manner. However, the present invention is not limited to this arrangement. It may be so arranged that contact development is performed by causing the toner transportation member and the surface of the photosensitive drum to contact each other.

Figure 19:
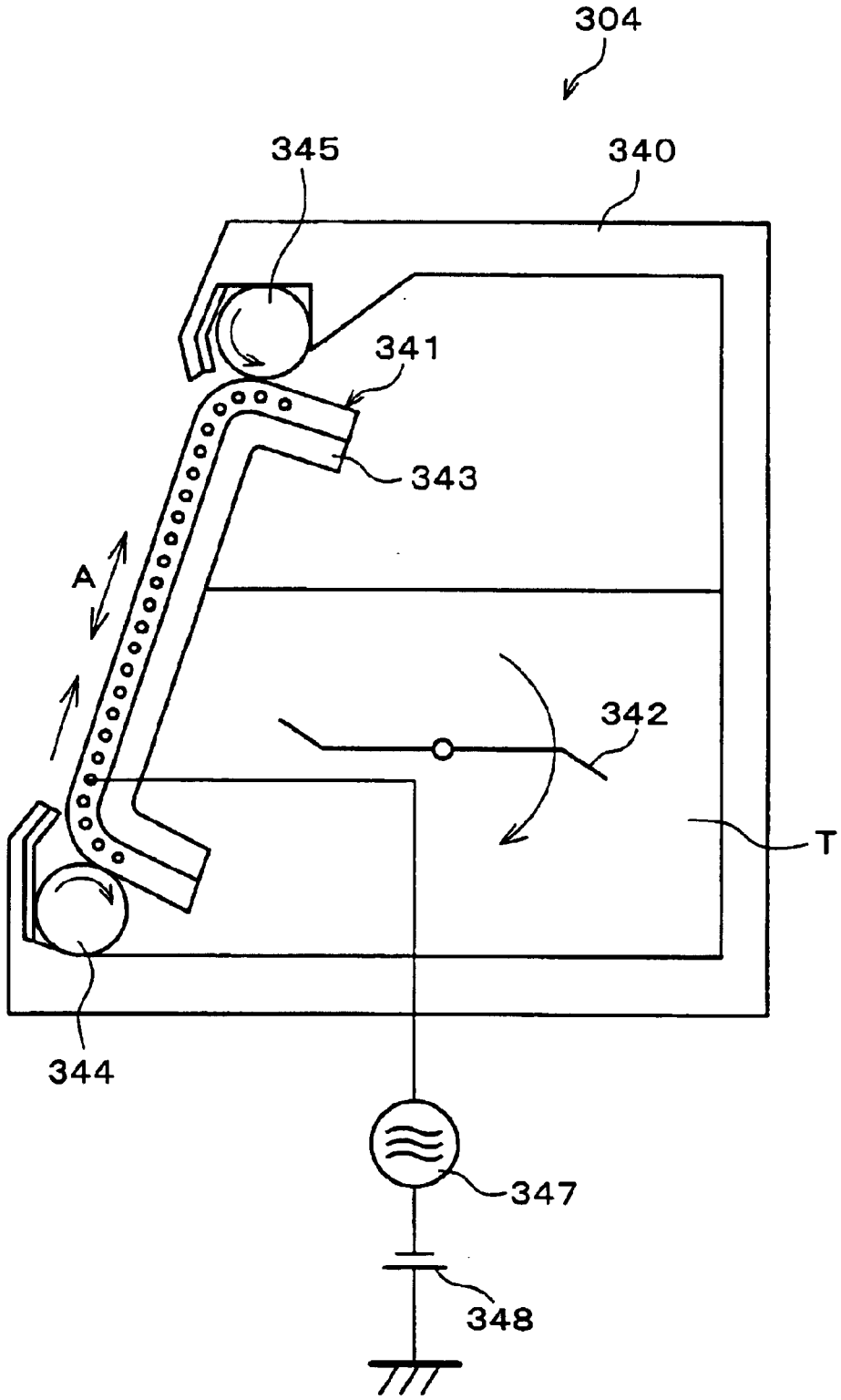
FIG. 19 is a schematic diagram illustrating an arrangement of the developing apparatus.

As shown in FIG. 19, the developing apparatus 304 includes a casing 340, a toner transportation member 341, and a mixing puddle 342. The casing 340 contains the toner T. The mixing puddle 342 mixes the toner T contained in the casing 340.

The toner transportation member 341 has a belt-like shape and forms a substantially flat surface that faces a development area A of the photosensitive drum 301. Note that, although the toner transportation member 341 has the belt-like shape in the present embodiment, the toner transportation member 341 may have other shapes. For example, the toner transportation member 341 may have a semicircular shape.

The toner transportation member 341 is slightly sloped with respect to a vertical direction of the developing apparatus 304, so as to be substantially parallel to a tangent line of the development area A on the surface of the photosensitive drum 301. In order that the toner transportation member 341 having the belt-like shape can keep the posture above, a supporting member 343 that supports the toner transportation member 341 is provided on a reverse surface of the surface on which the toner T is transported.

At a lower end of the toner transportation member 341, there is provided a supplying member 344 that supplies the toner T that is to be transported on the surface of the toner transportation member 341. On the other hand, at an upper end of the toner transportation member 341, there is provided a collecting member 345 that collects the toner T on the toner transportation member 341.

To the toner transportation member 341, a multiphase alternating voltage source 347 and a developing bias voltage source 348 are connected serially. The supplying member 344 and the connecting member 345 respectively have cylindrical shapes, and are rotatably in contact with the surface of the toner transportation member 341 having the belt-like shape.

The supplying member 344 supplies, to the toner transportation member 341, the toner T contained in the casing 340. Although a material of the supplying member 344 is not particularly limited, examples of the material are solid rubber and rubber foam of such as silicone, urethane, EPDM (ethylene-propylene-diene-methylene copolymer), and the like. To the material, carbon black or ionic conductive material may be added, so that the supplying member 344 becomes conductive (then, a voltage may be applied to the supplying member 344). It may be so arranged that the supplying member 344 has a function of charging the toner T, by setting, to predetermined values, (i) a contact pressure between the supplying member 344 and the toner transportation member 341 and (ii) voltages applied to the supplying member 344. Alternatively, it may be so arranged that the toner T is electrically charged by, for example, a thin-plate-shaped zlade provided in front of the supplying member 344. The same material as that constituting the supplying member 344 may be used as a material for the thin-plate-shaped blade.

The collecting member 345 is provided for collecting, and returning into the developing apparatus 304, the toner T that did not contribute to developing the electrostatic latent image on the photosensitive drum 301. Although a material of the collecting member 345 is not particularly limited, the same material as that constituting the supplying member 344 may be used, for example.

The supporting member 343 is provided for supporting the toner transportation member 341 having the belt-like shape, so that the toner transportation member 341 keeps facing the photosensitive drum 301. An arrangement of the supporting member 343 is not particularly limited. For example, the supporting member 343 is made of ABS (acrylonitrile-butadiene-styrene) resin.

Figure 20:
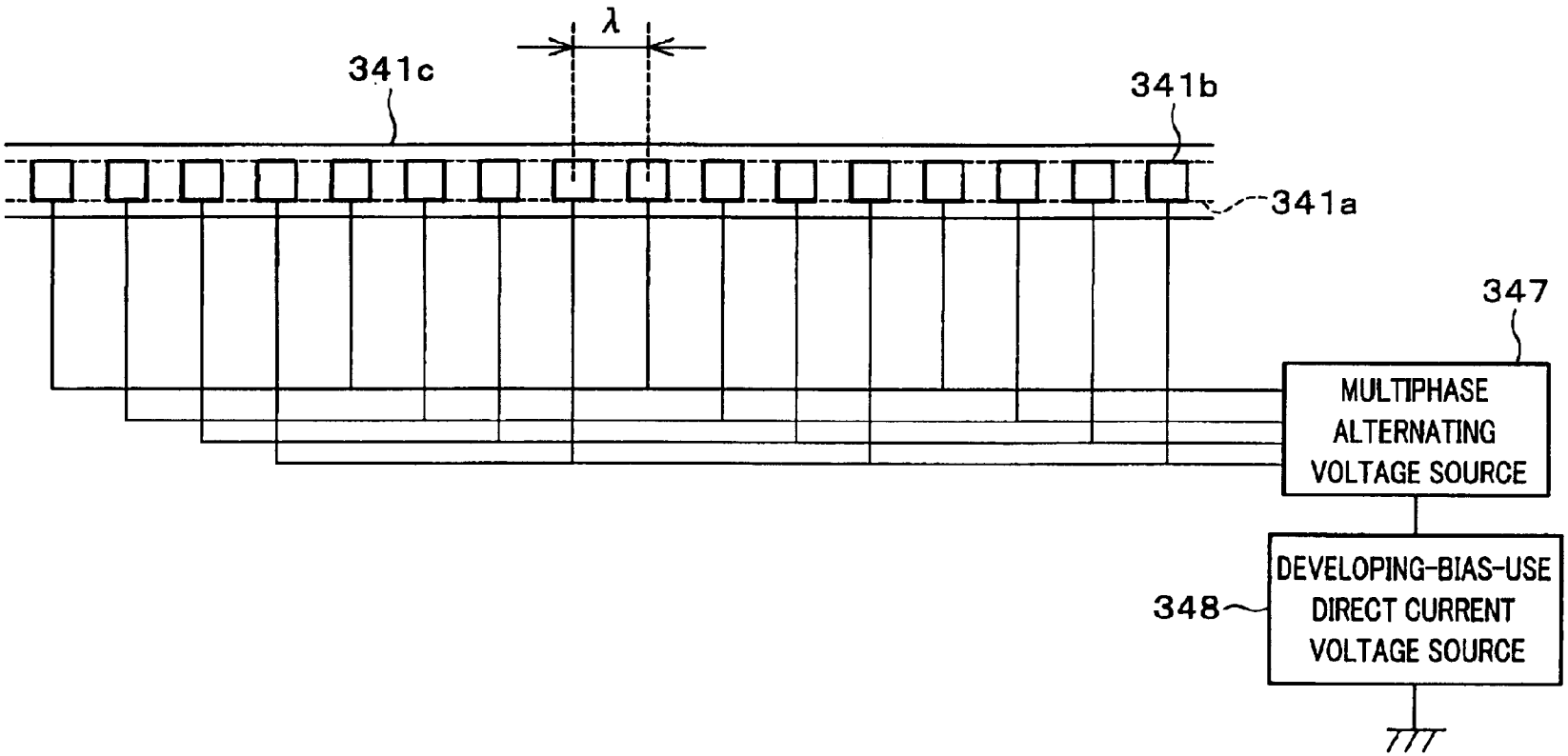
FIG. 20 is a schematic diagram illustrating an arrangement of a toner transportation member.

The toner transportation member 341 is provided for transporting the toner T by an electric field curtain effect. As shown in FIG. 20, the toner transportation member 341 has, on a substrate 341*a* consisting of insulating layers, plural sets of progressive wave generating electrodes 341*b* provided in series. The progressive wave generating electrodes 341*b* generate the electric field curtain effect. Each set includes 304 progressive wave generating electrodes 341*b*. A front surface of the toner transportation member 341 is covered with a front surface protective layer 341*c* including at least one of a dielectric material layer and a high-resistance layer. When multiphase alternating voltages are applied to the electrodes 341*b* by the multiphase alternating voltage source 347, which is provided for transporting the toner, an electric field curtain is generated on the front surface of the toner transportation member 341, in a direction parallel to the front surface of the toner transportation member 341. In this way, the toner T is transported to the development area A by the electric field curtain effect. Here, the progressive wave generating electrodes 341*b* are very small electrodes, each of which has a width of 40 μm to 250 μm. The progressive wave generating electrodes 341*b* are provided in parallel with each other to the surface of the photosensitive drum 301 (photoconductor layer 312).

Figure 21:
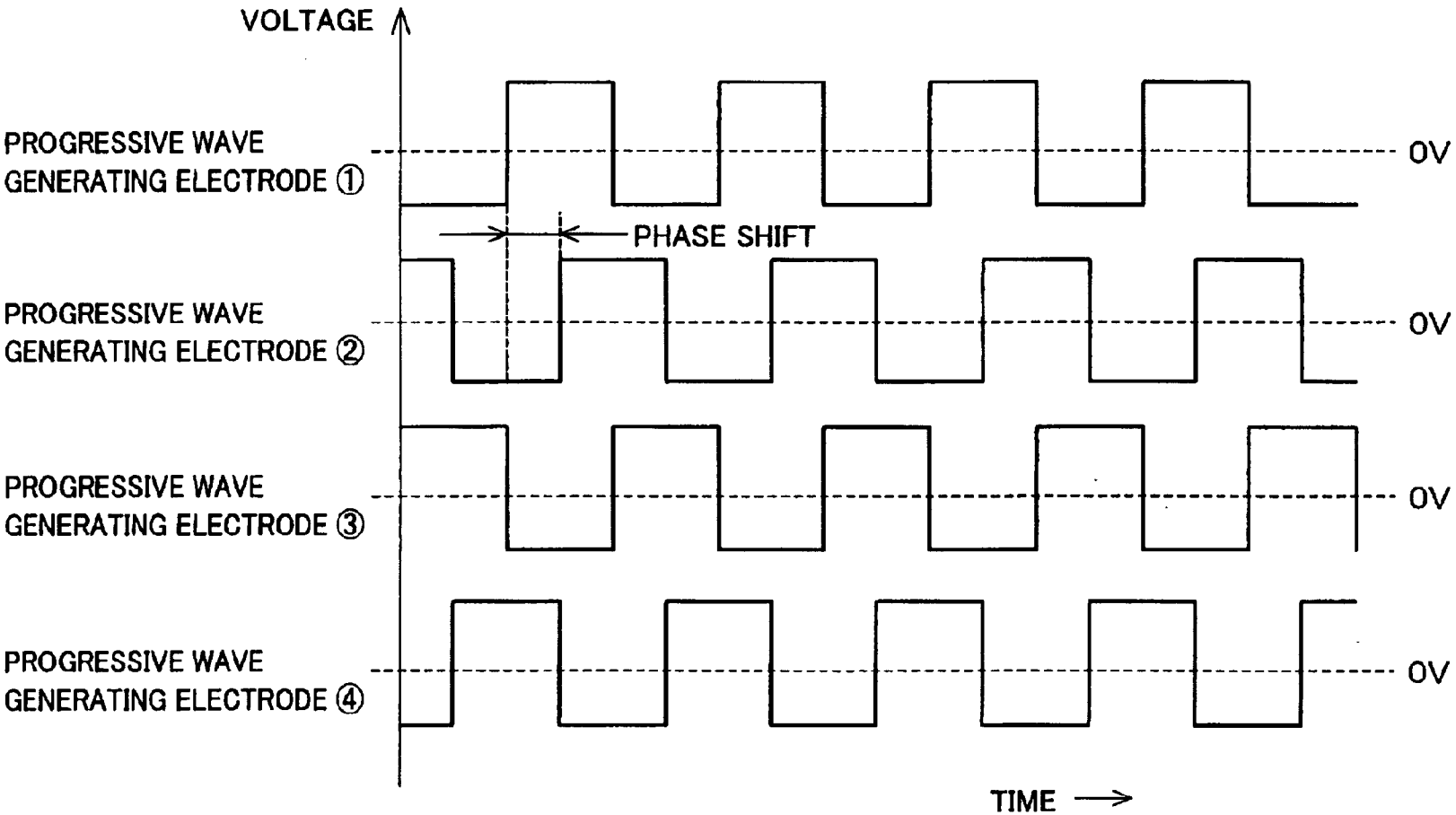
FIG. 21 is a waveform chart illustrating waveforms of voltages applied to the toner transportation member.

A specific example of the toner transportation member 341 is as follows: the substrate 341*a* is 25 μm in thickness and made of polyimide; the progressive wave generating electrodes 341*b* are respectively 18 μm in thickness, and made of copper; and the front surface protective layer 341*c* is 25 μm in thickness and made of polyimide. In the present embodiment, four progressive wave generating electrodes 341*b* constitute one set, and four alternating voltages having such waveforms as shown in FIG. 21 are respectively applied to the four progressive wave generating electrodes 341*b* of each set. In this way, progressive wave electric field is generated on the progressive wave generating electrodes 341*b*. However, the toner transportation member 341 is not limited to this arrangement. For example, it may be so arranged that three progressive wave generating electrodes are used as a set, and three alternating voltages are respectively applied to the three progressive wave generating electrodes of each set. Moreover, it is preferable that a bias voltage (developing bias) is applied, so that a developing field is generated between the photosensitive drum 301 and the toner transportation member 341.

Waveforms of the voltages may be in sinusoidal, trapezoidal, or other forms. It is preferable that values of the voltages fall within a range of, for example, 100V to 3 kV, so as not to cause dielectric breakdown between adjacent ones of the progressive wave generating electrodes 341*b*. Moreover, a preferable range of the frequency is approximately 100 Hz to 5 kHz, so as not to cause dielectric breakdown between adjacent ones of the progressive wave generating electrodes 341*b*. However, these values of the voltages and frequency are not particularly limited, but may be set appropriately in accordance with a shape of progressive wave generating electrode elements, a transportation speed of the toner T, material of the toner T, and the like.

As a feature of the present invention, as shown in FIG. 22, (i) a gap d (μm) between the toner transportation member 341 and the photosensitive drum 301 and (ii) the pitch λ (μm) between adjacent ones of the progressive wave generating electrodes 341*b* satisfy $$d>\lambda.$$

This setting is based on an analysis of image formation states under different magnitude relationships between the gap d and the pitch λ, as shown in FIG. 22. Specifically, this setting is adopted because if the gap d and the pitch λ satisfy d>λ (if a total evaluation is B (good) or A (very good)), periodical unevenness is reduced favorably or very favorably, and blotching is also reduced favorably or very favorably. Note that FIG. 22 is based on results of an experiment conducted under the following conditions:

TABLE 4

| CONDITION OF EXPERIMENT | PITCH λ (μm) BETWEEN ELECTRODES 120 | 250 | 500 |
|---|---|---|---|
| VOLTAGE OF PROGRESSIVE WAVE | 0 ± 200 V | 0 ± 375 V | 0 ± 750 V |
| WIDTH (μm) OF ELECTRODES | 50 | 100 | 200 |
| FREQUENCY | 1 kHz | | |
| WAVEFORM | RECTANGULAR WAVE | | |
| NUMBER OF PHASES AND AMOUNT OF PHASE LAG | FOUR, 90° | | |
| CHARGE POTENTIAL V0 OF PHOTOSENSITIVE DRUM | −1000 V | | |

According to the setting above, the gap d between the toner transportation member 341 and the photosensitive drum 301 is wider than the pitch λ of adjacent ones of the progressive wave generating electrodes 341*b*. Under such a condition, even while the progressive wave electric field is generated on the surface of the toner transportation member 341, that is, even while different voltages are respectively applied to the progressive wave generating electrodes 341*b*, the surface (supporting surface) of the photosensitive drum 301 is hardly influenced, at a position right above or in close proximity with the surface of the toner transportation member 341, by spatial and temporal distribution of the potential. Therefore, the potential distribution between adjacent ones of the progressive wave generating electrodes 341*b* is hardly reflected on the surface of the photosensitive drum 301 that is in close proximity with the surface of the toner transportation member 341. Therefore, temporal and spatial uniformity is maintained. This makes it possible to reduce, in performing developing, an influence of unevenness in the potential distribution between adjacent ones of the progressive wave generating electrodes 341*b*, so as to develop an image having a uniform density on the surface of the photosensitive drum 301. Moreover, excellent image forming can be performed because such problems as blotching, in which the toner T adheres to a non-developing area on the surface of the photosensitive drum 301, can be prevented. Moreover, because the pitch λ of adjacent ones of the progressive wave generating electrodes 341*b* is varied stepwise from 120 μm, 250 μm, to 500 μm, the pitch λ of adjacent ones of the progressive wave generating electrodes 341*b* is set optimally, without becoming excessively wide or narrow.

If the pitch λ between adjacent ones of the electrodes is narrower than 100 μm, there is a possibility that the progressive wave generating electrodes 341*b* are not formed properly when the toner transportation member 341 is manufactured, thereby resulting in leakage between adjacent ones of the progressive wave generating electrodes 341*b*. On the other hand, if the pitch λ between adjacent ones of the electrodes is wider than 1000 μm, it is necessary to apply high voltages in order to cause the progressive wave electric field to be strong enough to transport the toner T. As a result, there is a possibility that costs for the power source are increased, and unnecessary noise is caused by vibration of the toner transportation member 341. However, by setting the pitch λ of adjacent ones of the progressive wave generating electrodes 341*b* to 120 μm, 250 μm, and 500 μm, it is possible to prevent the leakage between adjacent ones of the progressive wave generating electrodes 341*b*, to reduce the costs for the power source, and to reduce the noise caused by the vibration of the toner transportation member 341.

Furthermore, because the gap d between the toner transportation member 341 and the photosensitive drum 301 is within a range of 300 μm to 2000 μm, the pitch λ of adjacent ones of the progressive wave generating electrodes 341*b* is set optimally, without becoming excessively wide or narrow.

If the gap between the toner transportation member and the photosensitive drum 301 is excessively narrow, blotching, in which the developer adheres to the non-developing area, is likely to occur, and the image forming becomes unstable because the strength of the developing electric field is significantly changed even by a slight inaccuracy of the gap. On the other hand, if the gap between the toner transportation member and the photosensitive drum 301 is excessively wide, the charge potential needs to be high, so as to attain the field intensity necessary to return the unnecessary toner to the toner transportation member 341. This increases a load applied to the photosensitive drum 301, thereby causing deterioration of the photosensitive drum 301. However, by setting the gap d between the toner transportation member 341 and the photosensitive drum 301 to 300 μm to 2000 μm, it is possible to prevent blotching of the photosensitive drum 301 and to stabilize the developing field intensity, so that the image forming can be performed smoothly. Moreover, it is possible to lower the charge potential of the photosensitive drum 301 so as to decrease the load applied to the photosensitive drum 301, thereby preventing deterioration of the photosensitive drum 30.

As shown in FIG. 23, a peripheral velocity vp (mm/s) of the photosensitive drum 301, a latent image writing resolution R (dot/mm) in the perimeter direction of the photosensitive drum 301, and the frequency f (Hz) of the voltages applied to the progressive wave generating electrodes 341*b* satisfy $$vp \times R > f.$$

This setting is based on an analysis of periodical density unevenness under different magnitude relationships between (i) a spatial frequency vp×R (dot/sec) of the electrostatic latent image on the surface of the photosensitive drum 301, and (ii) the frequency f of the voltages applied, and under different (a) frequencies f of the voltages applied, (b) image resolutions R, and (c) peripheral velocities vp of the photosensitive drum 301, as shown in FIG. 23. Specifically, this setting is adopted because, if the spatial frequency vp×R (dot/sec) of the electrostatic latent image and the frequency f of the voltages applied satisfy vp×R>f in FIG. 23, (if a total evaluation is B (good) or A (very good)), the periodical density unevenness is reduced favorably or very favorably. Note that FIG. 23 is based on results of an experiment conducted under the following conditions:

TABLE 5

| CONDITION OF EXPERIMENT | PITCH λ (μm) BETWEEN ELECTRODES 250 | 500 |
|---|---|---|
| VOLTAGE OF PROGRESSIVE WAVE | 0 ± 375 V | 0 ± 500 V |
| WIDTH (μm) OF ELECTRODES | 100 | 200 |
| FREQUENCY | VARIABLE | |
| WAVEFORM | RECTANGULAR WAVE | |
| NUMBER OF PHASES AND AMOUNT OF PHASE LAG | FOUR, 90° | |
| CHARGE POTENTIAL V0 OF PHOTOSENSITIVE DRUM | −1000 V | |

With this setting, the voltages applied to the progressive wave generating electrodes 341*b* have such a frequency f that is lower than the spatial frequency vp×R (dot/sec) of the electrostatic latent image on the surface of the photosensitive drum 301.

Figure 24:
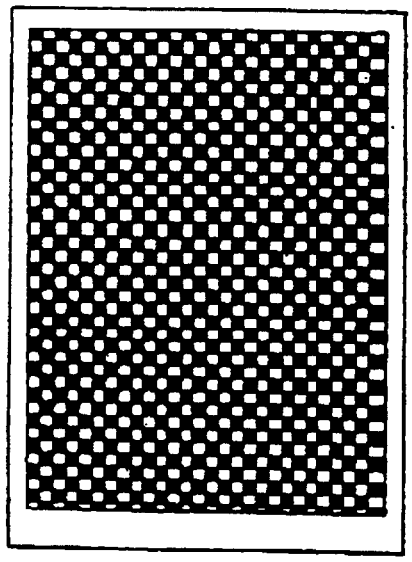
FIG. 24(*a*) is an explanatory diagram illustrating a uniform and excellent image with no unevenness in development density.
Figure 24:
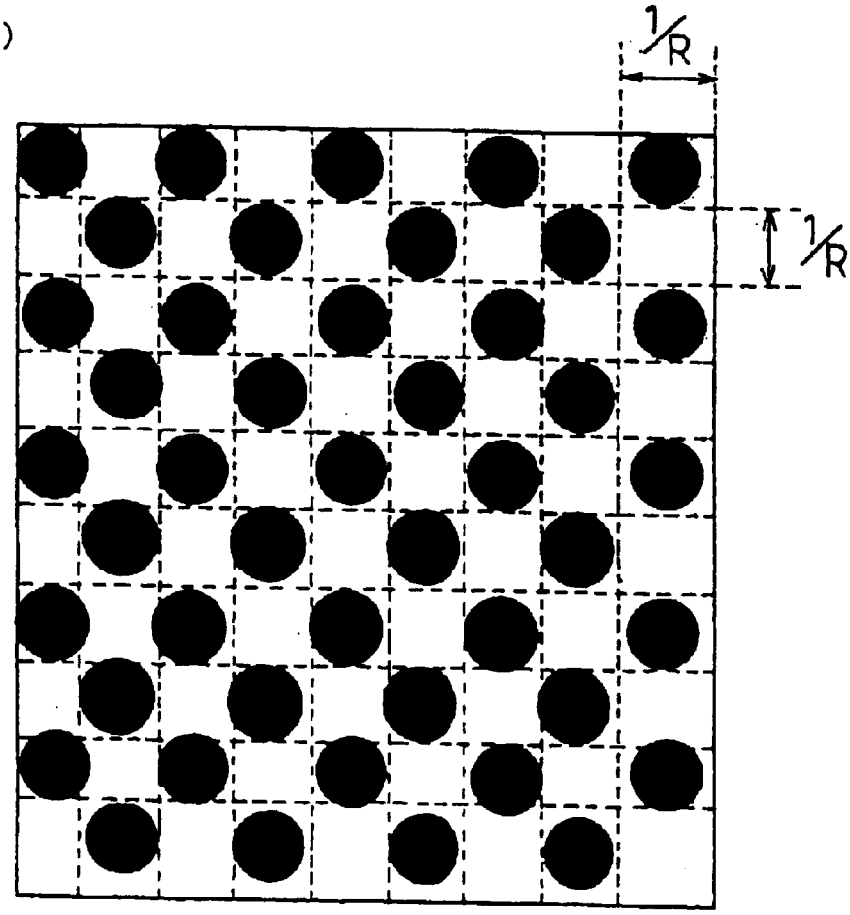
Figure 26:
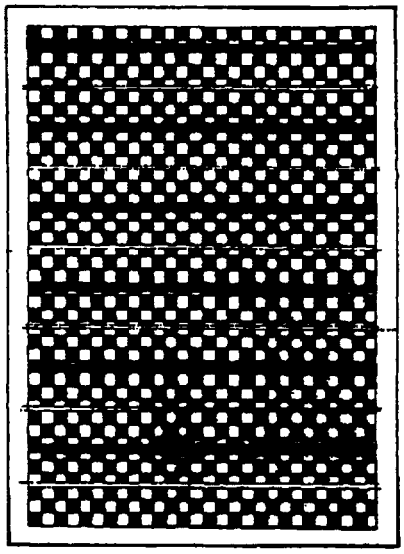
FIG. 26(*a*) is an explanatory diagram illustrating an image having periodical unevenness in development density.
Figure 26:
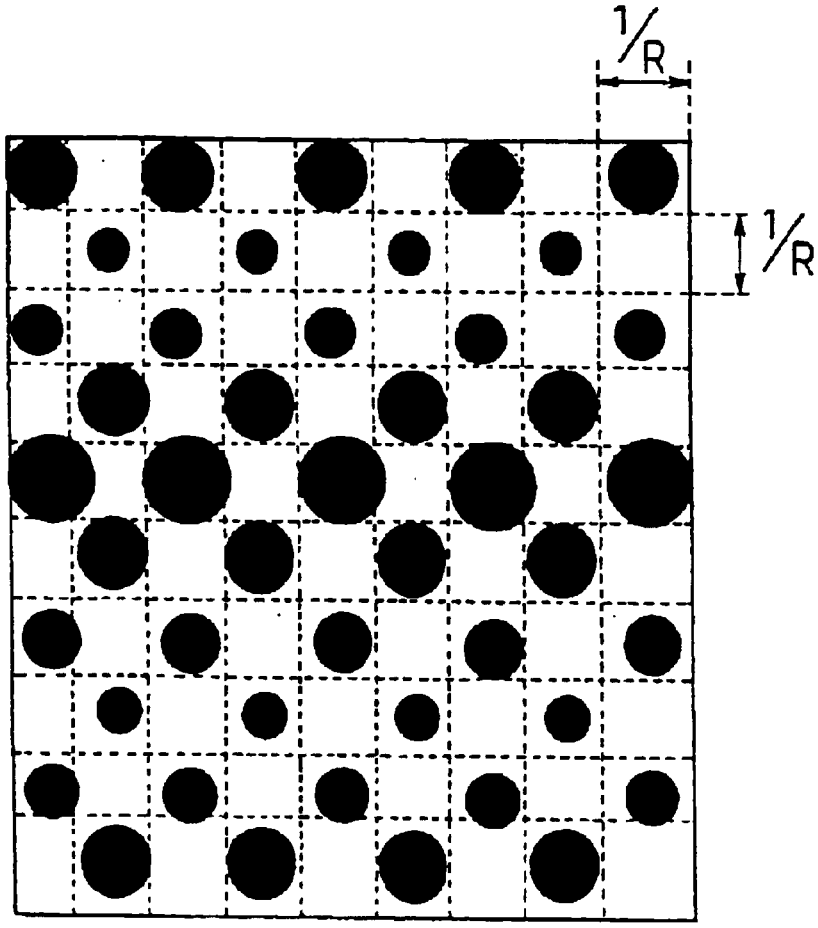

If the spatial frequency vp×R of the electrostatic latent image on the surface of the photosensitive drum 301 is higher than the frequency f of the progressive wave electric field, states of development are different per plural pixels on the surface of the photosensitive drum 301, between a case in which the voltages applied to the progressive wave generating electrodes 341*b* are maximum, and a case in which the voltages applied to the progressive wave generating electrodes 341*b* are minimum, as shown in FIG. 26(*a*) and 26(*b*). As a result, periodical unevenness in development density is caused. On the other hand, if the voltages having a high frequency f are applied to each of the progressive wave generating electrodes 341*b*, each pixel on the surface of the photosensitive drum 301 is developed by experiencing the voltages of a maximum value and the voltage of a minimum value. Although this eliminates the unevenness in development density among the pixels, the costs for the power source are increased. The foregoing setting is made to solve this problem. Here, the surface of the photosensitive drum 301 that is in close proximity with the surface of the toner transportation member 341 is hardly influenced by the potential distribution between adjacent ones of the progressive wave generating electrodes 341*b*, if (i) the gap d between the toner transportation member 341 and the photosensitive drum 301 and (ii) the pitch λ between adjacent ones of the progressive wave generating electrodes 341*b* are set to satisfy d>λ. Therefore, by applying, to the progressive wave generating electrodes 341*b*, the voltages having the frequency f lower than the spatial frequency vp×R of the electrostatic latent image on the surface of the photosensitive drum 301, it is possible to perform uniform image forming with no unevenness in development density, as shown in FIGS. 24(*a*) and 24(*b*). Moreover, it is possible to reduce the costs for the power source, so as attain a reasonable price.

As shown in FIG. 25, an average value V301 (V) of the voltages applied to the progressive wave generating electrodes 341*b*, a charge potential V300 (V) in the non-developing area of the photosensitive drum 301, and the gap d (m) between the toner transportation member 341 and the photosensitive drum 301 satisfy $$|V0-V1|/d>10^4.$$

This setting is based on an analysis of the occurrence of blotching under different gaps d and voltages V applied to the progressive wave generating electrodes 341*b*, as shown in FIG. 25. If a quotient of (i) an absolute value of a difference between the charge potential V0 in the non-developing area of the photosensitive drum 301 and the average value V1 of the voltages applied to the progressive wave generating electrodes 341*b*, by (ii) the gap d between the toner transportation member 341 and the photosensitive drum 301 is larger than $10^4$, that is, if |V0−V1|/d, which is field intensity with which unnecessary toner is returned to the toner transportation member 341, is larger than $10^4$ (if an evaluation in FIG. 25 is B (good) or A (very good)), blotching is reduced favorably or very favorably. Note that FIG. 25 is based on results of an experiment conducted under the following conditions:

TABLE 6

| CONDITION OF EXPERIMENT | PITCH λ (μm) BETWEEN ELECTRODES 250 |
|---|---|
| VOLTAGE OF PROGRESSIVE WAVE | A ± 375 V (A: VARIABLE) |
| WIDTH (μm) OF ELECTRODES | 100 |
| FREQUENCY | 1 kHz |
| WAVEFORM | RECTANGULAR WAVE |
| NUMBER OF PHASES AND AMOUNT OF PHASE LAG | FOUR, 90° |
| CHARGE POTENTIAL V0 OF | VARIABLE |

TABLE 6-continued

| CONDITION OF EXPERIMENT | PITCH λ (μm) BETWEEN ELECTRODES 250 |
|---|---|
| PHOTOSENSITIVE DRUM | |

With the setting above, decided is strength of an effect by which unnecessary toner is returned onto the toner transportation member 341 so that the unnecessary toner does not adhere to the non-image area (non electrostatic latent image part) or scatter in the apparatus. Here, the unnecessary toner is the toner that did not contribute to development of the electrostatic latent image on the surface of the photosensitive drum 301 when the toner in a cloud-like state transported by the progressive wave electric field reached a vicinity of the photosensitive drum 301. In other words, decided is strength of an effect by which the unnecessary toner is returned to the toner transportation member 341 by a force applied in a direction in which the toner T is returned to the toner transportation member 341, the force being given by the electric field between the non-image area of the photosensitive drum 301 and the toner transportation member 341. Here, an important factor (the strength of the effect by which unnecessary toner is returned to the toner transportation member 341) is the quotient of (i) the absolute value of the difference between the charge potential V0 in the non-developing area of the photosensitive drum 301 and the average value V1 of the voltages applied to the progressive wave generating electrodes 341*b*, by (ii) the gap d between the toner transportation member 341 and the photosensitive drum 301. By setting the quotient to be larger than $10^4$, it is possible to perform excellent image forming with no blotching.

Furthermore, by providing the developing apparatus 304 to an image forming apparatus X, it is possible to provide an image forming apparatus X that can develop, on the surface of the photosensitive drum 301, an image having uniform density, and that can perform excellent image forming with little blotching.

Note that, as described in the embodiment above, the present invention is not limited to an electrostatic latent image formed by writing optical information onto a photosensitive drum electrically charged with a predetermined charge. The present invention may be applied to a method such as an ion flow method, in which an electrostatic latent image is formed directly on a dielectric material. Alternatively, the present invention may be applied to a method such as a toner jet method, in which image forming is carried out directly by (i) applying an arbitrary voltage to an electrode having a plurality of openings, so that a latent image is formed in the air, and (ii) spraying the developer on a recording medium.

With reference to the drawings, the following specifically describes a further embodiment of the present invention.

Figure 27:
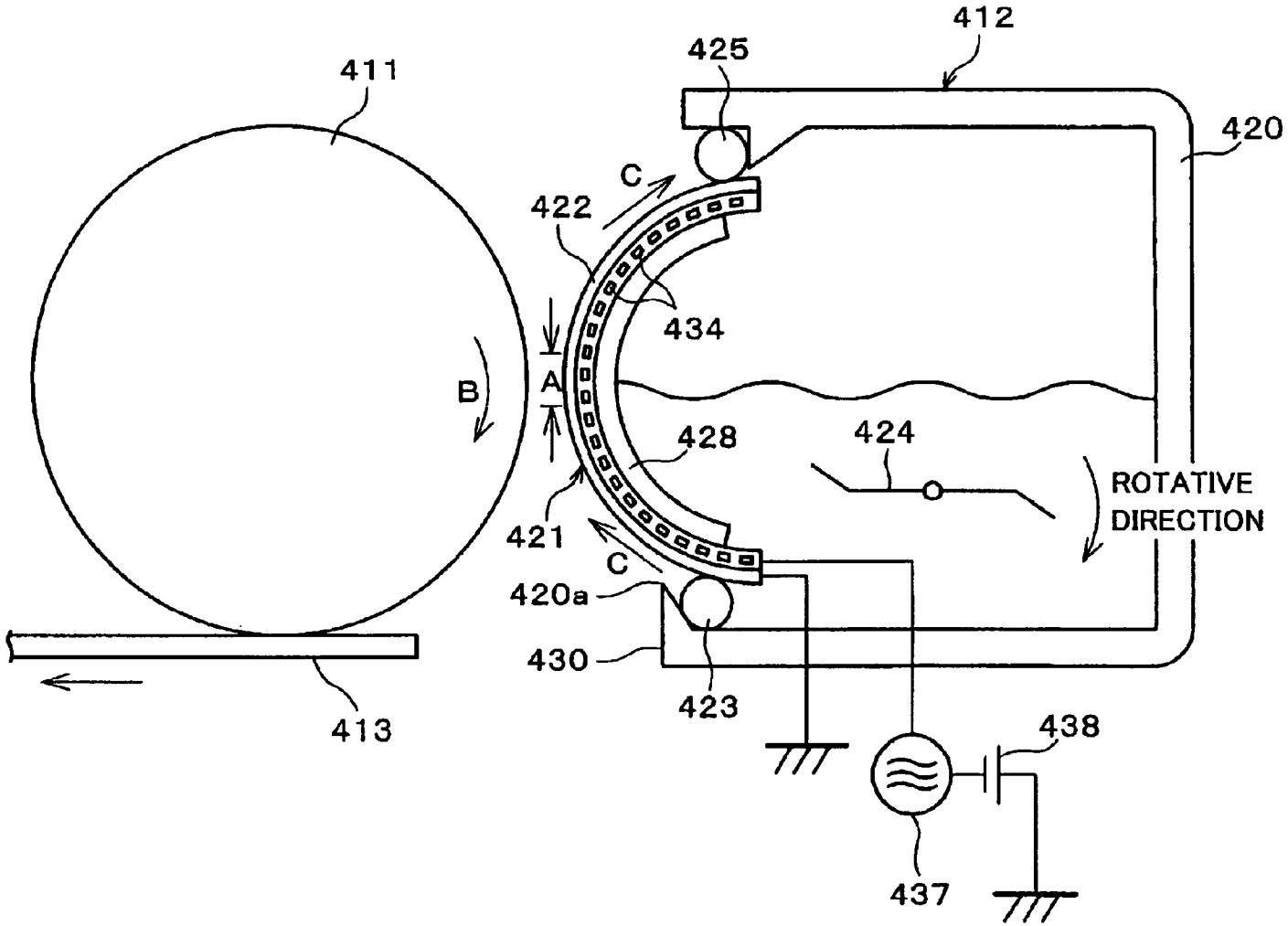
FIG. 27 is a schematic diagram illustrating, with partial enlargement, an image forming apparatus using a developing apparatus of an embodiment of the present invention.

FIG. 27 is a schematic diagram illustrating, with partial enlargement, an image forming apparatus using a developing apparatus of the present embodiment. The image forming apparatus forms an image by an electrophotographic method. Specifically, the image is formed as follows. A photosensitive drum 411 is rotated in a direction of an arrow B. Meanwhile, a surface of the photosensitive drum 411 is electrically charged evenly. The surface of the photosensitive drum 411 is scanned by a laser beam, so that an electrostatic latent image is formed on the photosensitive drum 411. A developing apparatus 412 causes toner to adhere to the electrostatic latent image, so that a toner image is formed. The toner image is transferred from the photosensitive drum 411 to a recording sheet 413. Then, the toner image on the recording sheet 413 is fixed by heating and pressurizing. After that, the photosensitive drum 411 is cleaned by removing remaining toner on the photosensitive drum 411. Finally, a remaining potential on the surface of the photosensitive drum 411 is removed.

For these processing steps, not only the developing apparatus 412, but also a transferring apparatus, a cleaning apparatus, an exposing apparatus and the like (all not shown) are provided to surround the photosensitive drum 411 in this order from an upstream side of a rotative direction of the photosensitive drum 411. Moreover, a fixing apparatus is provided on a downstream side in a traveling direction of the recording sheet.

For example, the photosensitive drum 411 is a metal drum made of aluminum or the like, and provided with a photoconductive layer made of amorphous silicon (a-Si), selen (Se), organic photoconductor (OPC) or the like, the photosensitive layer being provided to a circumferential surface of the metal drum.

For example, the charging apparatus includes (i) a corona charger made of such as (a) a charge wire such as a tungsten wire, (b) a shielding plate made of metal, or (c) a grid plate, (ii) a charging roller, and (iii) a charging brush. The exposing apparatus includes a semiconductor laser, a light-emitting diode, and the like. The transferring apparatus includes a corona transferrer, a transferring roller, a transferring brush, or the like.

The developing apparatus 412 of the present embodiment includes a developing tank 420, a toner transportation path 421, a supplying roller 423, a mixing paddle 424, a collecting roller 425, and the like. The developing apparatus 412 contains the toner. The toner transportation path 421 generates a progressive wave electric field, so as to transport the toner. The supplying roller 423 supplies the toner from the developing tank 420 to the toner transportation path 421. The mixing paddle 424 stirs the toner in the developing tank 420, and moves the toner to the supplying roller 423. The collecting roller 425 collects the toner from the toner transportation path 421 into the developing tank 420.

The developing tank 420 has an opening 420*a* facing a lateral portion of the photosensitive drum 411. To the opening 420*a*, a supporting body 428 having a semicylindrical shape is fixed. The toner transportation path 421 is fixed on a circumferential surface of the supporting body 428. Thus, the opening 420*a* of the developing tank 420 is blocked by the toner transportation path 421. Inside of this is a storage for the toner. Note that a position of the developing tank 420 with respect to the photosensitive drum 411 may be varied.

At a lower portion of a rim of the opening 420*a*, a holding section 430 is provided. The holding section 430 has a sloped surface directed toward the photosensitive drum 411. The toner is held by the sloped surface. The toner adheres to the toner transportation path 421 after electrically charged by the supplying roller 423, and supplied to the toner transportation path 421. At this time, the toner having insufficient amount of electric charge drops out of the toner transportation path 421. The holding section 430 is provided to receive the toner, so as to prevent the toner from scattering.

The supplying roller 423 is made of sponge-type urethane foam, for example. The supplying roller 423 is provided along a lower end of the toner transportation path 421, and is rotatably supported. By being driven by a motor or the like (not shown), the supplying roller 423 rotates in a counterclockwise direction, and supplies the toner to the toner transportation path 421. In supplying the toner, the supplying roller 423 regulates, while charging the toner, thickness of the toner that adheres to a surface protective layer 422 of the toner transportation path 421. The supplying roller 423 is in contact with the protective layer 422 of the toner transportation path 421 in an abrading manner, and also in contact with a bottom surface of the developing tank 420 in an abrading manner, so as to collect the toner held by the sloped surface of the holding section 430, and to prevent the toner from leaking from the developing tank 420. It may be so arranged that a direct current power source for charging the toner is connected to the supplying roller 423.

The collecting roller 425 is a roller made of such material as urethane rubber, silicone rubber, or EPDM (ethylene propylene), mixed with carbon black or ionic conductive material. Alternatively, the collecting roller 425 is a roller made of such conductive material as (i) stainless copper, (ii) nickel-coated steel, (iii) aluminum, or (iv) copper. The collecting roller 425 is provided along an upper surface of the toner transportation path 421, and is rotatably supported. By being driven by a motor or a like (not shown), the collecting roller 425 rotates in the counterclockwise direction. The collecting roller 425 is in contact with the surface protective layer 422 of the toner transportation path 421 in an abrading manner. The collecting roller 425 removes the remaining potential from the surface protective layer 422, scraps the toner off the surface protective layer 422 so as to clean the surface protective layer 422, and collects the toner into the developing layer 420.

Figure 28:
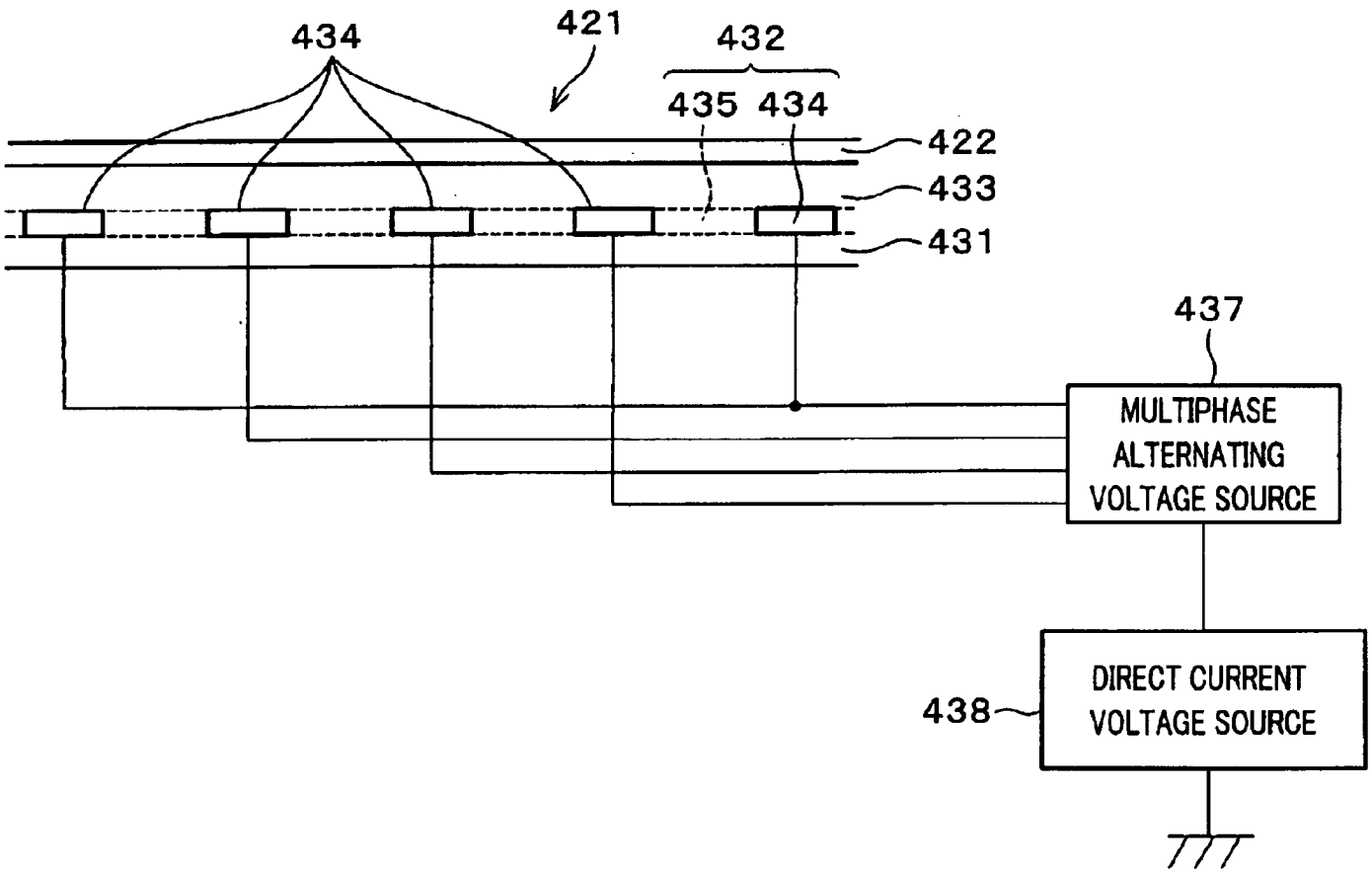
FIG. 28 is a view illustrating a cross-sectional structure of a toner transportation path of the developing apparatus in FIG. 27.

For example, as shown in FIG. 28, the toner transportation path 421 is structured as follows: (i) On a substrate 431, which is made of polyimide or the like, and is approximately 25 $\mu$m in thickness, a generating electrode body (EPC belt) 432 is provided; and (ii) On the generating electrode body 432, an insulating layer 433 and the surface protective layer 422, which are made of polyimide or the like, and are approximately 25 $\mu$m in thickness, are laminated.

The surface protective layer 422 covers and protects that side of the toner transportation path 421 which faces the photosensitive drum 411. This prevents, from being electrically charged, the substrate 431, the insulating layer 433 and the like, which are in the toner transportation path 421, and prevents firm adhering of the toner. The surface protective layer 422 is made of (i) an organic insulating material such as polyimide, PET (polyethylene terephthalate), poly (ethylene tetrafluoride), poly (ethylene-propylene fluoride), or PTFE (polytetrafluoroethylene), or (ii) a material in which a carbon black or ionic conductive material is dispersed in or evenly mixed with a rubber material such as silicon, isoprene, or butadiene.

The generating electrode body (EPC belt) 432 includes a plurality of progressive wave generating electrodes 434 made of copper foil of approximately 18 $\mu$m in thickness, and insulating layers 435. The progressive wave generating electrodes 434 are embedded in the insulating layers 435. There are predetermined intervals between adjacent ones of the progressive wave generating electrodes 434.

The insulating layer 433 and the insulating layers 435 may be made of different materials or the same material. For example, both the insulating layer 433 and the insulating layers 435 are made of polyimide.

The toner transportation path 421 is so thin and elastic that it is possible to bent the toner transportation path 421 along an outer circumferential surface of the supporting body 428 having the cylindrical shape, so as to attach the toner transportation path 421 to the outer circumferential surface.

For example, the progressive wave generating electrodes 434 of the toner transportation path 421 are approximately 40 μm to 250 μm in width, and are so disposed parallel to each other that there are intervals of 50 dpi to 300 dpi (approximately 500 μm to approximately 85 μm) between adjacent ones of the electrodes. The progressive wave generating electrodes 434 are provided from the lower end to the upper end of the toner transportation path 421. The progressive wave generating electrodes 434 are divided into plural sets, each set including three or four of the progressive wave generating electrodes 434.

Figure 29:
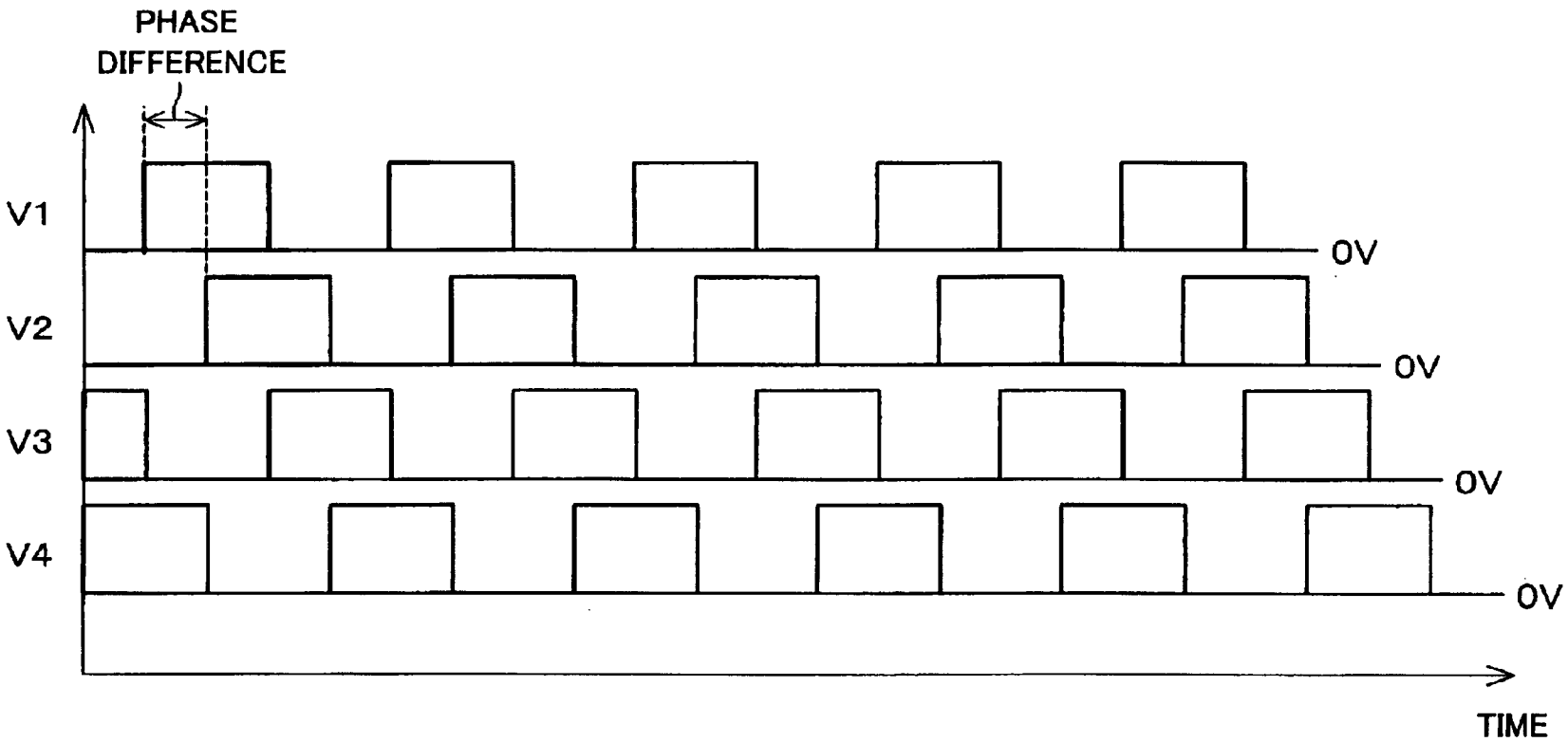
FIG. 29 illustrates waveforms of four alternating voltages having different phases applied to progressive wave generating electrodes of the toner transportation path in FIG. 28.

The progressive wave generating electrodes 434 of each set receive multiphase alternating voltages from an alternating voltage source 437. For example, if each set includes four progressive wave generating electrodes 434, and four alternating voltages having different phases are applied to the set, four alternating voltages V1 to V 4 shown in FIG. 29 are applied to the four progressive wave generating electrodes 434, respectively. This generates a progressive wave electric field. Because the progressive wave generating electrodes 434 are provided from the lower end to the upper end of the toner transportation path 421, the progressive wave electric field is generated from the lower end to the upper end of the toner transportation path 421. The progressive wave electric field transports the toner in a direction of arrow C from the lower end to the upper end of the toner transportation path 421.

For example, the four alternating voltages are set to 100V to 3 kV, so that no dielectric breakdown occurs between adjacent ones of the progressive wave generating electrodes 434. A frequency of the four alternating voltages is set to 20 Hz to 10 kHz. The alternating voltages and the frequency of the four alternating voltages are set appropriately in accordance with a shape of the progressive wave generating electrodes 434, a transportation speed of the toner, properties of the toner, and the like.

Figure 30:
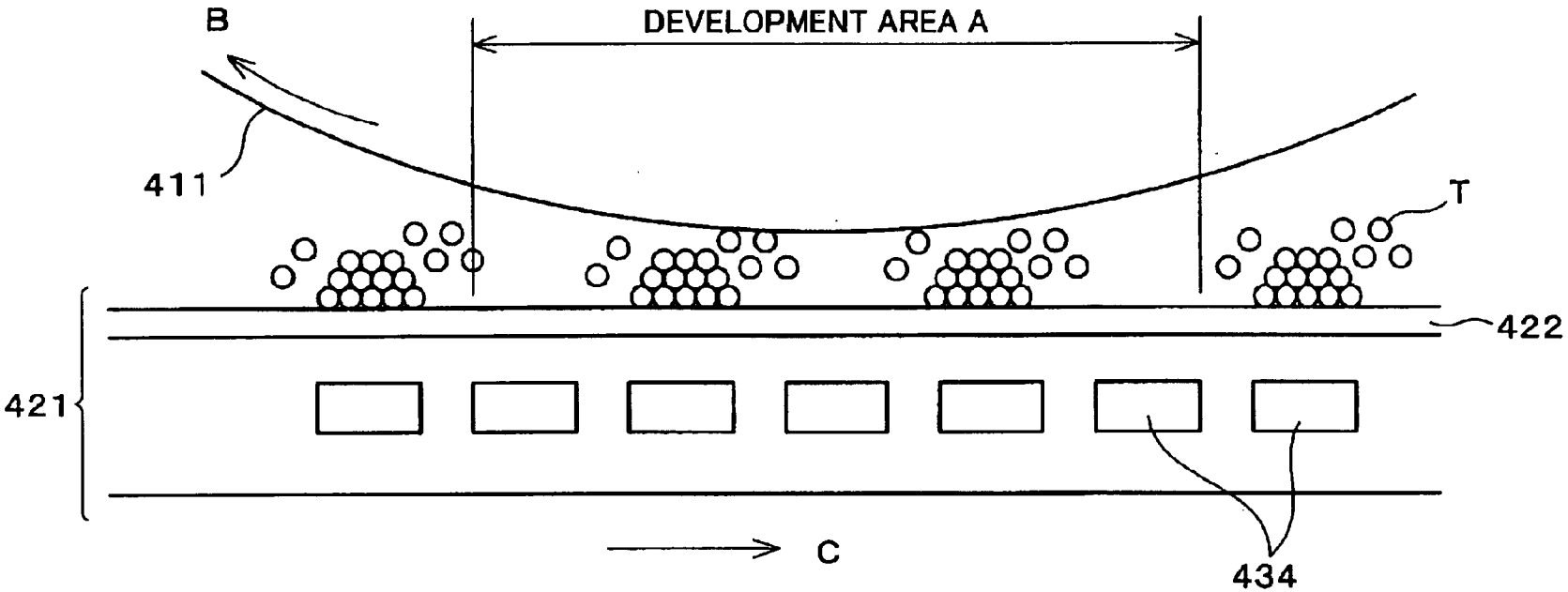
FIG. 30 is an enlarged view illustrating a part of the image forming apparatus in FIG. 27 with partial enlargement.

As described above, the supplying roller 423 supplies the toner from the developing tank 420 to the toner transportation path 421. The progressive wave electric field transports the toner from the lower end to the upper end of the toner transportation path 421. Then, the collecting roller 425 collects the toner from the toner transportation path 421 into the developing tank 420. Meanwhile, between the photosensitive drum 411 and the toner transportation path 421, a bias direct current that generates a developing electric field is applied by a direct current power source 438. In a development area A where the photosensitive drum 411 and the toner transportation path 421 are close to each other as shown in FIG. 30, the developing electric field causes the toner T to be sprayed from the toner transportation path 421 onto the electrostatic latent image on the photosensitive drum 411. Thus, the toner T adheres to the electrostatic latent image, thereby forming a toner image.

Incidentally, when the toner is transported on the toner transportation path 421 by the progressive wave electric field, periodical density unevenness of the toner is caused, in accordance with the frequency of the four alternating voltages applied to the progressive wave generating electrodes 434. However, in the image forming apparatus of the present embodiment, the photosensitive drum 411 is rotated in the direction of arrow B, and the toner is transported in the direction of arrow C on the toner transportation path 421. In other words, the rotative direction of the photosensitive drum 411 and the traveling direction of the toner are opposite. With this setting, the toner on the toner transportation path 421 and the electrostatic latent image on the photosensitive drum 411 pass each other, so that the toner can be supplied to any part of the electrostatic latent image from a broad range in the toner transportation path 421. Because of this, the density unevenness of the toner disappears in a process of supplying the toner from the toner transportation path 421 to the photosensitive drum 411. Therefore, the density unevenness of the toner does not appear in the electrostatic latent image. This makes it possible to develop the electrostatic latent image on the photosensitive drum 411 uniformly.

In the present embodiment, the interval λ (μm) between adjacent ones of the progressive wave generating electrodes 434, and the frequency f (kHz) of the multiphase alternating voltages are set to satisfy $10 \leqq \lambda \times f \leqq 800$. This makes it possible to suppress the density unevenness of the toner, and to transport the toner stably on the toner transportation path 421. As a result, it is possible to stabilize quality of the toner image formed by developing the electrostatic latent image.

FIG. 31(*a*) shows a result of an experiment in which a value of λ×f is changed appropriately, and with respect to each value of λ×f, a transportation state and the density unevenness of the toner are judged, and a total evaluation level is decided. The experiment is conducted with respect to a case in which the rotative direction of the photosensitive drum 411 and the traveling direction of the toner are opposite, and a case in which the rotative direction of the photosensitive drum 411 and the transportation traveling direction of the toner are the same. FIG. 31(*b*) shows conditions of the experiment.

Figure 32:
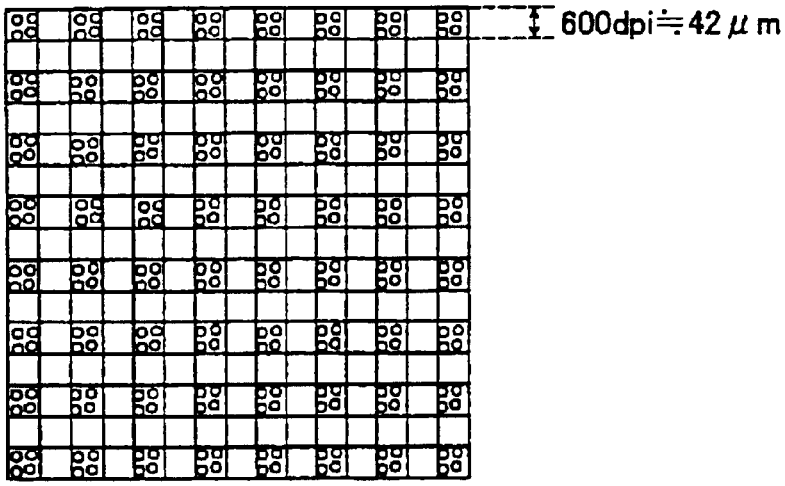
FIGS. 32(*a*), 32 (*b*), and 32 (*c*) are views conceptually illustrating the density unevenness on a photosensitive drum.
Figure 32:
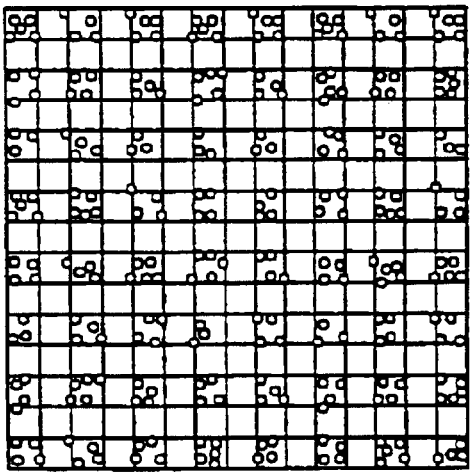
Figure 32:
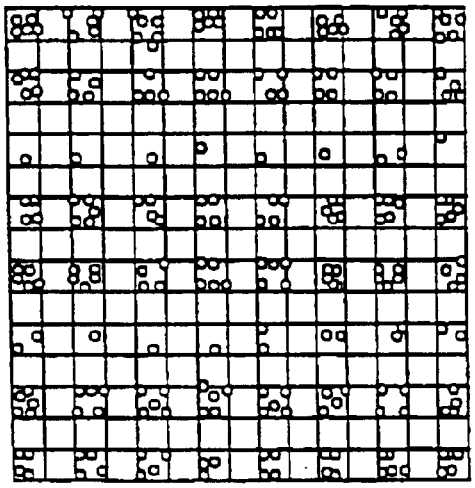

FIGS. 32(*a*), 32(*b*), and 32(*c*) show the density unevenness on the photosensitive drum 411. In FIG. 32(*a*), density is uniform among dots, and a result of evaluation on the density unevenness is A (very good). In FIG. 32(*b*), density unevenness is caused slightly, and a result of evaluation on the density unevenness is 'B' (good). In FIG. 32(*c*), density unevenness is caused significantly, and a result of evaluation on density unevenness is 'C' (bad).

As is obvious from FIG. 31, in the case in which the rotative direction of the photosensitive drum 411 and the traveling direction of the toner are opposite, the transportation state and the density unevenness are good under a setting of $10 \leqq \lambda \times f \leqq 800$. On the other hand, if the interval λ and the frequency f are set to satisfy $\lambda \times f > 800$, the frequency is so high as compared with the interval λ, that the progressive wave electric field is switched before the toner is transported over the progressive wave generating electrodes 434. Therefore, much of the toner moves in an opposite direction, without following the progressive wave electric field. As a result, the density unevenness of the toner becomes significant, thereby increasing the density unevenness in the toner image. Moreover, if the interval λ and the frequency f are set to satisfy $\lambda \times f < 10$, an amount of the toner T transported is drastically decreased.

If the rotative direction of the photosensitive drum 411 and the traveling direction of the toner are the same, as in conventional arrangements, λ×f needs to be very high; otherwise, the density unevenness cannot be reduced. As a result, a good transportation state and density unevenness cannot be attained at the same time.

Note that the present invention is not limited to the foregoing embodiment; the present invention may be varied in many ways. For example, the present invention may be carried out by using a photosensitive belt, instead of the photosensitive drum. The toner transportation path may be modified appropriately in accordance with a shape of a photosensitive body. Moreover, it is not necessary to ensure that the photosensitive body and the toner transportation path do not contact each other. Effects of the present invention can be attained even if the photosensitive body and the toner transportation path contact each other.

Figure 33:
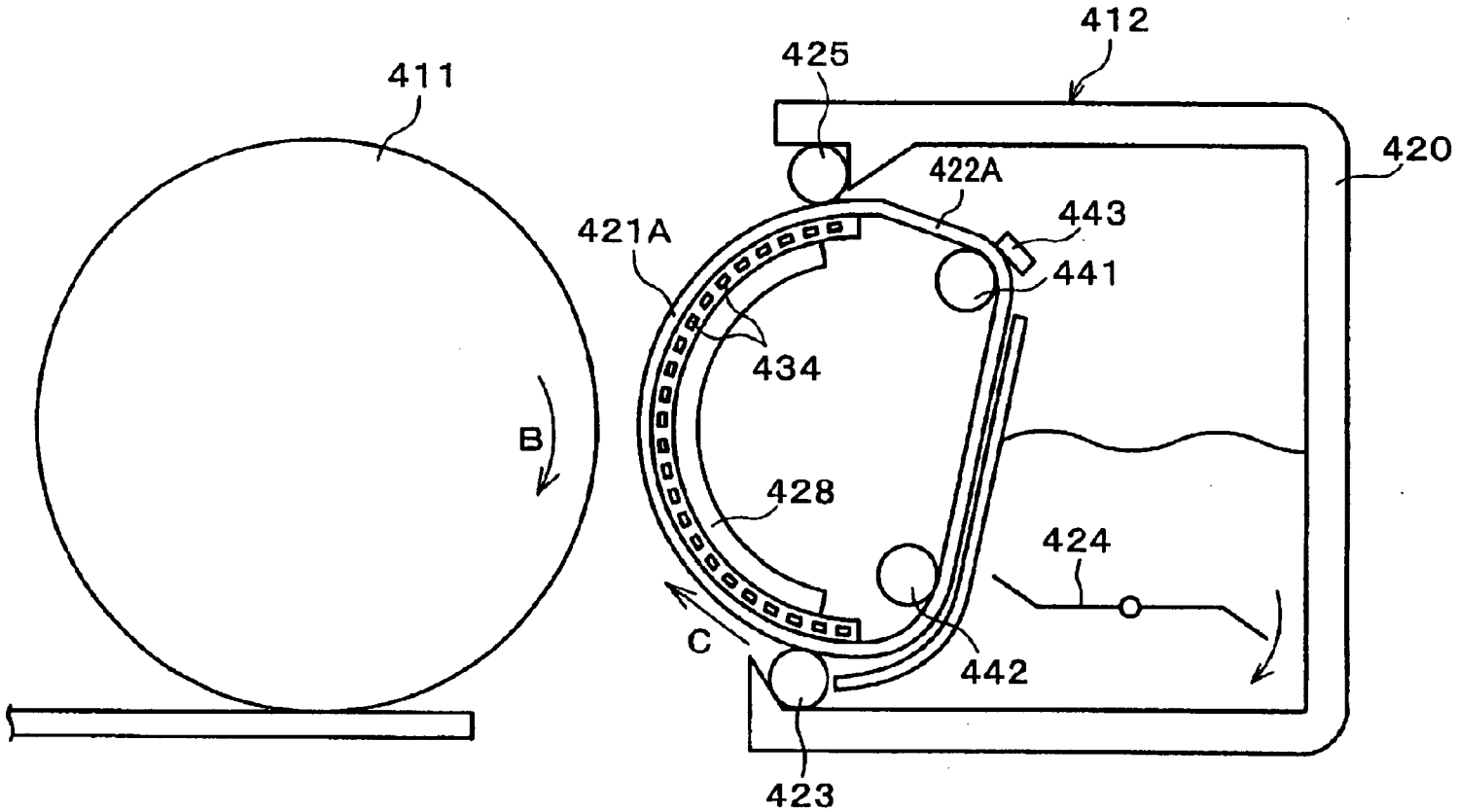
FIG. 33 is a schematic diagram illustrating a variation example of the developing apparatus of FIG. 27.

In the foregoing embodiment, the surface protective layer 422 is integrated with the toner transportation path 421. However, a separately provided surface protective layer may be moved along the toner transportation path. For example, as shown in FIG. 33, it may be so arranged that a surface protective layer 422A (i) has a shape of an endless belt, (ii) hangs on a driving roller 441 and a driven roller 442, and (iii) moves in the traveling direction of the toner when the driving roller 441 rotates in the counterclockwise direction. Use of such a surface protective layer 422A having a shape of an endless belt makes it possible to clean the surface protective layer 422A sufficiently by using a blade 443, so that always a refreshed part of the surface protective layer 422A faces the photosensitive drum 411.

Moreover, the surface protective layer 422A is in close contact with the surface of the toner transportation path 421A. This ensures that the surface protective layer 422A is not distanced from the progressive wave generating electrodes 434. As a result, intensity of the progressive wave electric field on the surface protective layer 422A is maintained, so that an excellent transportation property of the toner is maintained.

Moreover, the surface protective layer 422A is moved in the traveling direction of the toner at a speed sufficiently lower than the transportation speed of the toner. If the surface protective layer 422A is moved at a speed higher than the transportation speed of the toner, the density unevenness of the toner is caused. For example, if the surface protective layer 422A is moved at a high speed, airflow is caused on the surface of the surface protective layer 422A. The airflow unfixes the toner (toner in a cloud-like state), thereby causing the density unevenness of the toner. Therefore, the surface protective layer needs to be moved in such a speed that is equivalent to zero when compared with the transportation speed of the toner. For example, the surface protective layer 422A is moved at such a speed that is approximately 1/10 to 1/100 of the transportation speed of the toner. For example, the transportation speed of the toner is measured by a method in which the toner on the transportation path is detected by two infrared sensors, and time required for arrival of the toner is measured. Alternatively, the transportation speed of the toner is measured by a method using a high-speed video camera (IS&Ts NIP15: 1999 International Conference on Digital Technologies p.262–265 "Aspects of Toner Transport on a Traveling Device[2]").

The specific embodiments and examples in the "BEST MODE FOR CARRYING OUT THE INVENTION" section are described only for clarifying technical contents of the present invention. Therefore, the scope of the present invention must not be interpreted as being limited to these specific examples. The present invention may be modified in many ways within the scope of the spirit of the present invention and the following claims.

INDUSTRIAL APPLICABILITY

The present invention relates to an electrophotographic developing apparatus, in which an electrostatic latent image formed on an image supporting body is developed by using developer, and relates to an image forming apparatus using the developing apparatus. The present invention can be applied particularly to a developing apparatus and an image forming apparatus in which developer is transported to a development position on an image supporting body, by using a progressive wave electric field.

What is claimed is:

1. A developing apparatus in which an electrostatic latent image on a surface of an image supporting body is visualized by transporting developer to a development position by using a progressive wave electric field generated at transportation means, wherein:

the transportation means includes:

an insulating layer that covers a circumferential surface of progressive wave generating electrodes provided on a surface of a substrate; and a protective layer that protects a contact surface that contacts the developer, the insulating layer and the protective layer being laminated in this order; and a volume resistivity of the protective layer is lower than a volume resistivity of the insulating layer.

2. The developing apparatus as set forth in claim 1, wherein:

the volume resistivity of the protective layer is in a range of $10^{10}$ Ω·cm to $10^{17}$ Ω·cm.

3. The developing apparatus as set forth in claim 1, wherein:

the protective layer is grounded.

4. The developing apparatus as set forth in claim 1, wherein:

$$a1+a2<b$$

where a1 is thickness of the protective layer; a2 is thickness of the insulating layer; and b is a distance between adjacent ones of the progressive wave generating electrodes.

5. A developing apparatus comprising a developer transportation member, which is (i) provided at a development area that faces an image supporting body that supports, on a surface thereof, an electrostatic latent image, and (ii) made by coating, with a surface protective layer, a plurality of electrodes so provided on a substrate that there are predetermined intervals between adjacent ones of the electrodes, the developing apparatus transporting, on the developer transportation member, developer by using a progressive wave electric field generated by applying multiphase voltages to the electrodes, a gap d, in meter, between the developer transportation member and the image supporting body, and a pitch λ, in meter, between adjacent ones of the electrodes satisfy d>λ and wherein:

$$vp \times R > f$$

where vp, in millimeter per second, is a peripheral velocity of the image supporting body; R, in dot per millimeter, is a latent image writing resolution in a perimeter direction of the image supporting body; and f, in hertz, is a frequency of the voltages applied to the electrodes.

6. The developing apparatus as set forth in claim 5, wherein:

the pitch λ, in meter, between adjacent ones of the electrodes is 100 μm to 1000 μm.

7. The developing apparatus as set forth in claim 5, wherein:

the gap d, in meter, between the developer transportation member and the image supporting body is 0.1 mm to 10 mm.

8. An image forming apparatus, comprising:

the developing apparatus as set forth in claim 5.

9. A developing apparatus comprising a developer transportation member, which is (i) provided at a development area that faces an image supporting body that supports, on a surface thereof, an electrostatic latent image, and (ii) made by coating, with a surface protective layer, a plurality of electrodes so provided on a substrate that there are predetermined intervals between adjacent ones of the electrodes, the developing apparatus transporting, on the developer transportation member, developer by using a progressive wave electric field generated by applying multiphase voltages to the electrodes, a gap d, in meter, between the developer transportation member and the image supporting body, and a pitch λ, in meter, between adjacent ones of the electrodes satisfy d>λ and wherein:

$$|V0-V1|/d>10^4$$

where V1, in volts, is an average value of the voltages applied to the electrodes; V0, in volts, is a charge potential of a non-image area of the image supporting body, and d, in meter, is the gap between the developer transportation member and the image supporting body.

10. The developing apparatus as set forth in claim 9, wherein:

the pitch λ, in meter, between adjacent ones of the electrodes is 100 μm to 1000 μm.

11. The developing apparatus as set forth in claim 9, wherein:

the gap d, in meter, between the developer transportation member and the image supporting body is 0.1 mm to 10 mm.

12. An image forming apparatus, comprising:

the developing apparatus as set forth in claim 9.

* * * * *